US009056481B2

(12) United States Patent
Oya

(10) Patent No.: US 9,056,481 B2
(45) Date of Patent: Jun. 16, 2015

(54) CARTRIDGE, LIQUID EJECTION DEVICE, AND LIQUID EJECTION SYSTEM

(71) Applicant: SEIKO EPSON CORPORATION, Tokyo (JP)

(72) Inventor: Shun Oya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/194,343

(22) Filed: Feb. 28, 2014

(65) Prior Publication Data

US 2014/0240411 A1 Aug. 28, 2014

(30) Foreign Application Priority Data

Feb. 28, 2013 (JP) ..... 2013-039456

(51) Int. Cl.
*B41J 2/175* (2006.01)

(52) U.S. Cl.
CPC ..... *B41J 2/1752* (2013.01); *B41J 2/17526* (2013.01)

(58) Field of Classification Search
CPC ..... B41J 2/175; B41J 2/1752; B41J 2/17546; B41J 2/17506; B41J 2/17509; B41J 2/1753
USPC ..... 347/50, 84–87
See application file for complete search history.

(56) References Cited

U.S. PATENT DOCUMENTS

| | | | | |
|---|---|---|---|---|
| 6,375,315 | B1 * | 4/2002 | Steinmetz et al. | 347/86 |
| 2008/0049069 | A1 | 2/2008 | Inamura et al. | |
| 2008/0049080 | A1 | 2/2008 | Hayashi et al. | |
| 2008/0049081 | A1 | 2/2008 | Hayashi et al. | |

FOREIGN PATENT DOCUMENTS

| | | | |
|---|---|---|---|
| CN | 203093328 | U | 7/2013 |
| JP | 2008-049566 | A | 3/2008 |
| JP | 2008-074090 | A | 4/2008 |
| JP | 2008-074100 | A | 4/2008 |
| WO | 2014/121637 | A1 | 8/2014 |

* cited by examiner

*Primary Examiner* — Juanita D Jackson
(74) *Attorney, Agent, or Firm* — Stroock & Stroock & Lavan LLP

(57) ABSTRACT

The invention provides a technique for raising the reliability of contact between contact members of a liquid ejection device and terminals of a cartridge. A cartridge is configured to be removably mounted to a liquid ejection device including a first engaging portion and a conductive contact member that has elastic force and that is arranged so as to be adjacent to the first engaging portion. The cartridge includes a terminal arranged so as to be able to come into contact with the conductive contact member, and a first hook that can be engaged with the first engaging portion.

10 Claims, 68 Drawing Sheets

CROSS-SECTION ALONG F4A-F4A

CROSS-SECTION OF F6-F6 PORTION

CROSS-SECTION ALONG F15-F15

CROSS-SECTION ALONG F35A-F35A

CARTRIDGE, LIQUID EJECTION DEVICE, AND LIQUID EJECTION SYSTEM

BACKGROUND

1. Technical Field

The entire disclosure of Japanese Patent Application No.: 2013-039456, filed Feb. 28, 2013 is expressly incorporated by reference herein.

The present invention relates to a technique that is related to cartridges for storing a liquid.

2. Related Art

There is a conventionally known technique of employing an ink cartridge for storing ink (also simply called a "cartridge") as a technique for supplying ink to a printer, which is one example of a liquid ejection device. This cartridge includes a liquid storage portion for storing ink serving as the liquid, and a liquid supply portion for supplying the ink in the liquid storage portion to a printer.

There is also known to be a cartridge that includes a circuit substrate for exchanging information with a printer (e.g., see JP-A-2008-074100). This circuit substrate stores information regarding the cartridge, such as information indicating the manufacturing date of the cartridge and the color of stored ink. When the cartridge is mounted to the cartridge mounting portion of the printer, terminals of the circuit substrate come into contact with conductive contact members arranged on the cartridge mounting portion. The circuit substrate and the printer are thus electrically connected, making it possible for various types of information to be exchanged between the circuit substrate and the printer.

When the cartridge is in the mounted state, it is subjected to various external forces. One example of an external force is force that the conductive contact members exert on the cartridge (biasing force). Another example of an external force is the force exerted on the cartridge when the printer performs a printing operation or the like. If the printer is of the type in which the cartridge mounting portion is installed on the carriage that is provided with the head (i.e., the "on-carriage type"), another example of an external force is the force exerted on the cartridge due to the cartridge moving along the main scanning direction of the carriage (inertial force).

When the cartridge is subjected to various external forces, the state of contact between the contact members and the terminals becomes unstable, and there are cases where the electrical connection between the cartridge and the printer cannot be maintained in a favorable state.

In the technique described in JP-A-2008-074100, a positioning portion is provided on the bottom plane of the cartridge in order to suppress positional shift caused by force applied to the cartridge by the conductive contact members. The positioning portion of the cartridge is shaped as a projection, and engaging it with a positioning portion provided on the cartridge mounting portion suppresses positional shift of the cartridge caused by force applied by the contact members.

However, with the technique described in JP-A-2008-074100, there have been cases where it is difficult to suppress positional shift of the terminals provided on the cartridge relative to the contact members caused by external force applied to the cartridge. For example, there have been cases where the reliability of contact between the contact members and the terminals decreases due to the terminals and the positioning portions being arranged at separated positions. In this way, in technology that employs cartridges provided with terminals, there is desire for a technique for raising the reliability of contact between the terminals provided on the cartridge and the contact members provided in the printer. Also, with cartridges provided with terminals, with liquid ejection devices, and with systems that include a cartridge and a liquid ejection device, there is desire for size reduction, cost reduction, resource saving, structure simplification, improvement in usability, lifetime extension, improvement in safety during use, and the like.

SUMMARY

The invention has been achieved in order to address at least some of the above-described problems, and can be realized as any of the following modes.

(1) A first mode of the invention provides a cartridge configured to be removably mounted to a liquid ejection device including a first engaging portion and a conductive contact member that has elastic force and that is arranged so as to be adjacent to the first engaging portion. This cartridge includes: a terminal arranged so as to be able to come into contact with the conductive contact member; and a first hook that can be engaged with the first engaging portion.

According to the cartridge of this mode, it is possible to raise the reliability of contact between the conductive contact member and the terminal using the elastic force of the conductive contact member and the force generated by engagement with the first hook.

(2) In the cartridge of the above mode, the first hook may be configured so as to, when in a state of being engaged with the first engaging portion, restrict the terminal from moving away from the conductive contact member in resistance to the elastic force of the conductive contact member.

According to the cartridge of this mode, it is possible to raise the reliability of contact between the conductive contact member and the terminal using the elastic force of the conductive contact member and the restricting force of the first hook.

(3) In the cartridge of the above mode, the first hook may be, relative to the terminal, located in an extending direction of a plane of the terminal that can come into contact with the conductive contact member.

According to the cartridge of this mode, the first hook can be arranged on the same plane as the terminal, thus making it possible to arrange the first hook at a position in the vicinity of the terminal. This enables raising the reliability of contact between the conductive contact member and the terminal.

(4) In the cartridge of the above mode, the first hook may have a first opposing portion that, in a mounting process for mounting the cartridge to the liquid ejection device, opposes a first end portion of the first engaging portion located on a vertically upward direction side.

According to the cartridge of this mode, when mounting the cartridge, the first end portion collides with the first opposing portion, thus making it possible for the distance for which the conductive contact member rubs against the terminal to fall in an appropriate range. This enables raising the reliability of contact between the conductive contact member and the terminal. For example, it is possible to prevent the rubbing region of the conductive contact member from moving beyond the terminal and arriving at a portion where the terminal is not arranged.

(5) Another mode of the invention provides a cartridge configured to be removably mounted to a liquid ejection device including a first engaging portion and a conductive contact member that has elastic force and that is arranged so as to be adjacent to the first engaging portion. This cartridge includes: a terminal arranged so as to be able to come into contact with the conductive contact member; and a first engaged portion that can be engaged with the first engaging portion, wherein the first engaged portion is configured so as to, when in a state of being engaged with the first engaging portion, restrict the terminal from moving away from the conductive contact member in resistance to the elastic force of the conductive contact member.

According to the cartridge of this mode, it is possible to raise the reliability of contact between the conductive contact member and the terminal using the elastic force of the conductive contact member and the restricting force of the first engaged portion.

(6) In the cartridge of the above mode, the first engaged portion may be, relative to the terminal, located in an extending direction of a plane of the terminal that can come into contact with the conductive contact member.

According to the cartridge of this mode, the first engaged portion can be arranged on the same plane as the terminal, thus making it possible to arrange the first engaged portion at a position in the vicinity of the terminal. This enables raising the reliability of contact between the conductive contact member and the terminal.

(7) Another mode of the invention provides a cartridge configured to be removably mounted to a liquid ejection device including a first engaging portion and a conductive contact member that has elastic force and that is arranged so as to be adjacent to the first engaging portion. This cartridge includes: a terminal arranged so as to be able to come into contact with the conductive contact member; and a first engaged portion that can be engaged with the first engaging portion, wherein the first engaged portion is, relative to the terminal, located in an extending direction of a plane of the terminal that can come into contact with the conductive contact member.

According to the cartridge of this mode, the first engaged portion can be arranged on the same plane as the terminal, thus making it possible to arrange the first engaged portion at a position in the vicinity of the terminal. This enables raising the reliability of contact between the conductive contact member and the terminal.

(8) In the cartridge of the above mode, the first engaged portion may have a first opposing portion that, in a mounting process for mounting the cartridge to the liquid ejection device, opposes a first end portion of the first engaging portion located on a vertically upward direction side.

According to the cartridge of this mode, when mounting the cartridge, the first end portion collides with the first opposing portion even if the cartridge has excessively deviated from the designed position in the liquid ejection device. Accordingly, it is possible for the distance for which the conductive contact member rubs against the terminal to fall in an appropriate range, thus enabling raising the reliability of contact between the conductive contact member and the terminal. For example, it is possible to prevent the rubbing region of the conductive contact member from moving beyond the terminal and arriving at a portion where the terminal is not arranged.

(9) Another mode of the invention provides a cartridge configured to be removably mounted to a liquid ejection device including a first engaging portion, a conductive contact member that has elastic force and that is arranged so as to be adjacent to the first engaging portion, and a liquid introduction portion. This cartridge includes: a first plane in which a liquid supply portion configured to be connected to the liquid introduction portion is formed; and a second plane that includes a terminal arranged so as to be able to come into contact with the conductive contact member, wherein the second plane includes a first engaged portion that is able to be engaged with the first engaging portion, and the first engaged portion is configured so as to, when in a state of being engaged with the first engaging portion, restrict the terminal from moving away from the conductive contact member in resistance to the elastic force of the conductive contact member.

According to the cartridge of this mode, the first engaged portion can be arranged on the same plane as the terminal, thus making it possible to arrange the first engaged portion at a position in the vicinity of the terminal. This enables raising the reliability of contact between the conductive contact member and the terminal.

(10) In the cartridge of the above mode, a distance between the center of the liquid supply portion and a portion where the first engaging portion and the first engaged portion come into contact may be greater than a distance between the center of the liquid supply portion and a portion where the conductive contact member and the terminal come into contact.

According to the cartridge of this mode, the portion of contact between the first engaging portion and the first engaged portion can be arranged at a position that projects outward from the outer wall of the cartridge farther than the portion of contact between the conductive contact member and the terminal. This enables ensuring the region of contact between the first engaging portion and the first engaged portion without interference with the region of contact between the conductive contact member and the terminal. Accordingly, the first engaged portion can be arranged in the vicinity of the terminal, thus making it possible to raise the reliability of contact between the conductive contact member and the terminal.

(11) Another mode of the invention provides a cartridge configured to be removably mounted to a liquid ejection device including a first engaging portion, a conductive contact member that has elastic force and that is arranged so as to be adjacent to the first engaging portion, and a liquid introduction portion. This cartridge includes: a liquid supply portion that is able to be connected to the liquid introduction portion; a terminal arranged so as to be able to come into contact with the conductive contact member; and a first engaged portion that can be engaged with the first engaging portion, wherein a distance between the center of the liquid supply portion and a portion where the first engaging portion and the first engaged portion come into contact is greater than a distance between the center of the liquid supply portion and a portion where the conductive contact member and the terminal come into contact.

According to the cartridge of this mode, the portion of contact between the first engaging portion and the first engaged portion can be formed so as to be located at a position that projects outward from the outer wall of the cartridge farther than the portion of contact between the conductive contact member and the terminal. This makes it possible to give a degree of freedom in the arrangement position of the first engaged portion, thus enabling raising the reliability of contact between the conductive contact member and the terminal.

(12) In the cartridge of the above mode, the first engaged portion may be configured so as to, when in a state of being engaged with the first engaging portion, restrict the terminal from moving away from the conductive contact member in resistance to the elastic force of the conductive contact member.

According to the cartridge of this mode, it is possible to raise the reliability of contact between the conductive contact member and the terminal using the elastic force of the conductive contact member and the restricting force of the first engaged portion.

(13) In the cartridge of the above mode, the first engaged portion may be, relative to the terminal, located in an extending direction of a plane of the terminal that can come into contact with the conductive contact member.

According to the cartridge of this mode, the first engaged portion can be arranged on the same plane as the terminal, thus making it possible to arrange the first engaged portion at a position in the vicinity of the terminal. This enables raising the reliability of contact between the conductive contact member and the terminal.

(14) Another mode of the invention provides a cartridge configured to be removably mounted to a liquid ejection device including a first engaging portion, a second engaging portion, a conductive contact member that has elastic force and that is arranged between the first engaging portion and the second engaging portion, and a liquid introduction portion. This cartridge includes: a terminal arranged so as to be able to come into contact with the conductive contact member; a first engaged portion that can be engaged with the first engaging portion; and a second engaged portion that can be engaged with the second engaging portion, wherein the terminal is arranged between the first engaged portion and the second engaged portion.

According to the cartridge of this mode, it is possible to raise the reliability of contact between the conductive contact member and the terminal using the elastic force of the conductive contact member and the force generated by engagement with the first engaged portion and the engagement with the second engaged portion. In particular, due to the terminal being located between the first engaged portion and the second engaged portion, movement of the terminal can be restricted on both sides of the terminal by the first and second engaged portions, thus making it possible to further raise the reliability of contact between the conductive contact member and the terminal.

(15) The cartridge of the above mode may further includes: a liquid supply portion that is able to be connected to the liquid introduction portion, wherein a distance between the center of the liquid supply portion and a portion where the first engaging portion and the first engaged portion come into contact may be greater than a distance between the center of the liquid supply portion and a portion where the conductive contact member and the terminal come into contact, and a distance between the center of the liquid supply portion and a portion where the second engaging portion and the second engaged portion come into contact may be greater than a distance between the center of the liquid supply portion and a portion where the conductive contact member and the terminal come into contact.

According to the cartridge of this mode, the portion of contact between the first engaging portion and the first engaged portion and the portion of contact between the second engaging portion and the second engaged portion can be formed so as to be located at a position that projects outward from the outer wall of the cartridge farther than the portion of contact between the conductive contact member and the terminal. This makes it possible to give a degree of freedom in the arrangement position of the first engaged portion and the second engaged portion, thus enabling raising the reliability of contact between the conductive contact member and the terminal.

(16) In the cartridge of the above mode, the first engaged portion may be configured so as to, when in a state of being engaged with the first engaging portion, restrict the terminal from moving away from the conductive contact member in resistance to the elastic force of the conductive contact member, and the second engaged portion may be configured so as to, when in a state of being engaged with the second engaging portion, restrict the terminal from moving away from the conductive contact member in resistance to the elastic force of the conductive contact member.

According to the cartridge of this mode, it is possible to raise the reliability of contact between the conductive contact member and the terminal using the elastic force of the conductive contact member, the restricting force of the first engaged portion, and the restricting force of the second engaged portion.

(17) In the cartridge of the above mode, the first engaged portion and the second engaged portion may be, relative to the conductive contact member, located in an extending direction of a plane of the terminal that can come into contact with the conductive contact member.

According to the cartridge of this mode, the first engaged portion and the second engaged portion can be arranged on the same plane as the terminal, thus making it possible to arrange the first engaged portion and the second engaged portion at positions in the vicinity of the terminal. This enables raising the reliability of contact between the conductive contact member and the terminal.

(18) In the cartridge of the above mode, the first engaged portion may be a first hook, and the second engaged portion may be a second hook.

According to the cartridge of this mode, the first engaged portion and the second engaged portion are hooks, thus making it possible to form the first and second engaged portions with a simple configuration.

(19) In the cartridge of the above mode, a portion of the first engaged portion that comes into contact with the first engaging portion, a portion of the second engaged portion that comes into contact with the second engaging portion, and a portion of the terminal that comes into contact with the conductive contact member may be arranged on the same straight line.

According to the cartridge of this mode, due to the portions being arranged on the same straight line, positional shift of the portion (contact portion) of the terminal that comes into contact with the conductive contact member can be prevented by the first and second engaged portions located on respective sides of the terminal. This enables further stabilizing the position of the contact portion, thus making it possible to raise the reliability of contact between the conductive contact member and the terminal.

(20) In the cartridge of the above mode, the first engaged portion may have a first opposing portion that, in a mounting process for mounting the cartridge to the liquid ejection device, opposes a first end portion of the first engaging portion located on a vertically upward direction side, and the second engaged portion may have a second opposing portion that, in a mounting process for mounting the cartridge to the liquid ejection device, opposes a second end portion of the second engaging portion located on a vertically upward direction side.

According to the cartridge of this mode, when mounting the cartridge, even if the cartridge has excessively deviated from the designed position in the liquid ejection device, the first end portion collides with the first opposing portion, and the second end portion collides with the second opposing portion. Accordingly, it is possible for the distance for which the conductive contact member rubs against the terminal to fall in an appropriate range, thus enabling raising the reliability of contact between the conductive contact member and the terminal. For example, it is possible to prevent the rubbing region of the conductive contact member from moving beyond the terminal and arriving at a portion where the terminal is not arranged. In particular, due to the terminal being arranged between the first engaged portion and the second engaged portion, it is possible to prevent tilting of the terminal when the first end portion collides with the first opposing portion and the second end portion collides with the second opposing portion.

(21) Another mode of the invention provides a liquid ejection device. This liquid ejection device includes: a first engaging portion; a second engaging portion; a conductive contact member that has elastic force and that is arranged between the first engaging portion and the second engaging portion; a liquid introduction portion; and a cartridge mounting portion to which a cartridge can be removably mounted, the cartridge having a liquid supply portion that is able to be connected to the liquid introduction portion, a terminal arranged so as to be able to come into contact with the conductive contact member, a first engaged portion that can be engaged with the first engaging portion, and a second engaged portion that can be engaged with the second engaging portion.

According to the liquid ejection device of this mode, it is possible to raise the reliability of contact between the conductive contact member and the terminal using the elastic force of the conductive contact member and the force generated by engagement with the first engaging portion and the engagement with the second engaging portion. In particular, due to the conductive contact member being located between the first engaging portion and the second engaging portion, relative movement of the conductive contact member relative to the terminal can be restricted on both sides of the conductive contact member by the first and second engaging portions. This enables further raising the reliability of contact between the conductive contact member and the terminal.

(22) In the liquid ejection device of the above mode, a distance between the center of the liquid introduction portion and a portion where the first engaging portion and the first engaged portion come into contact may be greater than a distance between the center of the liquid introduction portion and a portion where the conductive contact member and the terminal come into contact, and a distance between the center of the liquid introduction portion and a portion where the second engaging portion and the second engaged portion come into contact may be greater than a distance between the center of the liquid introduction portion and a portion where the conductive contact member and the terminal come into contact.

According to the liquid ejection device of this mode, the portion of contact between the first engaging portion and the first engaged portion and the portion of contact between the second engaging portion and the second engaged portion can be formed at a different position from the portion of contact between the conductive contact member and the terminal. This makes it possible to give a degree of freedom in the arrangement position of the first engaging portion and the second engaging portion, thus enabling raising the reliability of contact between the conductive contact member and the terminal.

(23) In the liquid ejection device of the above mode, a portion of the first engaged portion that comes into contact with the first engaging portion, a portion of the second engaged portion that comes into contact with the second engaging portion, and a portion of the terminal that comes into contact with the conductive contact member may be arranged on the same straight line.

According to the liquid ejection device of this mode, due to the portions being arranged on the same straight line, positional shift of the portion (contact portion) of the conductive contact member that comes into contact with the terminal can be prevented by the first and second engaging portions located on respective sides of the conductive contact member. This enables further stabilizing the position of the contact portion, thus making it possible to raise the reliability of contact between the conductive contact member and the terminal.

(24) Another mode of the invention provides a liquid ejection system that includes a liquid ejection device; and a cartridge. In this liquid ejection system, the liquid ejection device includes: a first engaging portion; a second engaging portion; a conductive contact member that has elastic force and that is arranged between the first engaging portion and the second engaging portion; and a liquid introduction portion, and the cartridge includes: a liquid supply portion that is able to be connected to the liquid introduction portion; a terminal arranged so as to be able to come into contact with the conductive contact member; a first engaged portion that can be engaged with the first engaging portion; and a second engaged portion that can be engaged with the second engaging portion.

According to the liquid ejection system of this mode, it is possible to raise the reliability of contact between the conductive contact member and the terminal using the elastic force of the conductive contact member, the force generated by engagement between the first engaging portion and the first engaged portion, and the force generated by engagement between the second engaging portion and the second engaged portion. In particular, due to the terminal being located between the first engaged portion and the second engaged portion, movement of the terminal can be restricted on both sides of the terminal by the first and second engaged portions, thus making it possible to further raise the reliability of contact between the conductive contact member and the terminal.

(25) In the liquid ejection system of the above mode, a distance between the center of the liquid introduction portion and a portion where the first engaging portion and the first engaged portion come into contact may be greater than a distance between the center of the liquid introduction portion and a portion where the conductive contact member and the terminal come into contact, and a distance between the center of the liquid introduction portion and a portion where the second engaging portion and the second engaged portion come into contact may be greater than a distance between the center of the liquid introduction portion and a portion where the conductive contact member and the terminal come into contact.

According to the liquid ejection system of this mode, the portion of contact between the first engaging portion and the first engaged portion and the portion of contact between the second engaging portion and the second engaged portion can be formed so as to be located at a position that projects outward from the outer wall of the cartridge farther than the portion of contact between the conductive contact member and the terminal. This makes it possible to give a degree of freedom in the arrangement position of the first engaged portion and the second engaged portion, thus enabling raising the reliability of contact between the conductive contact member and the terminal.

(26) In the liquid ejection system of the above mode, a portion of the first engaged portion that comes into contact with the first engaging portion, a portion of the second engaged portion that comes into contact with the second engaging portion, and a portion of the terminal that comes into contact with the conductive contact member may be arranged on the same straight line.

According to the liquid ejection system of this mode, due to the portions being arranged on the same straight line, positional shift of the portion (contact portion) of the conductive contact member that comes into contact with the terminal can be further suppressed by the first and second engaging portions located on respective sides of the conductive contact member. This enables further stabilizing the position of the contact portion, thus making it possible to raise the reliability of contact between the conductive contact member and the terminal.

The constituent elements included in the above-described modes of the invention are not all essential, and in order to solve some or all of the above-described issues or achieve some or all of the effects described in this specification, some of the constituent elements can be modified, omitted, and replaced with other constituent elements as necessary, and the limiting content can be partially omitted. Also, in order to solve some or all of the above-described issues or achieve some or all of the above-described effects, some or all of the technical features in any of the above-described modes of the invention can be combined with some or all of the technical features included in another one of the above-described modes of the invention so as to obtain an independent mode of the invention.

For example, a mode of the invention can be implemented as a device that includes one or more elements out of the terminal and the first hook. In other words, this device may have or not have the terminal. Also, this device may have or not have the first hook. Although this device can be implemented as a cartridge, for example, it can also be implemented as a device other than a cartridge. According to this mode, it is possible to solve at least one of various problems such as achieving device size reduction, cost reduction, resource saving, structure simplification, and improvement in usability. Some or all of the technical features of the above-described modes of a cartridge, a liquid ejection device, and a liquid ejection system can be applied to such a device.

Note that the invention can be implemented in various modes, and can be implemented in various aspects such as a cartridge, a liquid ejection device, a liquid ejection system, a cartridge manufacturing method, a liquid ejection device manufacturing method, a unit in which a cartridge and a cartridge mounting portion to which the cartridge can be removably mounted are included, and a unit in which a cartridge and an external tank for storing liquid are included.

BRIEF DESCRIPTION OF THE DRAWINGS

The invention will be described with reference to the accompanying drawings, wherein like numbers reference like elements.

DESCRIPTION OF EXEMPLARY EMBODIMENTS

Next, embodiments of the invention will be described in the following order.

A. to C. Various embodiments

D. Various modified examples

A. First Embodiment

A-1: Configuration of Liquid Ejection System 1

Figure 1:
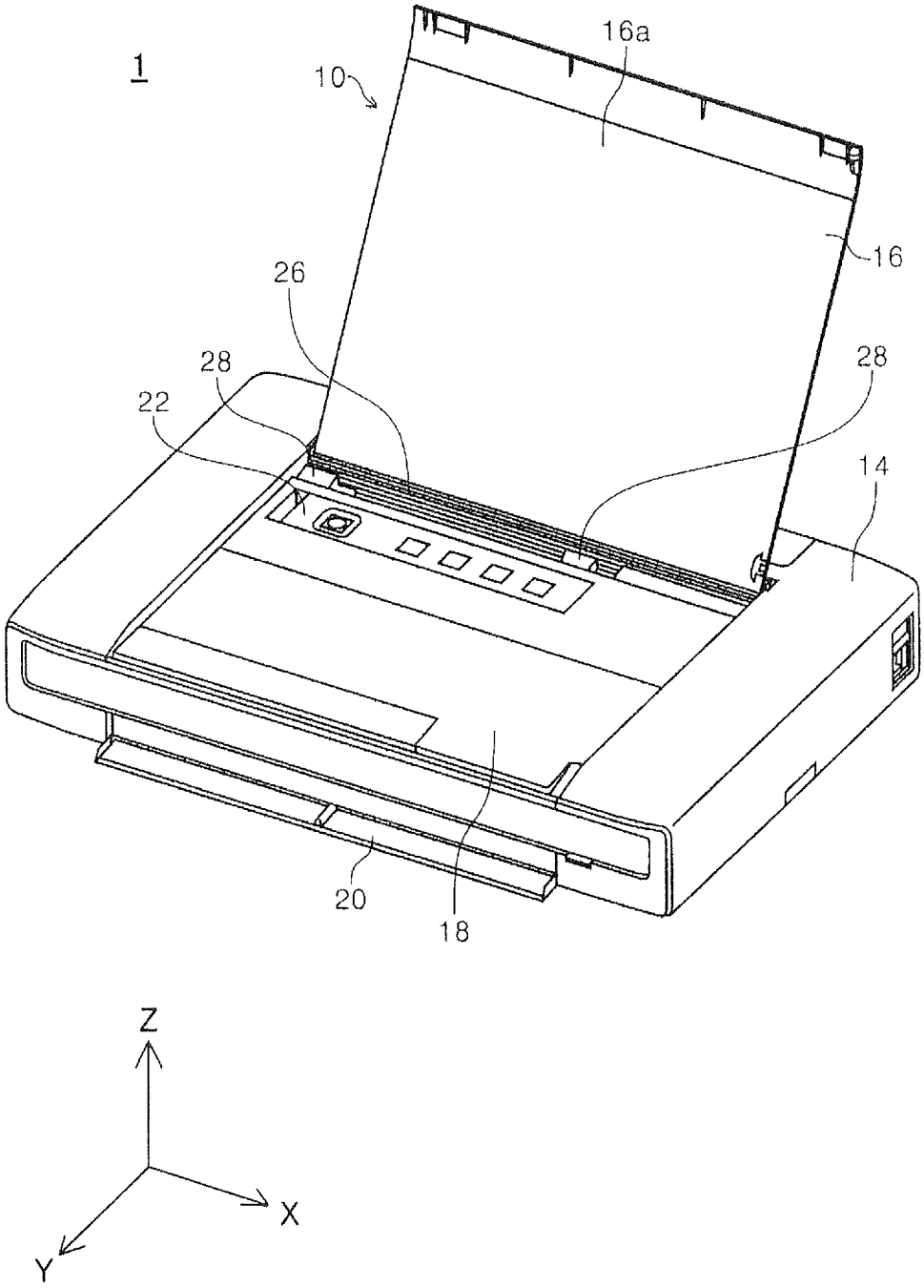
FIG. 1 is a perspective view of a schematic configuration of a liquid ejection system.
Figure 2:
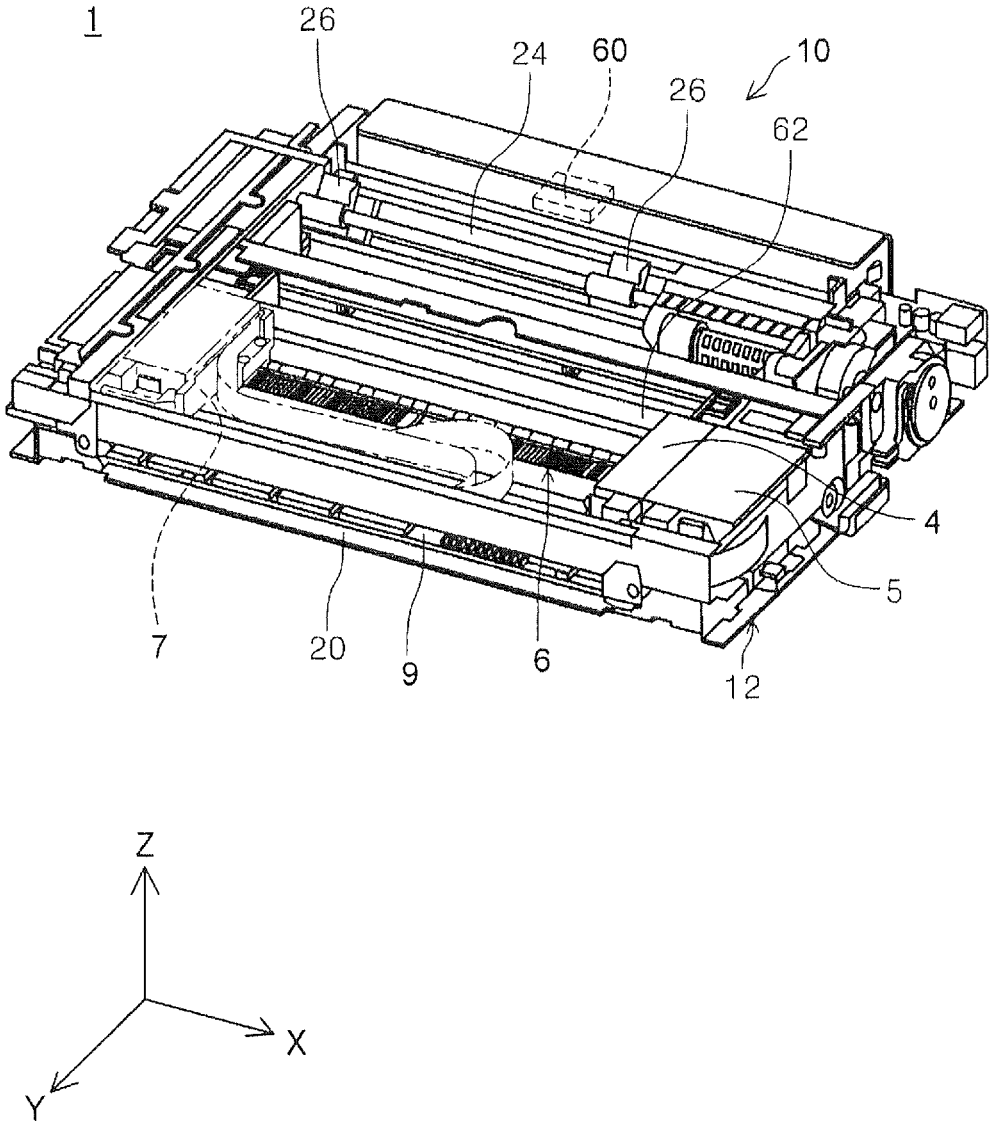
FIG. 2 is a perspective view of an internal configuration of a liquid ejection system.

FIG. 1 is a perspective view of the schematic configuration of a liquid ejection system 1. FIG. 2 is a perspective view of the internal configuration of the liquid ejection system 1. Mutually orthogonal X, Y, and Z axes are shown in FIGS. 1 and 2. These X, Y, and Z axes are used when necessary in later-described figures as well. The X, Y, and Z axes in FIGS. 1 and 2 correspond to the X, Y, and Z axes in the other figures as well. The liquid ejection system 1 includes a printer 10 serving as a liquid ejection device, and two types of cartridges 4 and 5. As shown in FIG. 2, in the liquid ejection system 1 of this embodiment, the cartridges 4 and 5 are removably mounted to a cartridge mounting portion 7 of the printer 10. The cartridge mounting portion 7 is provided on a carriage that includes a head for discharging ink. Hereinafter, the cartridge 4 will also be referred to as the "first cartridge 4", and the cartridge 5 will also be referred to as the "second cartridge 5".

The first cartridge 4 stores black ink. Three liquid storage portions are defined inside the second cartridge 5. The second cartridge 5 thus stores three colors of ink, namely yellow, magenta, and cyan.

Here, the number of and types of cartridges mounted to the cartridge mounting portion 7 is not limited to the number and types described in this embodiment. For example, four first cartridges 4 may be mounted to the cartridge mounting portion 7. In this case, four first cartridges 4 that correspond to black, cyan, magenta, and yellow ink may be mounted to the cartridge mounting portion 7. Also, cartridges storing other colors (e.g., light magenta and light cyan) ink may be mounted to the cartridge mounting portion 7.

The printer 10 is an inkjet printer. As shown in FIG. 1, the printer 10 includes a housing 14, a sheet supply unit cover 16, a recording unit protection cover 18, a discharge unit cover 20, and an operation unit 22. Also, as shown in FIG. 2, the printer 10 includes a device body 12.

As shown in FIG. 1, the housing 14 covers the periphery of the device body 12, and constitutes the exterior of the printer 10. Also, the sheet supply unit cover 16 is provided on the upper face of the printer 10. The sheet supply unit cover 16 is pivotably attached to the upper face of the housing 14. The sheet supply unit cover 16 can be in an opened state (FIG. 1) or a closed state (not shown) relative to the housing 14. When the sheet supply unit cover 16 is in the closed state relative to the housing 14, it constitutes the upper face of the printer 10 along with the upper face of the housing 14.

Also, when the sheet supply unit cover 16 is in the opened state relative to the housing 14, it is in a state of being inclined toward the rear plane side (−Y direction side) of the printer 10. In this state, the reverse side of the sheet supply unit cover 16 functions as a sheet supporting face 16*a*.

Also, when the sheet supply unit cover 16 is in the opened state relative to the housing 14, a sheet opening 26 of a later-described sheet supply unit 24 of the device body 12 is in an opened state relative to the top of the printer 10. This allows the sheet supply unit 24 to feed sheets supported on the supporting face 16*a* to a feeding path. The feeding path is the path along which sheets move when printing is performed. Also, a pair of sheet guides 28 are provided in the sheet opening 26. The pair of sheet guides 28 are configured such that the gap therebetween in the width direction (X axis direction) of the printer 10 can be adjusted. The pair of sheet guides 28 restrain the two width-direction edges of the sheets, and restrict the position of the sheets in the width direction.

Also, when the sheet supply unit cover 16 is in the opened state relative to the housing 14, it is in a state in which the recording unit protection cover 18 and the operation unit 22 are exposed on the upper face of the printer 10. The recording unit protection cover 18 can be in an opened state (not shown) or a closed state (FIG. 1) relative to the housing 14. When the recording unit protection cover 18 is in the opened state relative to the housing 14, a user can access a recording unit 6 provided in the device body 12.

Also, the operation unit 22 includes a power button, a print setting button, and the like for operating the printer 10. When the sheet supply unit cover 16 is in the opened state relative to the housing 14, the user can access the operation unit 22 and perform operations on the printer 10.

Furthermore, the discharge unit cover 20 is provided on the front face of the housing 14. The discharge unit cover 20 is pivotably attached to the front face of the housing 14. The discharge unit cover 20 can be in an opened state (FIG. 1) or a closed state (not shown) relative to the housing 14. When the discharge unit cover 20 is in the opened state relative to the housing 14, sheets P that are from a discharge unit 9 of the device body 12 and have been subjected to recording are discharged by the discharge unit cover 20 to the region in front of the printer 10.

As shown in FIG. 2, the device body 12 includes the sheet supply unit 24, the recording unit 6, the discharge unit 9, and a control unit 60.

The control unit 60 is electrically connected to the sheet supply unit 24, the recording unit 6, and the discharge unit 9, and controls operations of these portions based on instructions received from the operation unit 22. The control unit 60 also controls the rotation of a conveying roller shaft 50 and the movement of a carriage (not shown) via a drive motor (not shown). The carriage is attached to the bottom face of the cartridge mounting portion 7. The control unit 60 also exchanges signals with circuit substrates included in the cartridges 4 and 5.

The recording unit 6 includes a carriage guiding shaft 62, and a carriage driving means (not shown). The guiding shaft 62 is provided so as to extend in the X axis direction, that is to say, the width direction of the device body. The carriage guiding shaft 62 is inserted into a bearing portion (not shown) provided on the rear face side of the carriage. The carriage guiding shaft 62 supports the carriage. Also, the carriage guiding shaft 62 is configured as a hollow shaft.

The carriage is configured so as to be able to be transported in the width direction (X axis direction, transport direction) of the device body 12 by the carriage driving means (not shown). The cartridge mounting portion 7 moves in the width direction of the device body 12 due to the carriage being transported in the width direction of the device body 12. In other words, the cartridges 4 and 5 are transported in the transport direction (X axis direction) by the printer 10. The type of printer 10 in which cartridges 4 and 5 are mounted to a cartridge mounting portion 7 provided on a carriage that moves a head, as in this embodiment, is also called the "on-carriage type". In other embodiments, a configuration is possible in which an immobile cartridge mounting portion 7 is constituted at a different location from the carriage, and ink from cartridges 4 and 5 mounted to the cartridge mounting portion 7 is supplied to the head of the carriage via flexible tubes. This type of printer is also called the "off-carriage type". The cartridges 4 and 5 are not limited to being removable cartridges, and they may be fixed ink tanks. These fixed ink tanks may have an ink injection hole that allows ink to be injected from the outside.

When the liquid ejection system 1 is in an in-use state, the X axis is the axis that conforms to the main scanning direction (left-right direction) along which the carriage travels back-and-forth, the Y axis is the axis that conforms to the sub scanning direction (front-rear direction) along which sheets are conveyed, and the Z axis is the axis that conforms to the vertical direction (up-down direction). Also, the +Z axis direction corresponds to the vertically upward direction, and the −Z axis direction corresponds to the vertically downward direction. Note that the in-use state of the liquid ejection system 1 refers a state in which the liquid ejection system 1 is disposed on a horizontal surface, and in this embodiment, a horizontal surface is a surface that is parallel to the X axis and the Y axis (i.e., is an XY plane).

A-2. Cartridge Mounted State

Figure 3A:
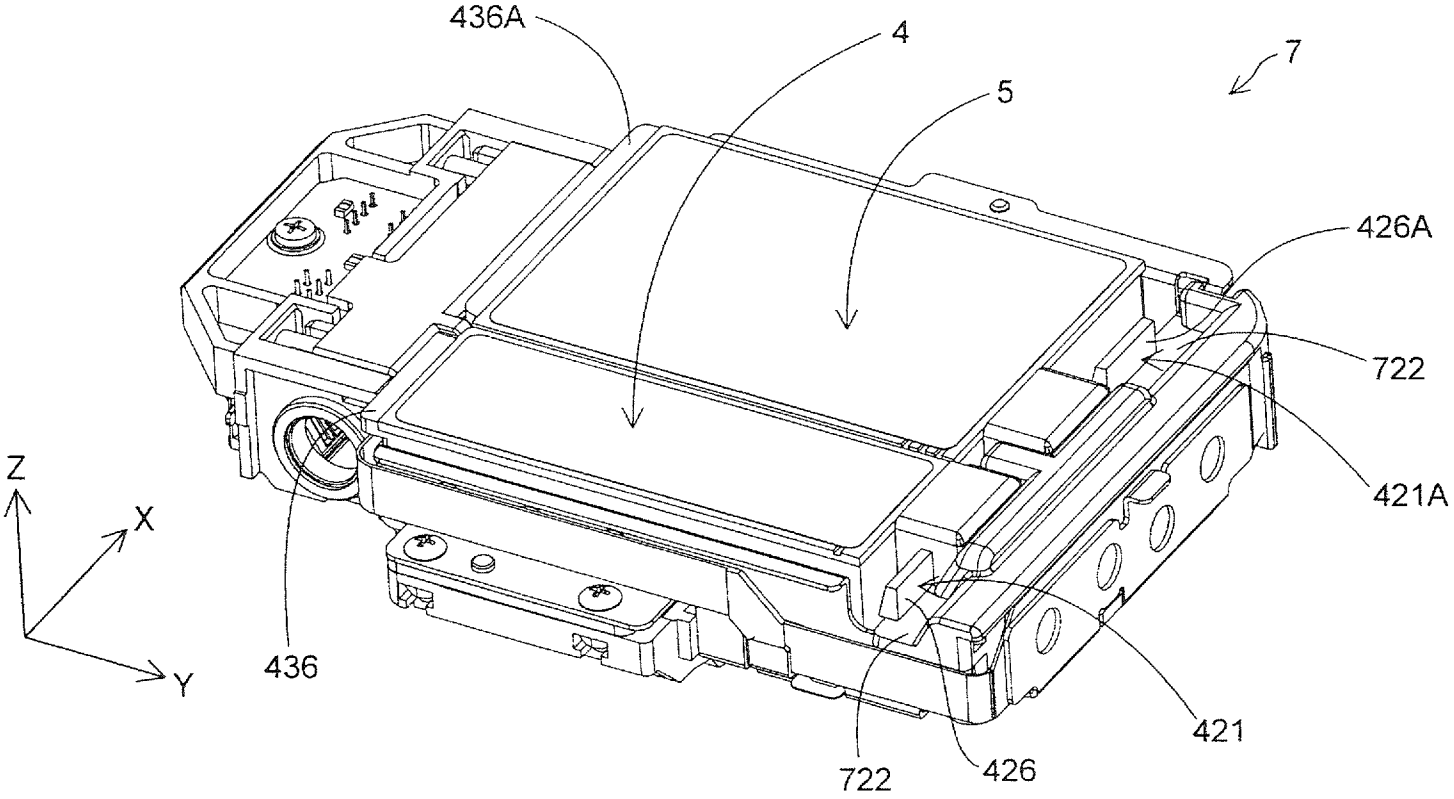
FIG. 3A is an external perspective view of a cartridge mounting portion.

FIG. 3A is an external perspective view of the cartridge mounting portion 7. In FIG. 3A, the cartridge mounting portion 7 is shown in a state in which the first and second cartridges 4 and 5 have been mounted. As shown in FIG. 3A, when the cartridges 4 and 5 are in the mounted state in which they have been mounted to the cartridge mounting portion 7, the first and second cartridges 4 and 5 are arranged side-by-side in the transport direction (X axis direction). In this mounted state, levers 421 and 421A serving as mounting/removal mechanism portions that the first and second cartridges include are engaged with the cartridge mounting portion 7. By applying external force to operation units 426 and 426A of the levers 421 and 421A, the user can displace the levers 421 and 421A so as to cancel the engagement with mounting/removal portions 722 that the cartridge mounting portion 7 includes. Canceling the engagement between the cartridge mounting portion 7 and the cartridges 4 and 5 enables the user to remove the cartridges 4 and 5 from the cartridge mounting portion 7.

Figure 3B:
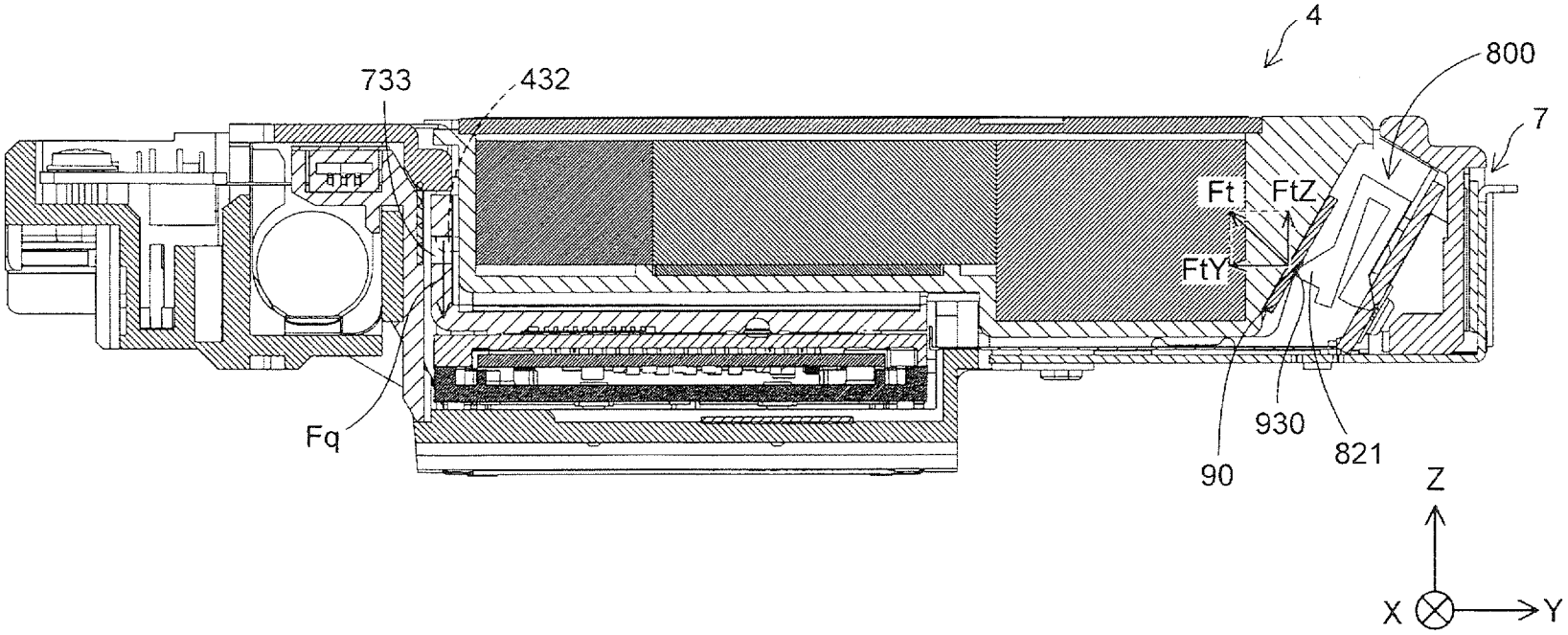
FIG. 3B is a cross-sectional view of a cartridge shown in FIG. 3A.
Figure 3C:
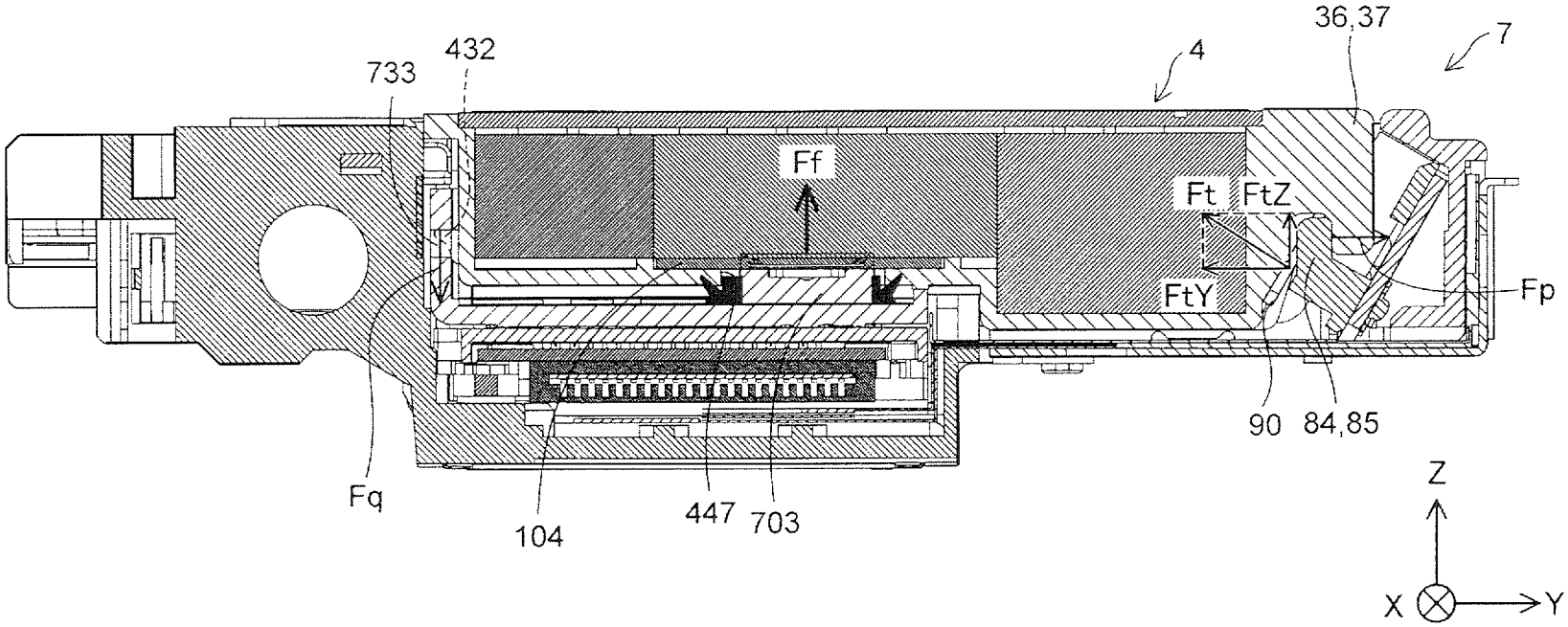
FIG. 3C is a cross-sectional view of the cartridge shown in FIG. 3A.
Figure 3D:
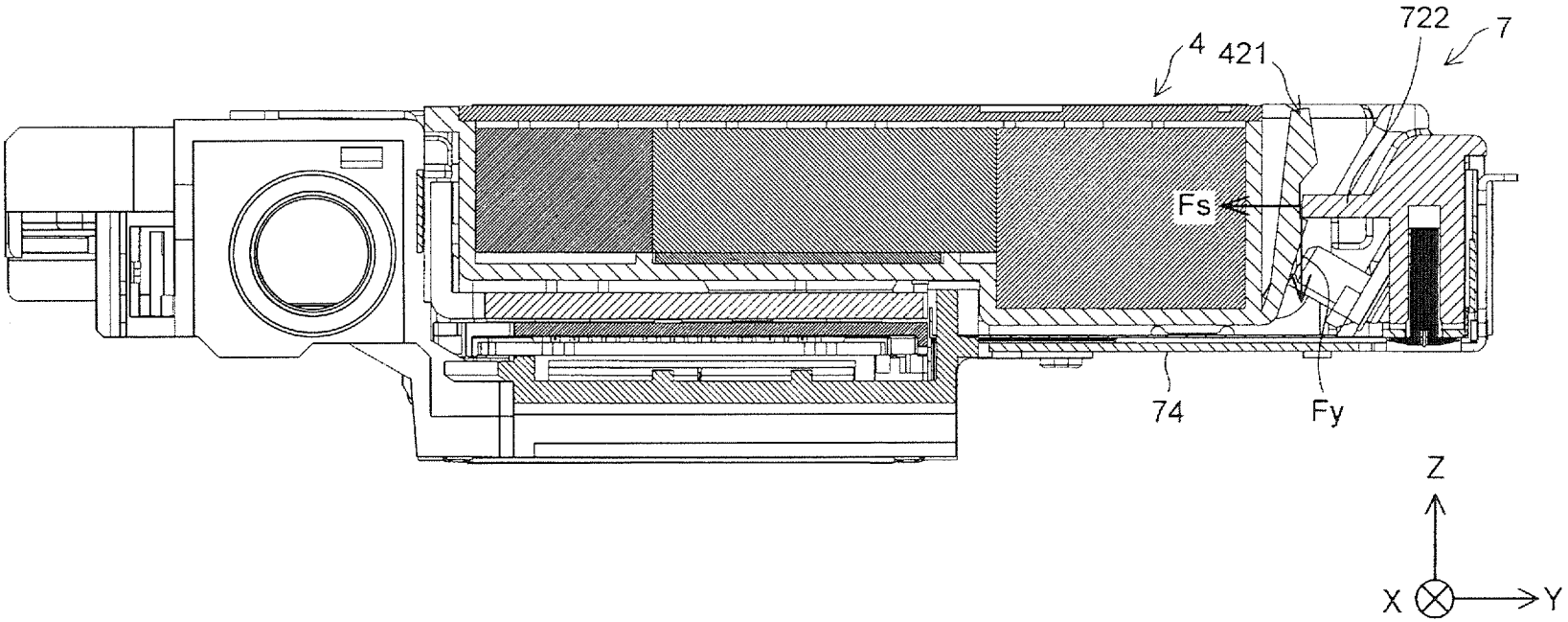
FIG. 3D is a cross-sectional view of the cartridge shown in FIG. 3A.

FIG. 3B is a cross-sectional view taken along a plane parallel to the Y axis direction and the Z axis direction (YZ plane) at a position where the cartridge 4 shown in FIG. 3A is located. FIG. 3C is a cross-sectional view taken along a YZ plane different from that in FIG. 3B at a position where the cartridge 4 shown in FIG. 3A is located. FIG. 3D is a cross-sectional view taken along a YZ plane different from those in FIGS. 3B and 3C at a position where the cartridge 4 shown in FIG. 3A is located. The mounted state of the cartridge 4 will be described below with reference to FIGS. 3B to 3D. Note that the relationships between forces shown in FIGS. 3B to 3D are similar in the mounted state of the cartridge 5 as well, and therefore the mounted state of the cartridge 5 will not be described.

As shown in FIG. 3B, in the cartridge 4 mounted state, a conductive contact member 800 (specifically, the one end portion 821) that the cartridge mounting portion 7 includes and a circuit substrate 90 (specifically, a terminal 930) that the cartridge 4 includes are in contact with each other. Accordingly, the cartridge 4 is subjected to force Ft from the contact member 800. The force Ft is force that includes a −Y axis direction (i.e., first direction) component and a +Z axis direction (i.e., second direction) component. In other words, the force Ft can be decomposed into a −Y axis direction force FtY and a +Z axis direction force FtZ.

Also, as shown in FIG. 3B, in the cartridge 4 mounted state, an engaging portion 733 that the cartridge mounting portion 7 includes and an engaged portion 432 that the cartridge 4 includes are engaged with each other. Accordingly, the engaging portion 733 applies a −Z axis direction (vertically downward direction) force Fq to the cartridge 4. The portion of the cartridge 4 on the −Y axis direction side is restricted from moving in the +Z axis direction (vertically upward direction) by the force Fq.

Also, as shown in FIG. 3C, in the cartridge 4 mounted state, a liquid introduction portion 703 that the cartridge mounting portion 7 includes and a liquid supply portion 447 that the cartridge 4 includes are connected to each other by the member 703 being inserted into the member 447. Accordingly, a first liquid holding member 104 connected to the liquid supply portion 447 comes into contact with the liquid introduction portion 703. Due to the members 104 and 703 coming into contact with each other, the liquid introduction portion 703 applies a +Z axis direction (vertically upward direction)

force Ff to the cartridge 4. Note that the first liquid holding member 104 can also be considered to be a portion of the liquid supply portion 447.

Also, as shown in FIG. 3C, in the cartridge 4 mounted state, a first engaging portion 84 that the cartridge mounting portion 7 includes and a first engaged portion 36 (also called the "first hook 36") that the cartridge 4 includes are engaged with each other. Accordingly, the first engaging portion 84 applies a +Y axis direction force Fp to the cartridge 4. Due to the application of the force Fp, the cartridge 4 can be restricted from moving away from the contact member 800 in resistance to elastic force Ft of the contact member 800. Movement away from the contact member 800 includes a −Y axis direction component. Note that a second engaging portion 85 that the cartridge mounting portion 7 includes and a second engaged portion 37 (also called the "second hook 37") that the cartridge 4 includes are in a similar relationship. The first engaged portion 36 is located more on the +X axis direction side than the second engaged portion 37 is. FIG. 3C shows a cross-section of the second engaged portion 37 and the second engaging portion 85.

As shown in FIG. 3D, in the cartridge 4 mounted state, a mounting/removal portion 722 that the cartridge mounting portion 7 includes and the lever 421 that the cartridge 4 includes are engaged with each other. Accordingly, the mounting/removal portion 722 applies a −Z axis direction (vertically downward direction) force Fy to the cartridge 4. Also, the mounting/removal portion 722 applies a −Y axis direction force Fs to the cartridge 4. The portion of the cartridge 4 on the +Y axis direction side is restricted from moving in the +Z axis direction by the force Fy.

A-3: Detailed Description of Cartridge Mounting Portion 7

Figure 4A:
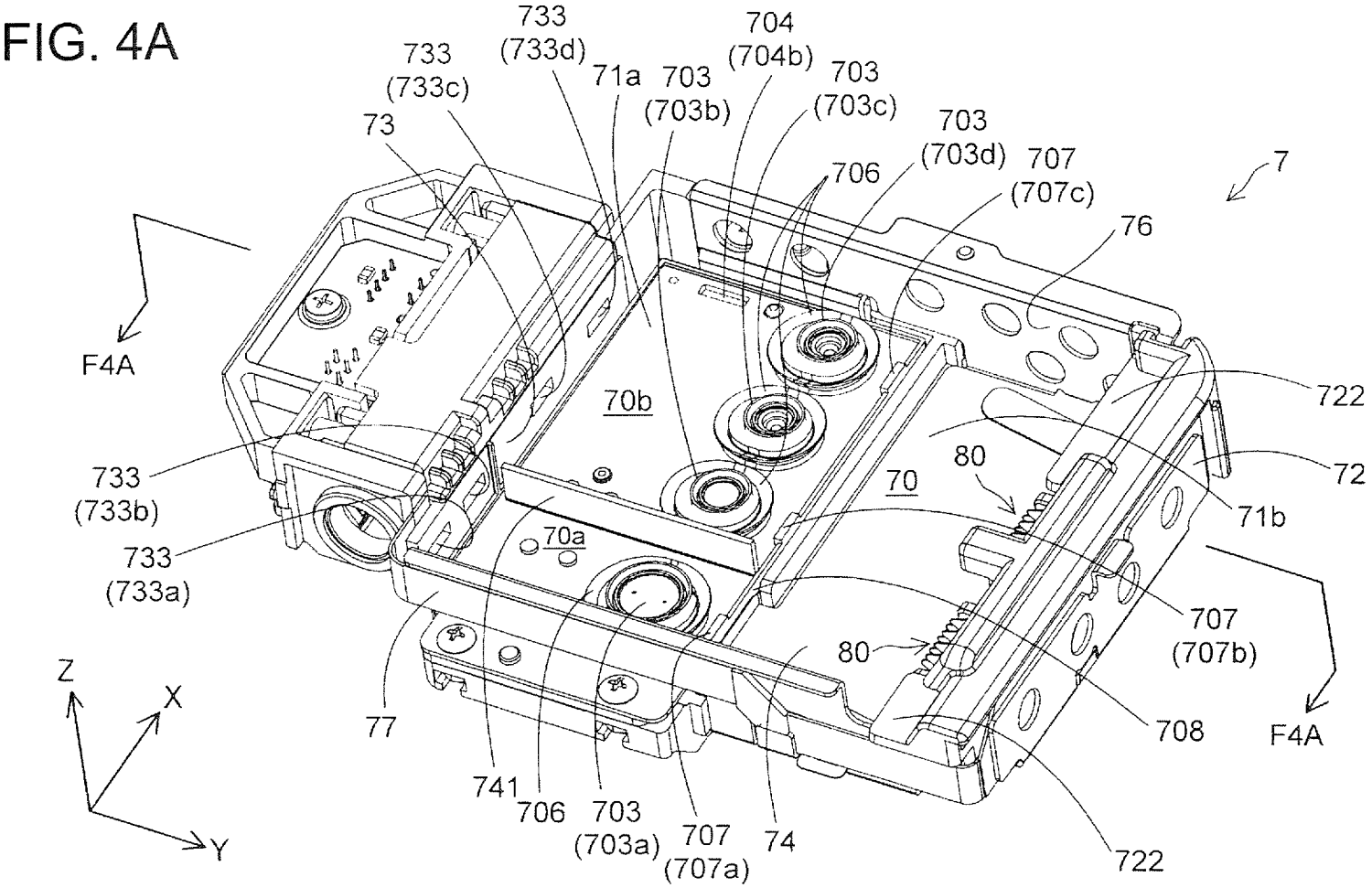
FIG. 4A is a first external perspective view of the cartridge mounting portion.
Figure 4B:
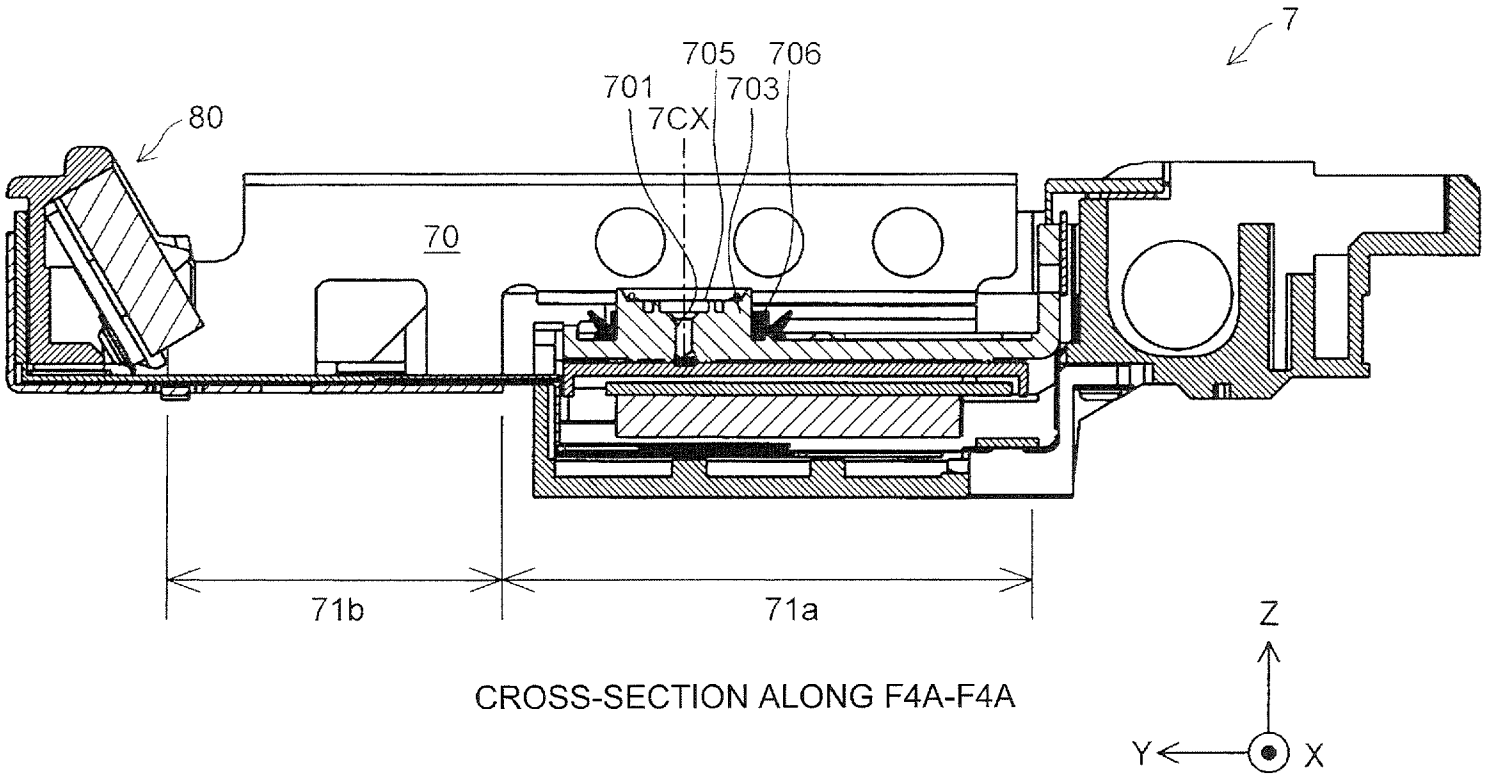
FIG. 4B is a cross-sectional view taken along F4A-F4A.
Figure 5:
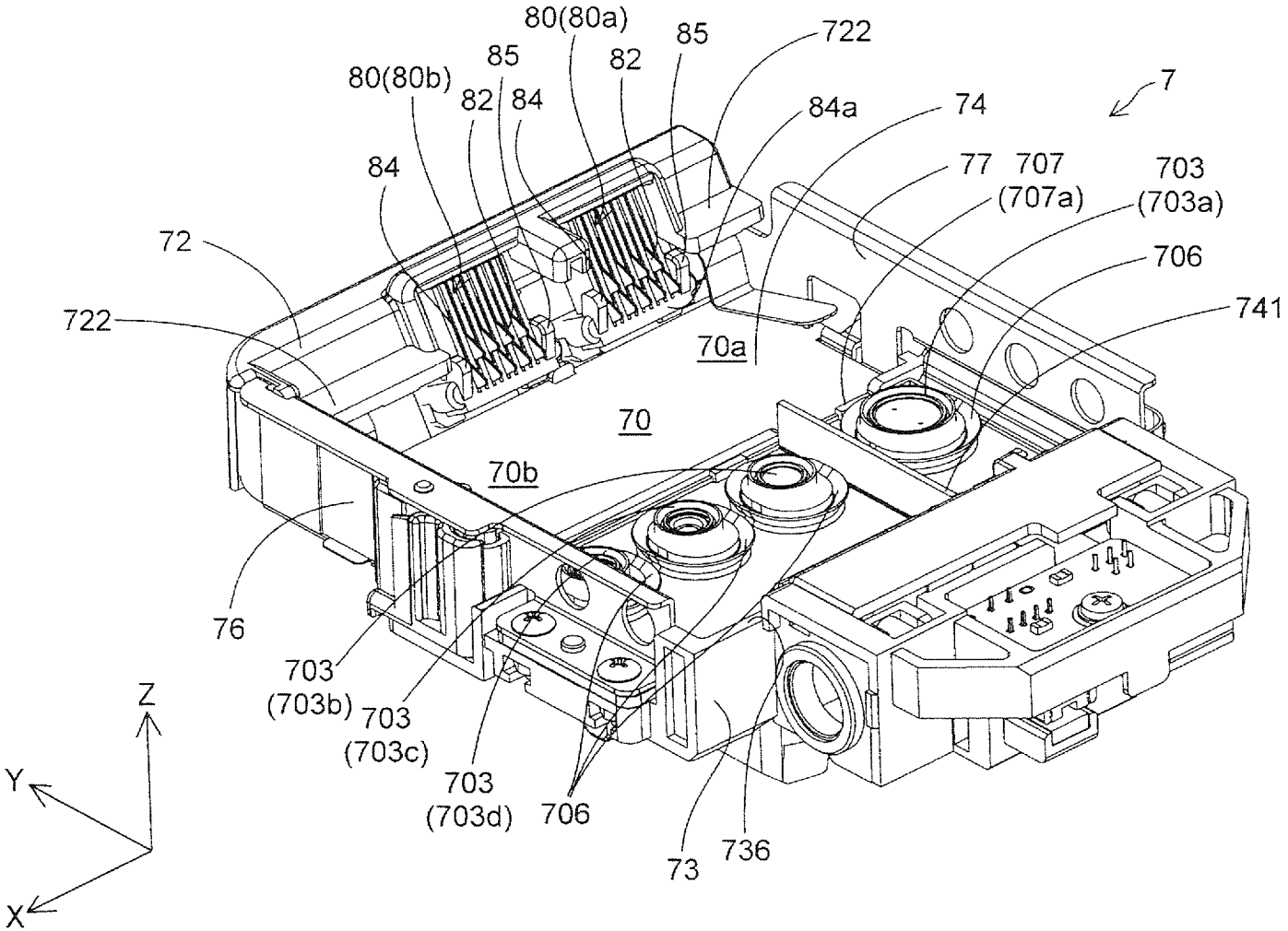
FIG. 5 is a second external perspective view of the cartridge mounting portion.
Figure 6:
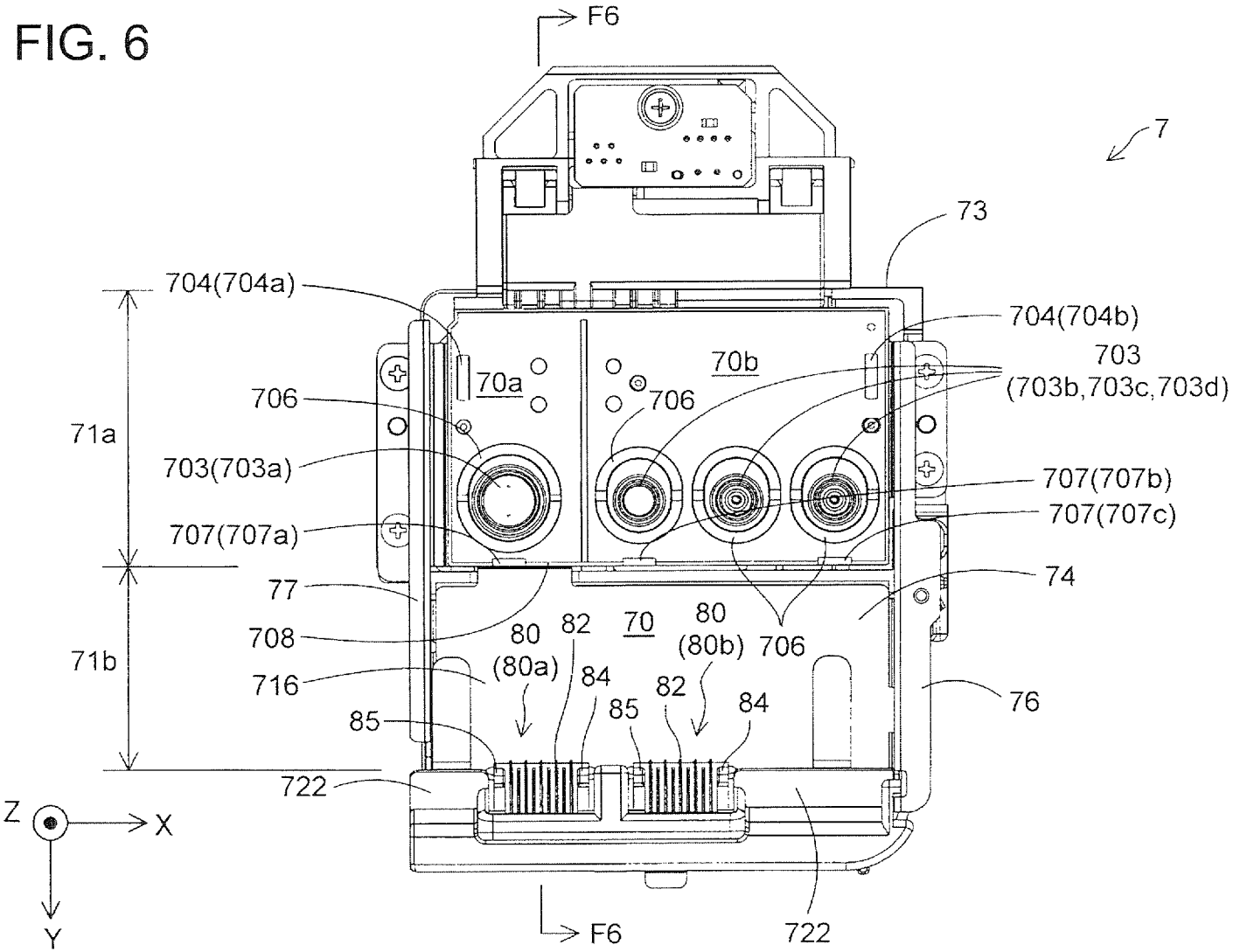
FIG. 6 is a top view of the cartridge mounting portion.
Figure 7A:
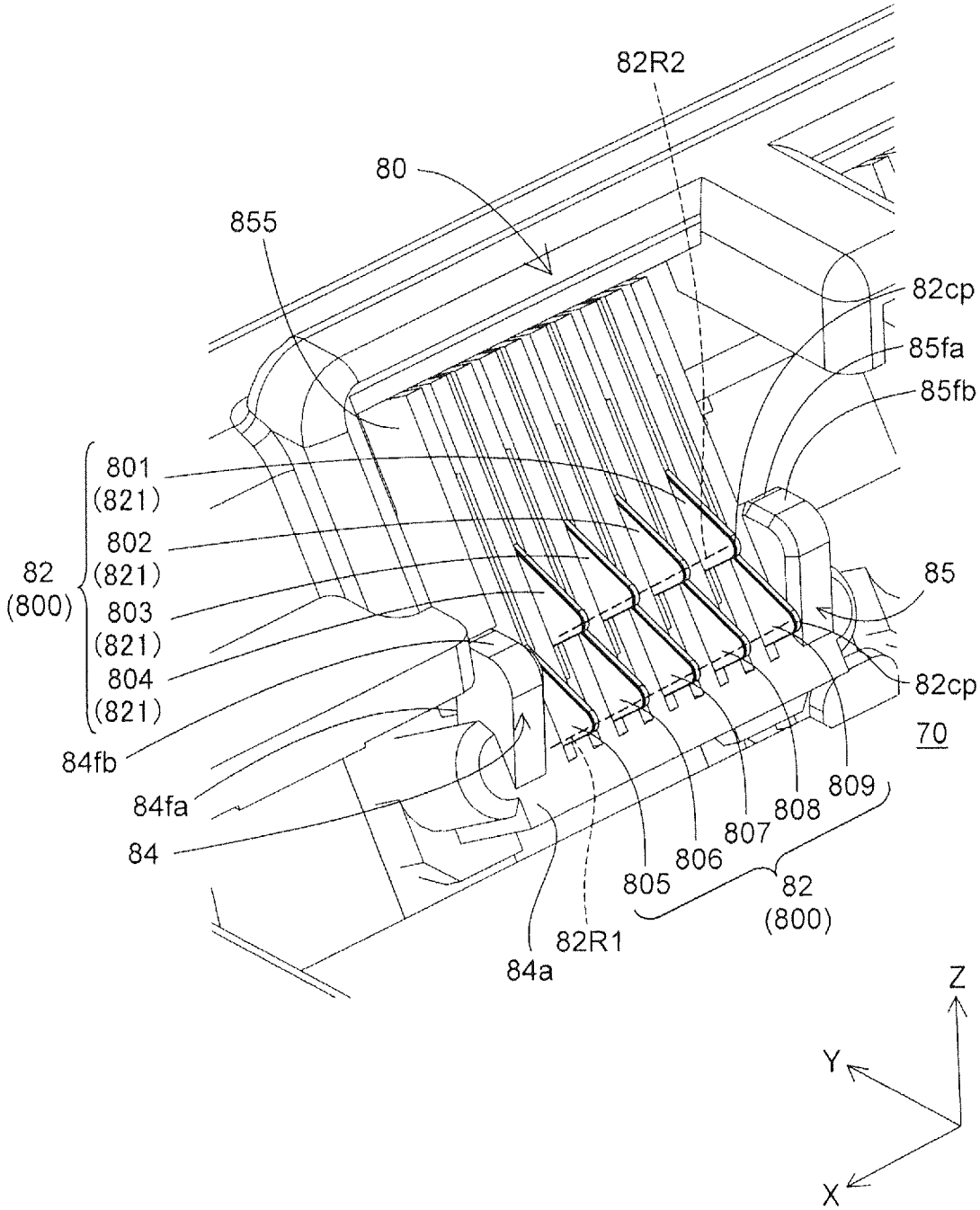
FIG. 7A is an enlarged view of the vicinity of a connector provided in a second slot.
Figure 7B:
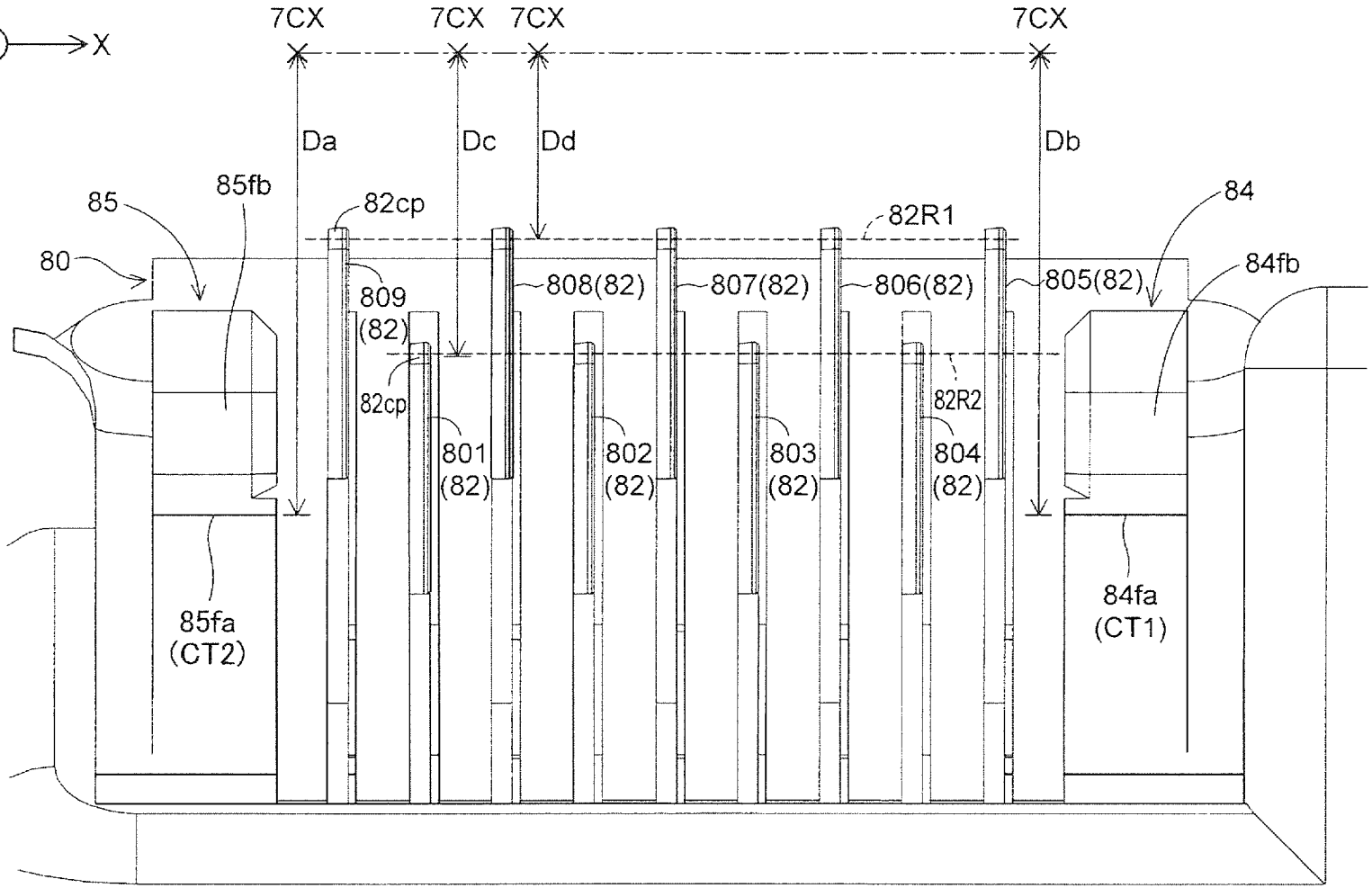
FIG. 7B is a partial enlarged view of FIG. 6.
Figure 7C:
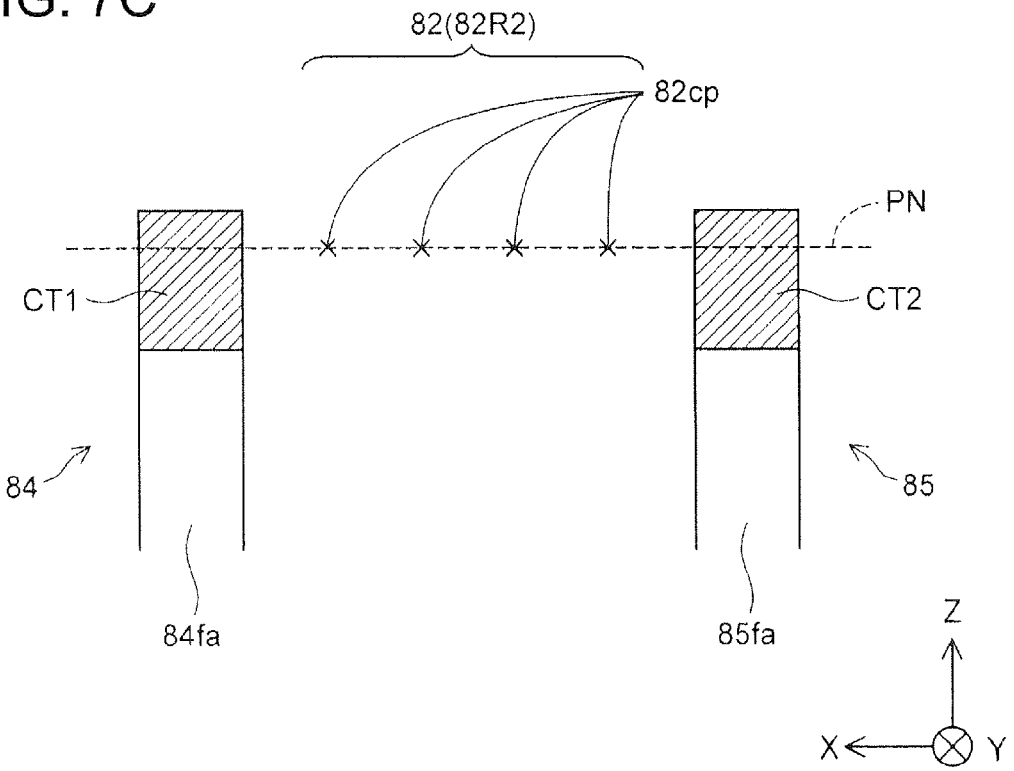
FIG. 7C is a schematic diagram showing the positional relationship between a first engaging portion, a second engaging portion, and a contact portion.
Figure 8:
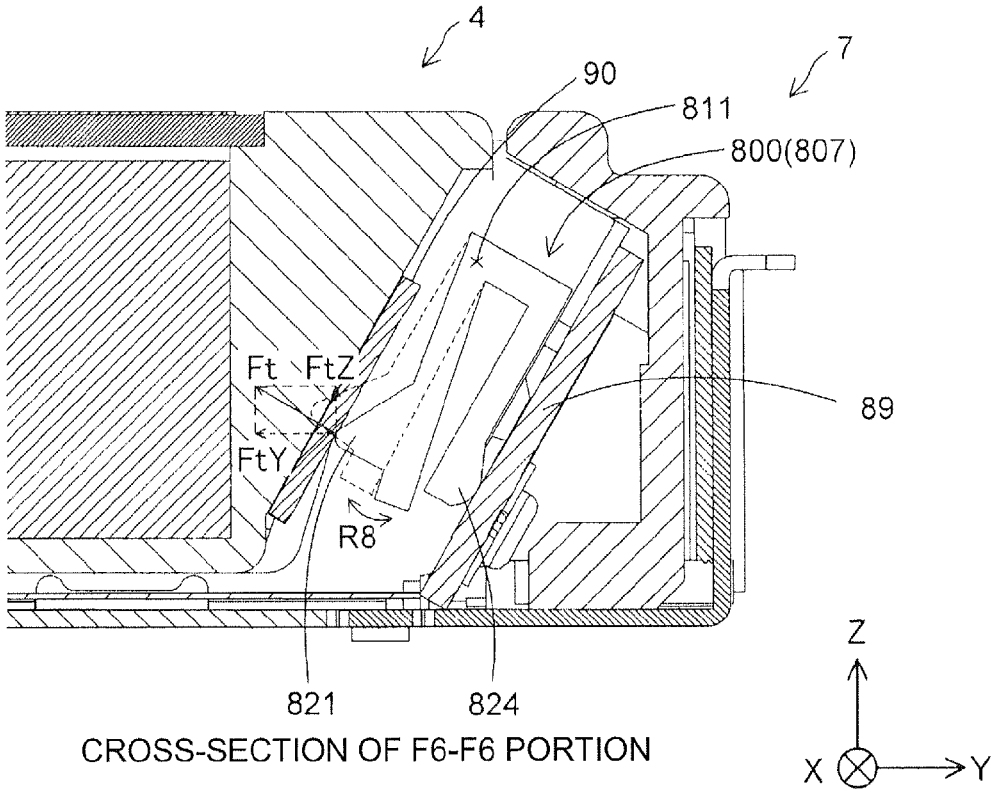
FIG. 8 is a partial cross-sectional view taken along F6-F6.

FIG. 4A is a first external perspective view of the cartridge mounting portion 7. FIG. 4B is a cross-sectional view taken along F4A-F4A. FIG. 5 is a second external perspective view of the cartridge mounting portion 7. FIG. 6 is a top view of the cartridge mounting portion 7. FIG. 7A is an enlarged view of the vicinity of a connector 80 provided in a second slot 70*b*. This is an enlarged view of the connector 80 that the cartridge mounting portion 7 is provided with. FIG. 7B is a partial enlarged view of FIG. 6. FIG. 7C is a schematic diagram showing the positional relationship between first and second engaging portions 84 and 85 and a contact portion 82*cp*. FIG. 8 shows the positional relationship in the mounted state in which the first cartridge 4 has been mounted. The following describes the detailed configuration of the cartridge mounting portion 7 with reference to FIGS. 4A to 8.

As shown in FIG. 4A, the cartridge mounting portion 7 includes five walls 72, 73, 74, 76, and 77. The five walls 72, 73, 74, 76, and 77 are formed from a synthetic resin. The cartridge mounting portion 7 is defined by these five walls 72, 73, 74, 76, and 77. The cartridge mounting portion 7 has a recessed shape, and has a slot 70 (mounting space 70) inside for mounting the cartridges 4 and 5. The slot 70 includes a first slot 70*a* for mounting the first cartridge 4 and a second slot 70*b* for mounting the second cartridge 5. The first and second slots 70*a* and 70*b* are partitioned by a partition wall 741. The height of the partition wall 741 is greater than the height of the liquid introduction portions 703. Specifically, the end of the partition wall 741 located on the +Z axis direction side is arranged at a higher position than the ends of the liquid introduction portions 703 located on the +Z axis direction side. This enables reducing the possibility of the outer shells of the cartridges 4 and 5 from colliding with the liquid introduction portions 703 in the process of mounting the cartridges 4 and 5. This therefore reduces the possibility of the liquid introduction portions 703 becoming damaged.

The first and second slots 70*a* and 70*b* are both substantially shaped as a parallelepiped. The X axis direction, the Y axis direction, and the Z axis direction are respectively the width direction, the length direction, and the height direction of the cartridge mounting portion 7. The width of the second slot 70*b* is greater than that of the first slot 70*a*.

The wall 74 defines the bottom plane of the cartridge mounting portion 7. The walls 72, 73, 76, and 77 respectively define side planes of the cartridge mounting portion 7. The side planes of the cartridge mounting portion 7 intersect with the bottom plane of the cartridge mounting portion. The wall 74 will also be called the "device-side bottom wall 74". The wall 72 will also be called the "first device-side side wall 72". The wall 73 will also be called the "second device-side side wall 73". The wall 76 will also be called the "third device-side side wall 76". The wall 77 will also be called the "fourth device-side side wall 77". An opening for the passage of the cartridges 4 and 5 when the cartridges 4 and 5 are mounted/removed is formed on the side that opposes the device-side bottom wall 74. Note that in this specification, the "intersection" of two planes (elements) refers to a state in which the two planes (elements) cross each other so as to actually intersect each other, a state in which an extension plane (extension portion) of one plane (element) intersects with the other plane (element), or a state in which extension planes (extension portions) of the two planes (elements) intersect each other.

The first to fourth device-side side walls 72, 73, 76, and 77 are provided upright on the device-side bottom wall 74. The first to fourth device-side side walls 72, 73, 76, and 77 extend substantially vertically from the device-side bottom wall 74. The first device-side side wall 72 and the second device-side side wall 73 oppose each other across the slot 70. The third device-side side wall 76 and the fourth device-side side wall 77 oppose each other across the slot 70. Here, the device-side bottom wall 74 is located on the −Z axis direction side of the slot 70. The first device-side side wall 72 is located on the +Y axis direction side of the slot 70. The second device-side side wall 73 is located on the −Y axis direction side of the slot 70. The third device-side side wall 76 is located on the +X axis direction side of the slot 70. The fourth device-side side wall 77 is located on the −X axis direction side of the slot 70.

As shown in FIG. 4A, a level change 708 is formed on the device-side bottom wall 74. The slot 70 therefore includes device compartments 71*a* and 71*b* that have different depths. The device compartment 71*b* is deeper than the device compartment 71*a*. In other words, the bottom plane of the device compartment 71*b* is arranged at a position lower than the bottom plane of the device compartment 71*a*.

As shown in FIGS. 4A and 6, the device-side bottom wall 74 includes liquid introduction portions 703, bottom wall engaging portions 704, and contact portions 707. Four liquid introduction portions 703 are provided. Two bottom wall engaging portions 704 are provided. Three contact portions 707 are provided.

The liquid introduction portions 703 are tube-shaped. The liquid introduction portions 703 extend along the +Z axis direction from the device-side bottom wall 74. In the mounted state in which the cartridges 4 and 5 have been mounted, the liquid supply portions 447 of the cartridges 4 and 5 are connected to the liquid introduction portions 703. Ink stored in the cartridges 4 and 5 is introduced to flow channels 701 (FIG. 4B) in the liquid introduction portion 703 via openings 705 (FIG. 4B) formed in one end portion of the liquid introduction portions 703. The ink introduced to the liquid introduction portions 703 flows to the head. As shown in FIGS. 4A and 4B, a sealing member 706 is provided in the periphery of each of the liquid introduction portions 703. In the mounted state of the cartridges 4 and 5, the sealing members 706 come into contact with the periphery of the liquid supply portions 447 of the cartridges 4 and 5 so as to prevent ink from leaking out from the liquid introduction portions 703. As shown in FIG. 4B, the liquid introduction portions 703 each include a central axis 7CX that extends along the Z axis direction.

As shown in FIG. 4A, the reference sign "703" will be used when referring to the four liquid introduction portions 703 collectively or mentioning any one of them, and reference signs "703*a*", "703*b*", "703*c*", and "703*d*" will be used when distinguishing between the four liquid introduction portions 703. The liquid introduction portion 703*a* is arranged in the first slot 70*a*, and the liquid introduction portions 703*b*, 703*c*, and 703*d* are arranged in the second slot 70*b*. As shown in FIG. 6, the liquid introduction portions 703*a* to 703*d* are arranged along the X axis direction. The liquid introduction portions 703*a* to 703*d* are arranged at substantially regular intervals.

As shown in FIGS. 4A and 6, the bottom wall engaging portions 704 are indentations formed in the device-side bottom wall 74. Note that the bottom wall engaging portions 704 may be through-holes. As shown in FIG. 6, the bottom wall engaging portions 704 are formed one each in the first slot 70*a* and the second slot 70*b*. The bottom wall engaging portions 704 receive the insertion of portions of the cartridges 4 and 5. The cartridges 4 and 5 are thus positioned relative to the cartridge mounting portion 7. The reference sign "704" will be used when referring to the two bottom wall engaging portions 704 collectively or mentioning either one of them, and reference signs "704*a*" and "704*b*" will be used when distinguishing between the two bottom wall engaging portions 704. The bottom wall engaging portion 704*a* is arranged in the first slot 70*a*, and the bottom wall engaging portion 704*b* is arranged in the second slot 70*b*.

As shown in FIG. 4A, the contact portions 707 are projections formed on the device-side bottom wall 74. The contact portions 707 are arranged at positions in the vicinity of the liquid introduction portions 703. The contact portions 707 come into contact with portions of the cartridges 4 and 5 in the mounting process performed when mounting the cartridges 4 and 5 to the cartridge mounting portion 7. Due to the contact portions 707 coming into contact with portions of the cartridges 4 and 5, it is possible to prevent the cartridges 4 and 5 from being pressed too far into the cartridge mounting portion 7. This enables achieving an appropriate extent of contact between the liquid introduction portions 703 and the liquid supply portions of the cartridges 4 and 5. It is therefore possible for the amount of ink introduced from the cartridges 4 and 5 to the liquid introduction portions 703 to be maintained in an appropriate range.

The reference sign "707" will be used when referring to the three contact portions 707 collectively or mentioning any one of them, and reference signs "707*a*", "707*b*", and "707*c*" will be used when distinguishing between the three contact portions 707. As shown in FIG. 6, the contact portion 707*a* is arranged in the first slot 70*a*, and the contact portions 707*b* and 707*c* are arranged in the second slot 70*b*. The contact portions 707*b* and 707*c* are arranged with a separation from each other in the X axis direction in order to suppress tilting of the second cartridge 5 so as to achieve stable contact. In terms of the X axis direction, the contact portion 707*b* is arranged at a position that coincides with the liquid introduction portion 703*b*, which is the one of the three aligned liquid introduction portions 703*b* to 703*d* that is located most on the −X axis direction side. Also, in terms of the X axis direction, the contact portion 707*c* is arranged at a position that coincides with the liquid introduction portion 703*d*, which is the one of the three aligned liquid introduction portions 703*b* to 703*d* that is located most on the +X axis direction side.

As shown in FIG. 5, the first device-side side wall 72 includes connectors 80 and mounting/removal portions 722. Two connectors 80 are provided. The reference sign "80" will be used when referring to the two connectors collectively or mentioning either one of them, and reference signs "80*a*" and "80*b*" will be used when distinguishing between the two connectors. The connector 80*a* is arranged in the first slot 70*a*, and the connector 80*b* is arranged in the second slot 70*b*. Specifically, the connector 80*a* comes into contact with the first cartridge 4, and the connector 80*b* comes into contact with the second cartridge 5.

As shown in FIG. 7A, the connectors 80 each include a connector body 855, a first engaging portion 84, a second engaging portion 85, and a contact member group 82. The contact member group 82 is made up of nine conductive contact members 801 to 809. Here, the reference sign "800" will be used when referring to the nine contact members 801 to 809 collectively, or when mentioning any one of them. The connector body 855 is a member for fixing the conductive contact members 800. A top plane 84*a* of the connector body 855 is inclined toward a direction that includes a +Z axis direction component and a −Y axis direction component. Specifically, the normal line of the top plane 84*a*, which is a plane, extends along a direction that includes a +Z axis direction component and a −Y axis direction component.

As shown in FIG. 7A, the first engaging portion 84 and the second engaging portion 85 are each fixed to the connector body 855. The first engaging portion 84 and the second engaging portion 85 are each a column-shaped member that extends along the vertically upward direction from the connector body 855. The first engaging portion 84 and the second engaging portion 85 both have the same shape. In the mounted state, the first engaging portion 84 and the second engaging portion 85 are respectively engaged with corresponding ones of the engaged portions (hooks) 36 and 37 that the cartridges 4 and 5 include (FIG. 3C).

As shown in FIG. 7A, the first engaging portion 84 is arranged so as to be adjacent to the contact members 800. The second engaging portion 85 is also arranged so as to be adjacent to the contact members 800. In this embodiment, the first engaging portion 84 is arranged so as to be adjacent to the contact members 800 in the X axis direction. The second engaging portion 85 is also arranged so as to be adjacent to the contact members 800 in the X axis direction.

As shown in FIGS. 7A and 7B, the first engaging portion 84 includes a first contact portion 84*fa* and a first end portion 84*fb*. The first contact portion 84*fa* and the first end portion 84*fb* constitute the outer surface of the first engaging portion 84. The first contact portion 84*fa* is the plane located on the +Y axis direction side. The first end portion 84*fb* is the plane located on the vertically upward direction side of the first engaging portion 84. The first contact portion 84*fa* intersects with the first end portion 84*fb*. The second engaging portion 85 includes a second contact portion 85*fa* and a second end portion 85*fb*. The second contact portion 85*fa* and the second end portion 85*fb* constitute the outer surface of the second engaging portion 85. The second contact portion 85*fa* is the plane located on the +Y axis direction side. The second end portion 85*fb* is the plane located on the vertically upward direction side of the second engaging portion 85. The first and second contact portions 84*fa* and 85*fa* are planes that extend vertically. The first and second end portions 84*fb* and 85*fb* are planes that are horizontal when the liquid ejection system 1 is in the in-use state.

In the mounted state of the cartridges 4 and 5, the first contact portion 84*fa* comes into contact with the engaged portions 36, which are portions of the cartridges 4 and 5, so as to be engaged therewith. In the mounted state of the cartridges 4 and 5, the second contact portion 85*fa* comes into contact with the engaged portions 37, which are portions of the cartridges 4 and 5, so as to be engaged therewith. In the mounting process for mounting the cartridges 4 and 5 to the cartridge mounting portion 7, the first end portion 84*fb* opposes the engaged portions 36, which are portions of the cartridges 4 and 5. In the mounting process, the second end portion 85*fb* opposes the engaged portions 37, which are portions of the cartridges 4 and 5.

As shown in FIG. 7A, the conductive contact members 800 are held by the connector body 855. The contact members 800 have elastic force. A portion of each of the contact members 800 protrudes from the top plane 84*a* of the connector body 855. As shown in FIGS. 7A and 7B, the portion of each contact member 800 that protrudes from the top plane 84*a* will also be referred to as the "one end portion 821". The one end portion 821 has a triangular side plane, and the vertex portion forms the contact portion 82*cp* for coming into contact with the terminals 930 of the cartridges 4 and 5.

As shown in FIG. 8, another portion of each of the contact members 800 is in contact with a board 89 that the cartridge mounting portion 7 is provided with. The board 89 is electrically connected to the control unit 60 of the printer 10. The contact members 800 are each a plate-shaped spring member. The contact members 800 have elastic force. The one end portion 821 of each of the contact members 800 can be displaced about a support 811 in the arrow R8 direction. The arrow R8 direction conforms to a plane that is parallel to the Y axis direction and the Z axis direction (i.e., the YZ plane).

As shown in FIG. 7A, the contact members 800 are fixed to the connector body 855 at positions sandwiched by the first engaging portion 84 and the second engaging portion 85. The contact members 800 are located between the first engaging portion 84 and the second engaging portion 85 in terms of the X axis direction.

Here, the contact member 801 will also be called the "first contact member 801", the contact member 802 will also be called the "second contact member 802", the contact member 803 will also be called the "third contact member 803", the contact member 804 will also be called the "fourth contact member 804", the contact member 805 will also be called the "fifth contact member 805", the contact member 806 will also be called the "sixth contact member 806", the contact member 807 will also be called the "seventh contact member 807", the contact member 808 will also be called the "eighth contact member 808", and the contact member 809 will also be called the "ninth contact member 809".

As shown in FIG. 7B, the contact portions 82*cp* of the first to fourth contact members 801 to 804 are arranged so as to form a row 82R2 along the X axis direction. Also, the contact portions 82*cp* of the fifth to ninth contact members 805 to 809 are arranged so as to form a row 82R1 along the X axis direction. The rows 82R1 and 82R2 are located at different heights.

As shown in FIG. 8, in the mounted state, the contact members 800 apply force Ft to the cartridge 4 (specifically, the circuit substrate 90). The force Ft is force that includes a −Y axis direction (i.e., first direction) component and a +Z axis direction (i.e., second direction) component. In other words, the force Ft can be decomposed into a −Y axis direction force FtY and a +Z axis direction force FtZ. Note that although the cartridge 4 is shown in FIG. 8, the connectors 80 apply similar force in the same direction as the force Ft to the cartridge 5 as well.

As shown in FIG. 7B, the central axes (centers) 7CX of the liquid introduction portions 703 are separated by a distance Dd from portions 82*cp* of the contact members 800 where the contact members 805 to 809 that form the row 82R1 come into contact with the terminals of the cartridges 4 and 5. Also, the central axes (centers) 7CX of the liquid introduction portions 703 are separated by a distance Dc from the portions 82*cp* of the contact members 800 where the contact members 801 to 804 that form the row 82R2 come into contact with the terminals of the cartridges 4 and 5. Also, portions CT1 of the first engaging portions 84 that come into contact with the engaged portions 36 of the cartridges 4 and 5 are separated from the central axes (centers) 7CX of the liquid introduction portions 703 by a distance Db. Also, portions CT2 of the second engaging portions 85 that come into contact with the engaged portions 37 of the cartridges 4 and 5 are separated from the central axes (centers) 7CX of the liquid introduction portions 703 by a distance Da. The distances Da to Dd are dimensions in the Y axis direction. In this embodiment, the distance Da and distance Db have the same magnitude. The following relationships hold in the printer 10. Specifically, the distance Da is greater than both of the distances Dc and Dd. Also, the distance Db is greater than both of the distances Dc and Dd. The above relationships are satisfied before the cartridges 4 and 5 are mounted, and in the mounted state.

As shown in FIG. 7C, the portion CT1 and the portions 82*cp* where the contact members 800 that form the row 82R2 come into contact with the terminals of the cartridges 4 and 5 are located on the same plane PN. Also, the portion CT2 and the portions 82*cp* where the contact members 800 that form the row 82R2 come into contact with the terminals of the cartridges 4 and 5 are located on the same plane PN. The relationships shown in FIG. 7C are satisfied before the cartridges 4 and 5 are mounted, and in the mounted state. Note that the region of the first contact portion 84*fa* that corresponds to the portion CT1 is indicated by hatching in order to facilitate understanding. Also, the region of the second contact portion 85*fa* that corresponds to the portion CT2 is indicated by hatching in order to facilitate understanding.

The mounting/removal portions 722 shown in FIG. 4A engage with the levers 421 and 421A that the cartridges 4 and 5 include. The mounting/removal portions 722 are plate-shaped members provided on an upper end portion of the first device-side side wall 72.

As shown in FIG. 4A, the second device-side side wall 73 includes engaging portions 733. The engaging portions 733 are through-holes. Four engaging portions 733 are provided. The reference sign "733" will be used when referring to the four engaging portions 733 collectively or mentioning any one of them, and reference signs "733*a*", "733*b*", "733*c*", and "733*d*" will be used when distinguishing between the four engaging portions 733. The engaging portions 733*a* and 733*b* are arranged in the first slot 70*a*, and the engaging portions 733*c* and 733*d* are arranged in the second slot 70*b*.

A-4: Description of Exterior of First Cartridge 4

Figure 9:
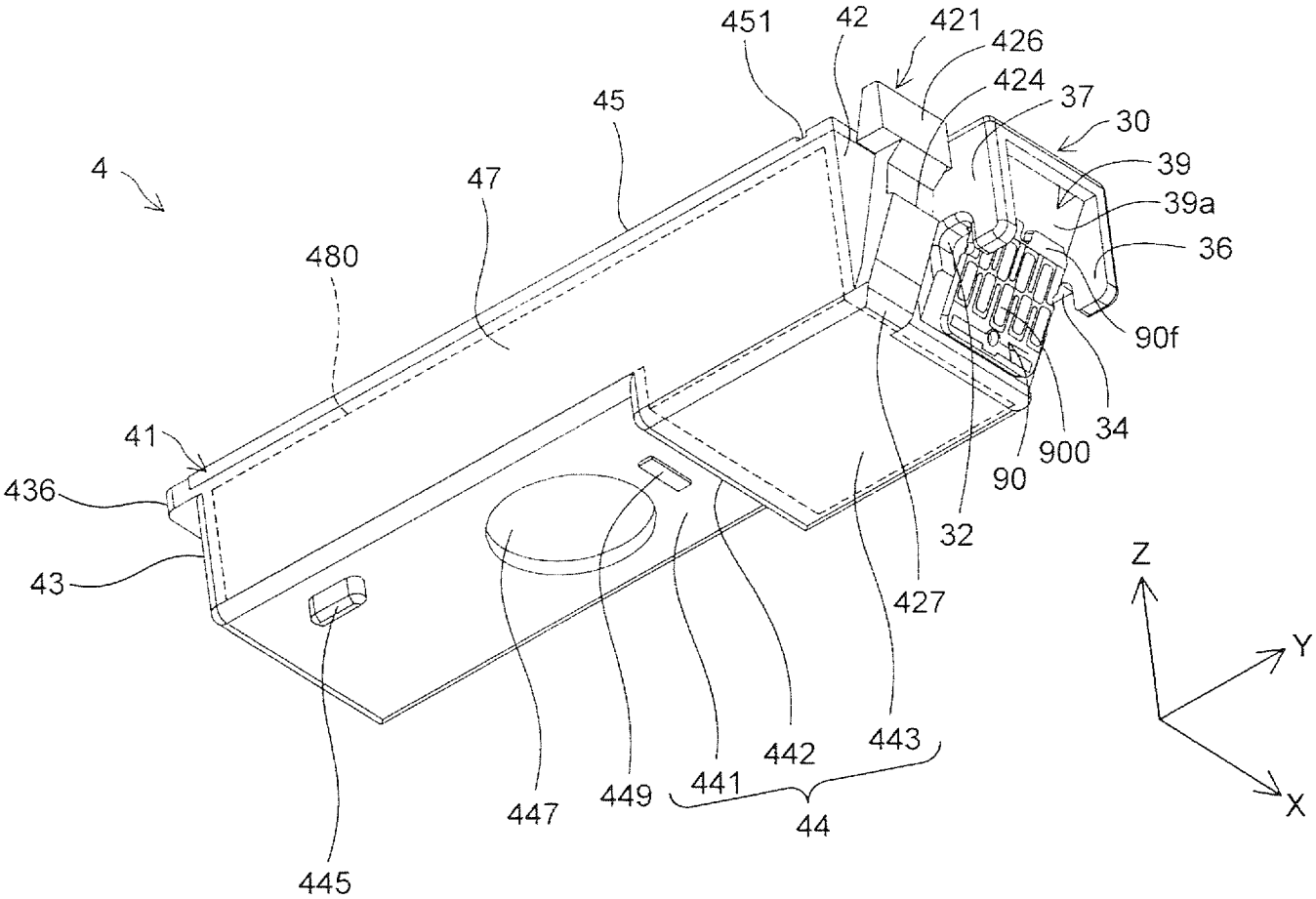
FIG. 9 is an external perspective view of a first cartridge.
Figure 10A:
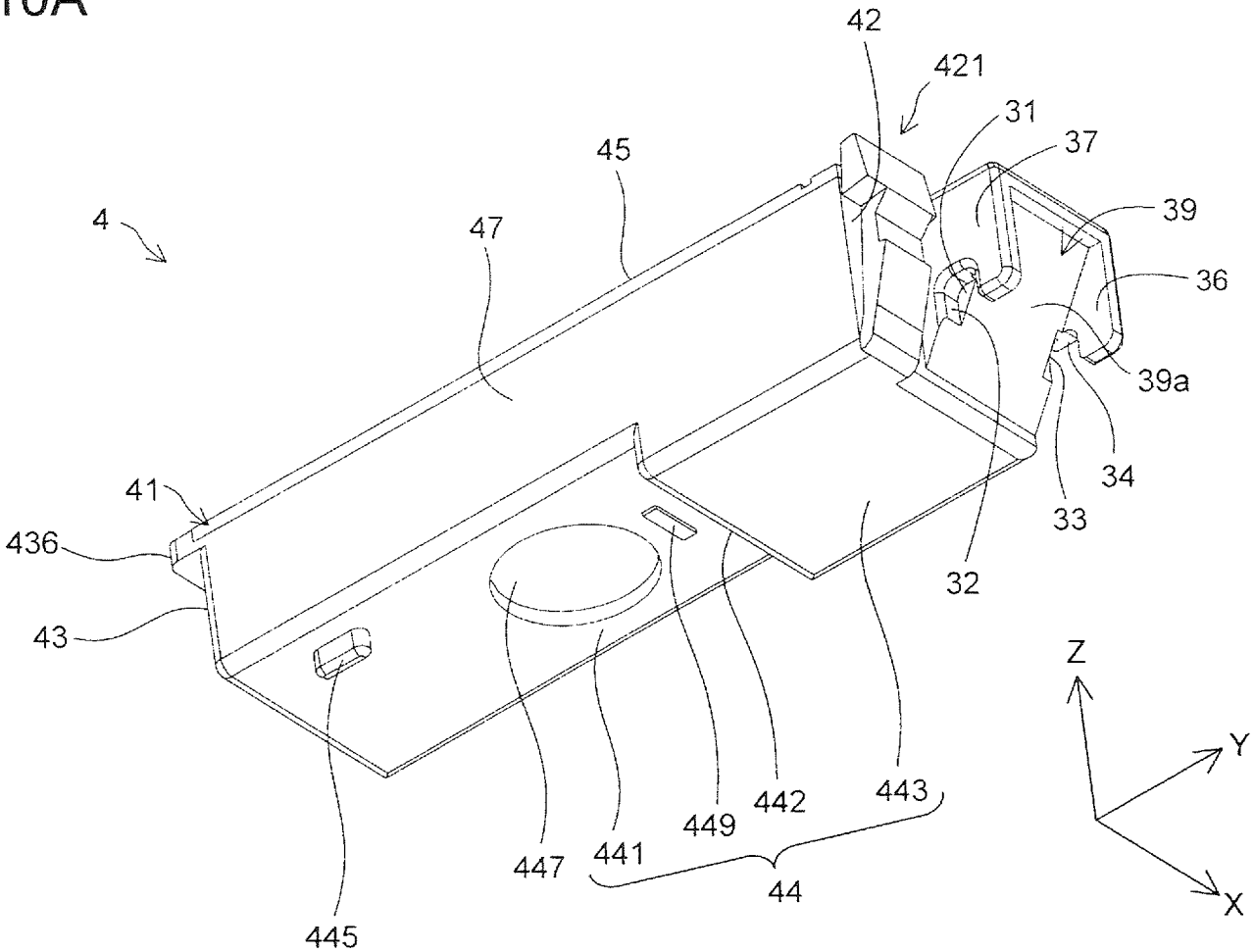
FIG. 10A is an external perspective view of the first cartridge.
Figure 10B:
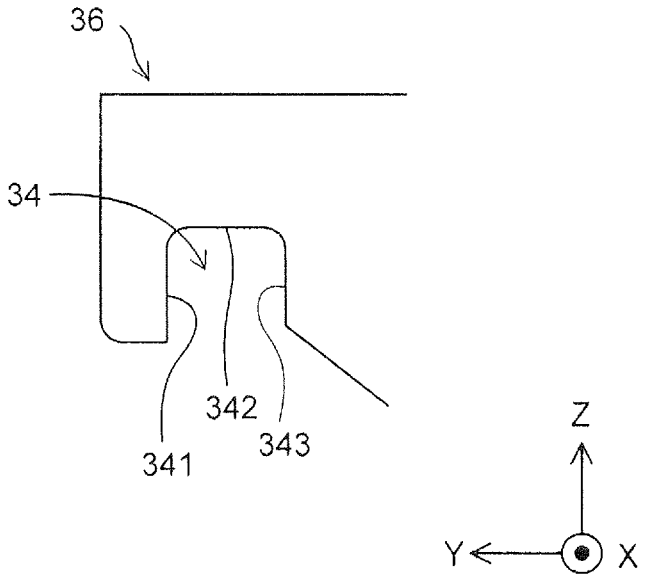
FIG. 10B is a diagram for describing a first engaged portion.
Figure 10C:
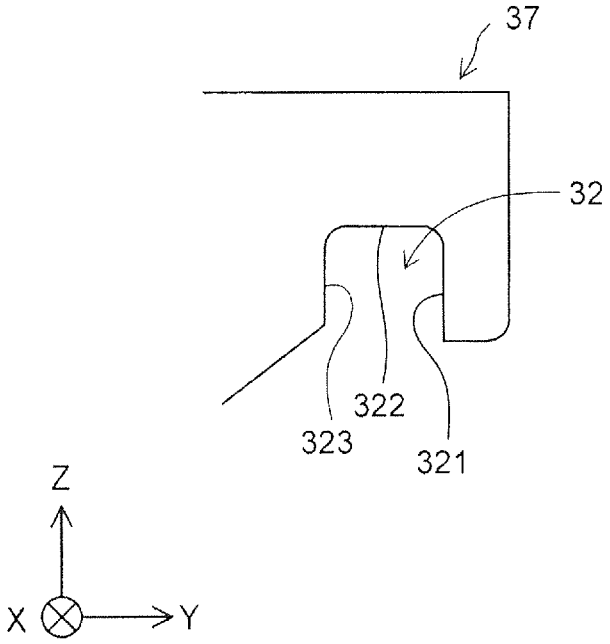
FIG. 10C is a diagram for describing a second engaged portion.
Figure 11:
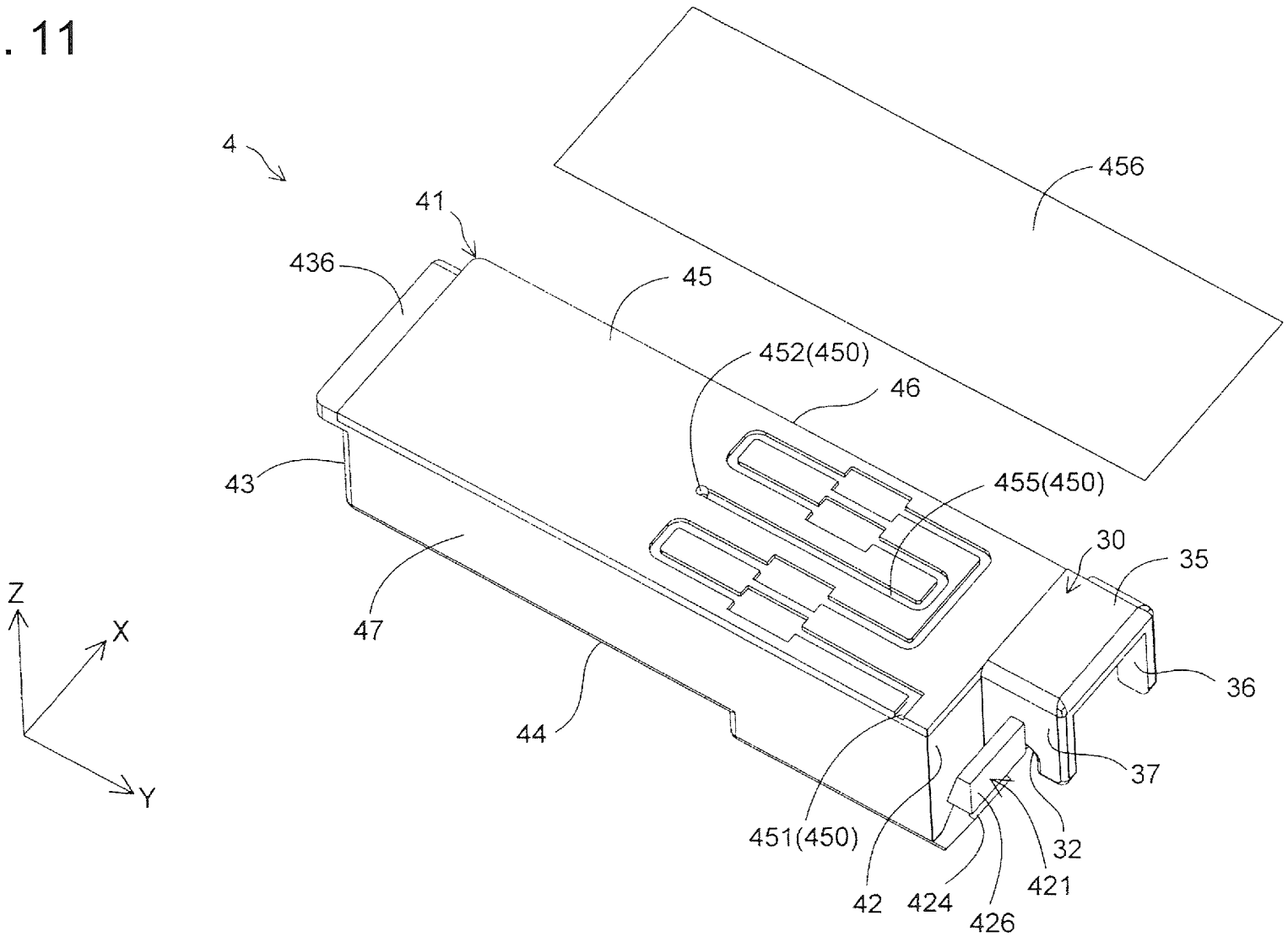
FIG. 11 is an external perspective view of the first cartridge.
Figure 12:
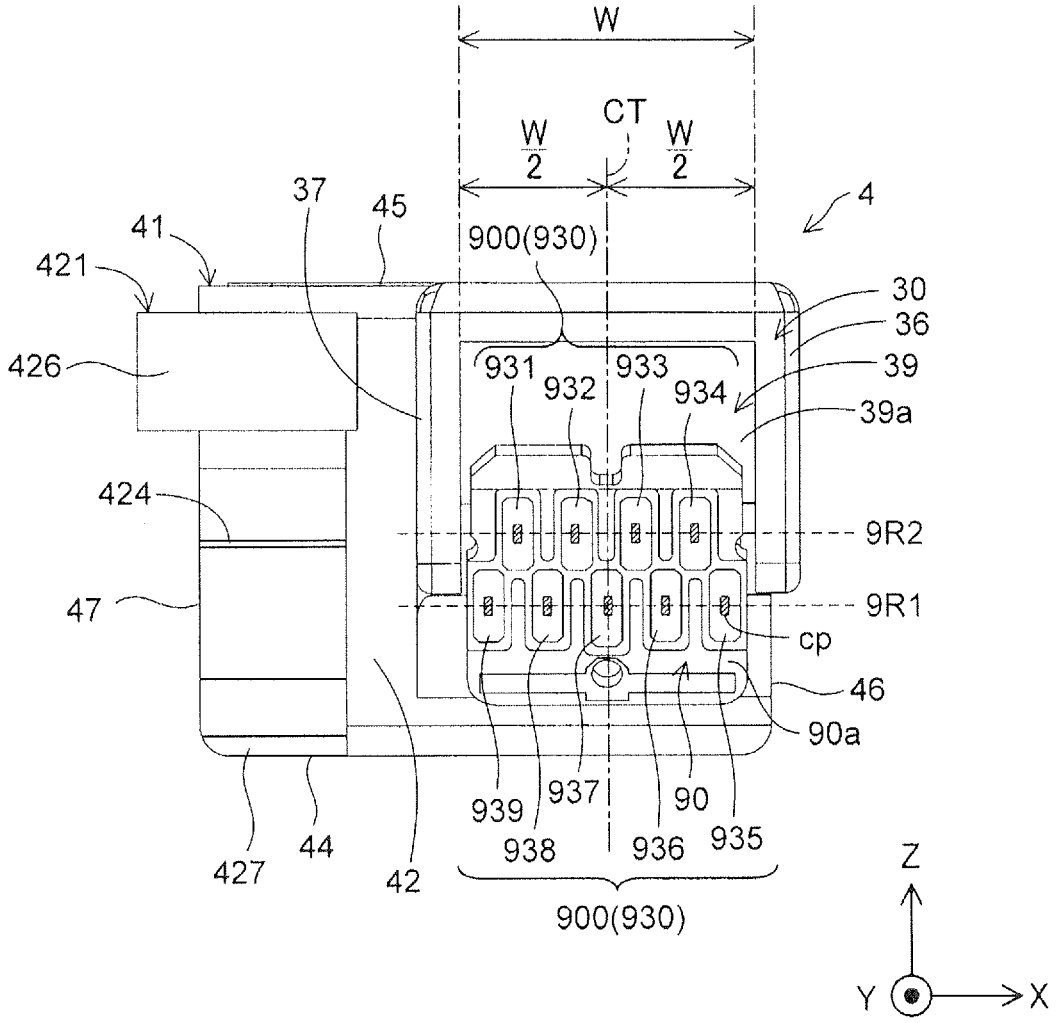
FIG. 12 is a front view of the first cartridge.
Figure 13:
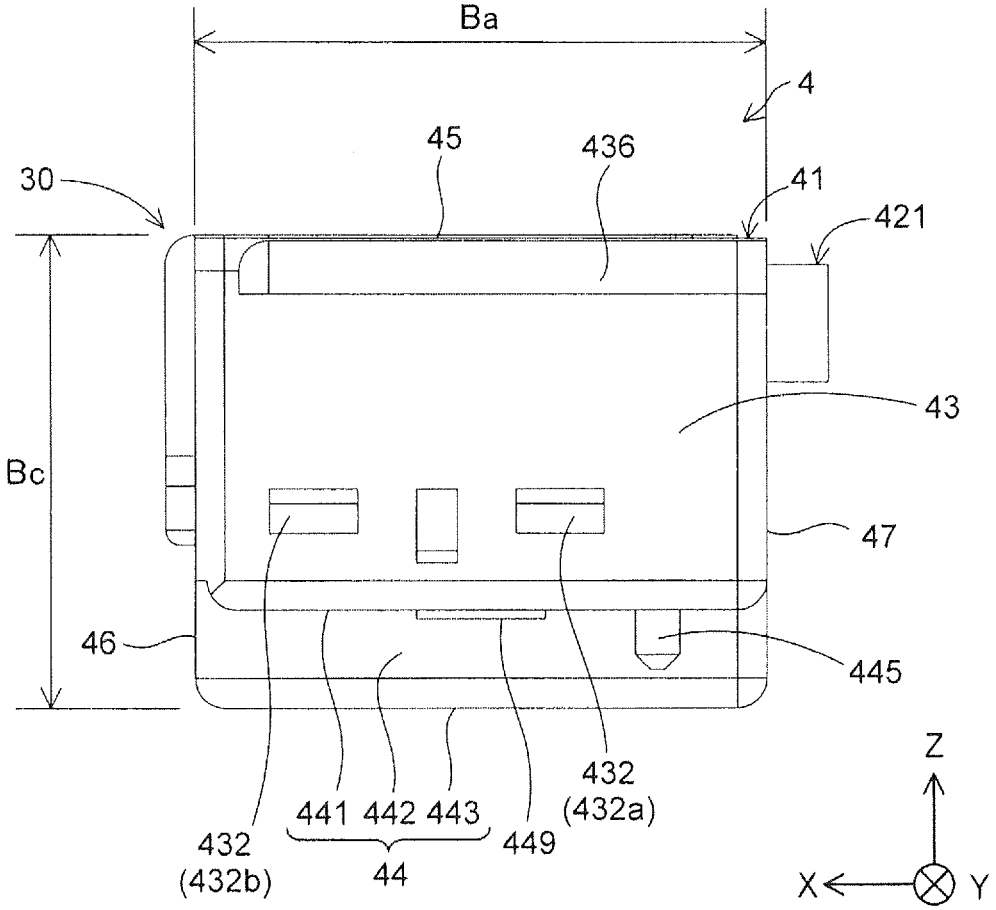
FIG. 13 is a rear view of the first cartridge.
Figure 14:
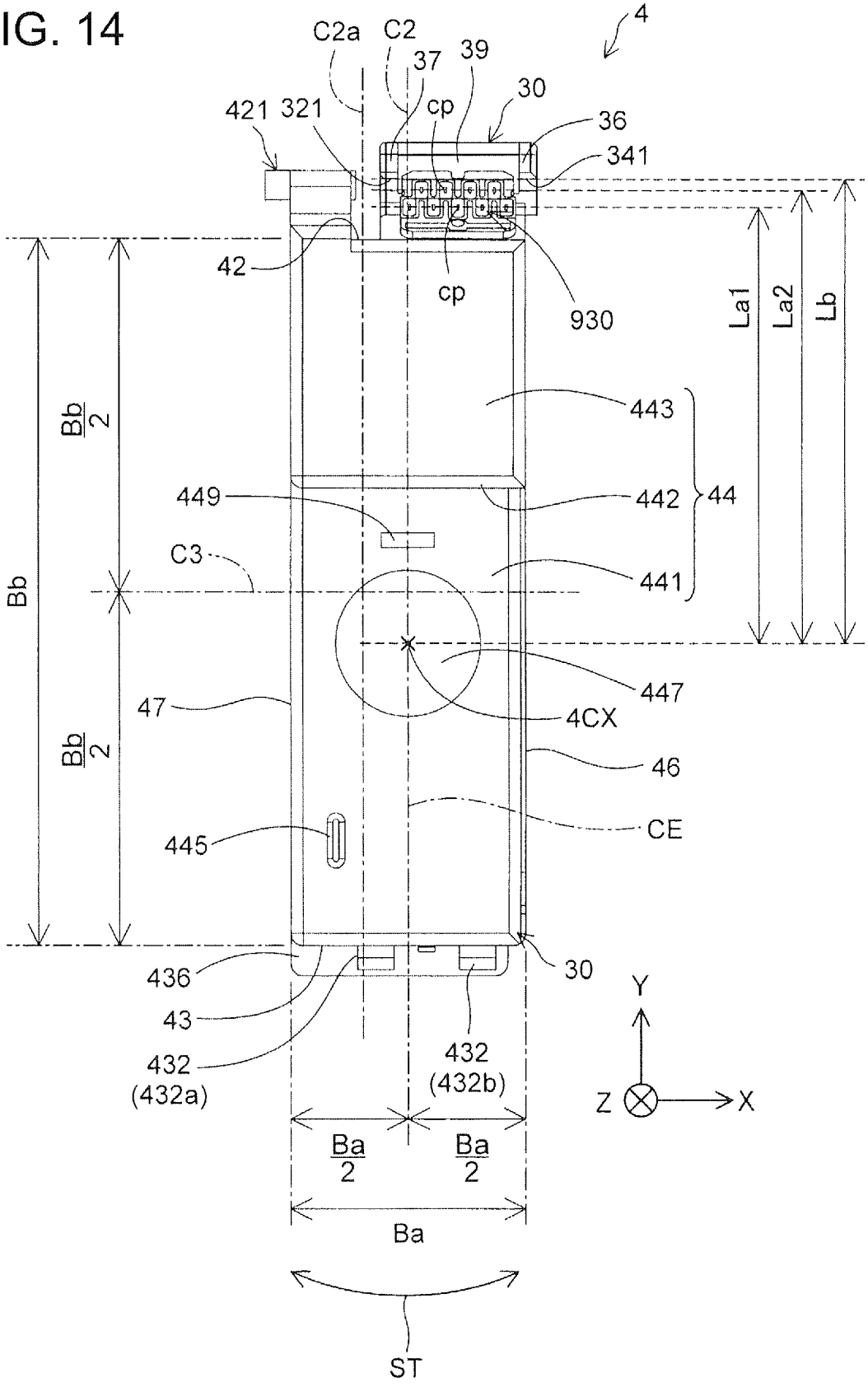
FIG. 14 is a bottom view of the first cartridge.
Figure 15:
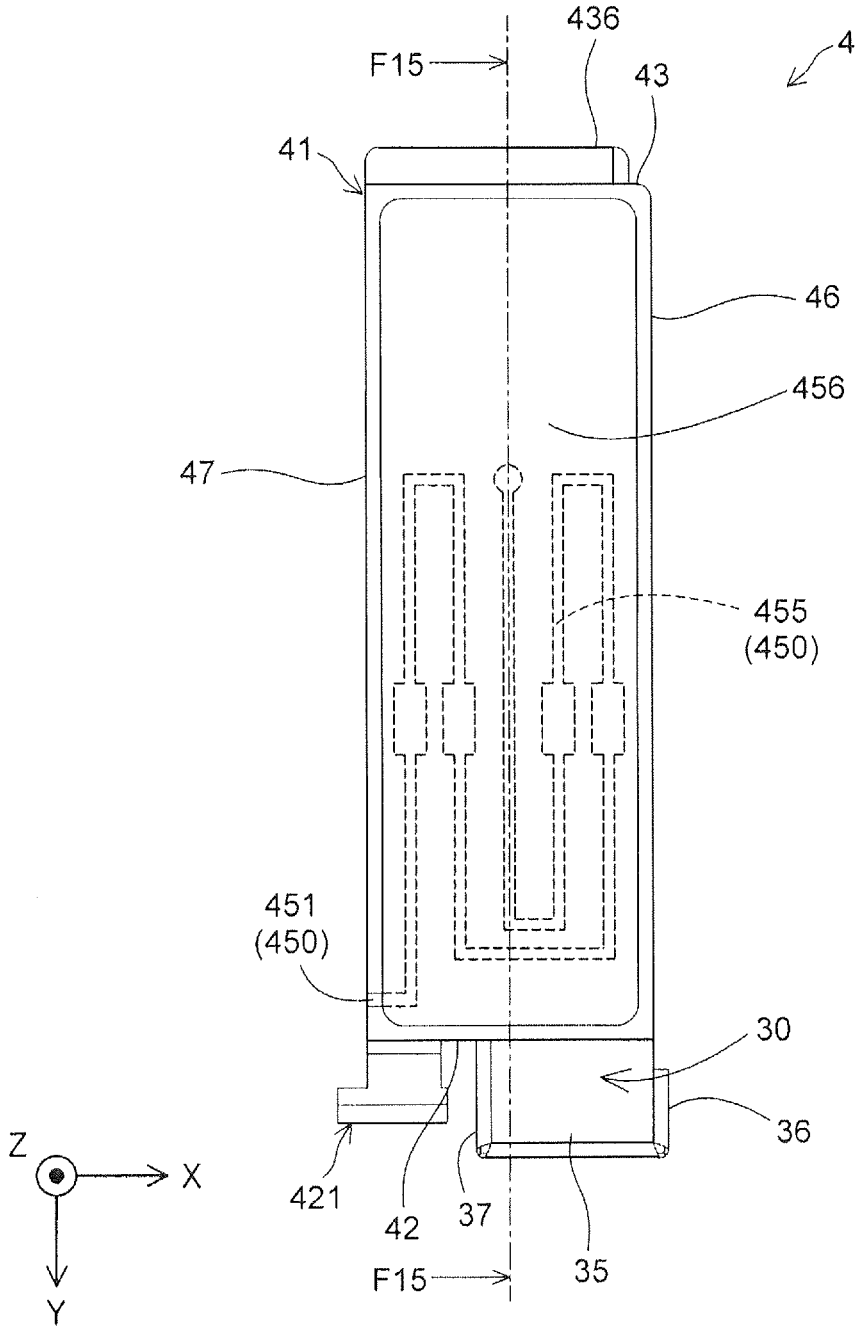
FIG. 15 is a top view of the first cartridge.
Figure 16:
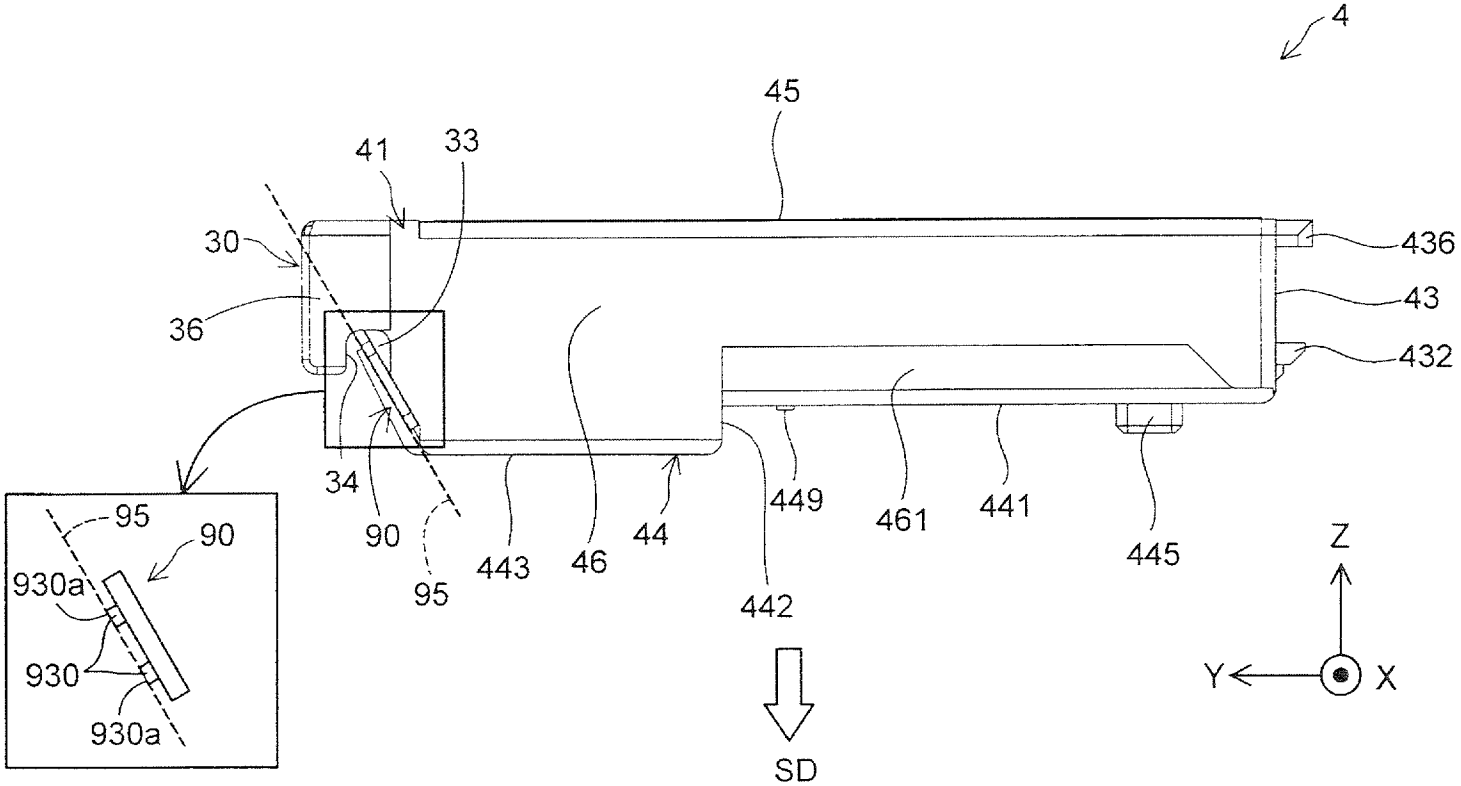
FIG. 16 is a first side view of the first cartridge.
Figure 17:
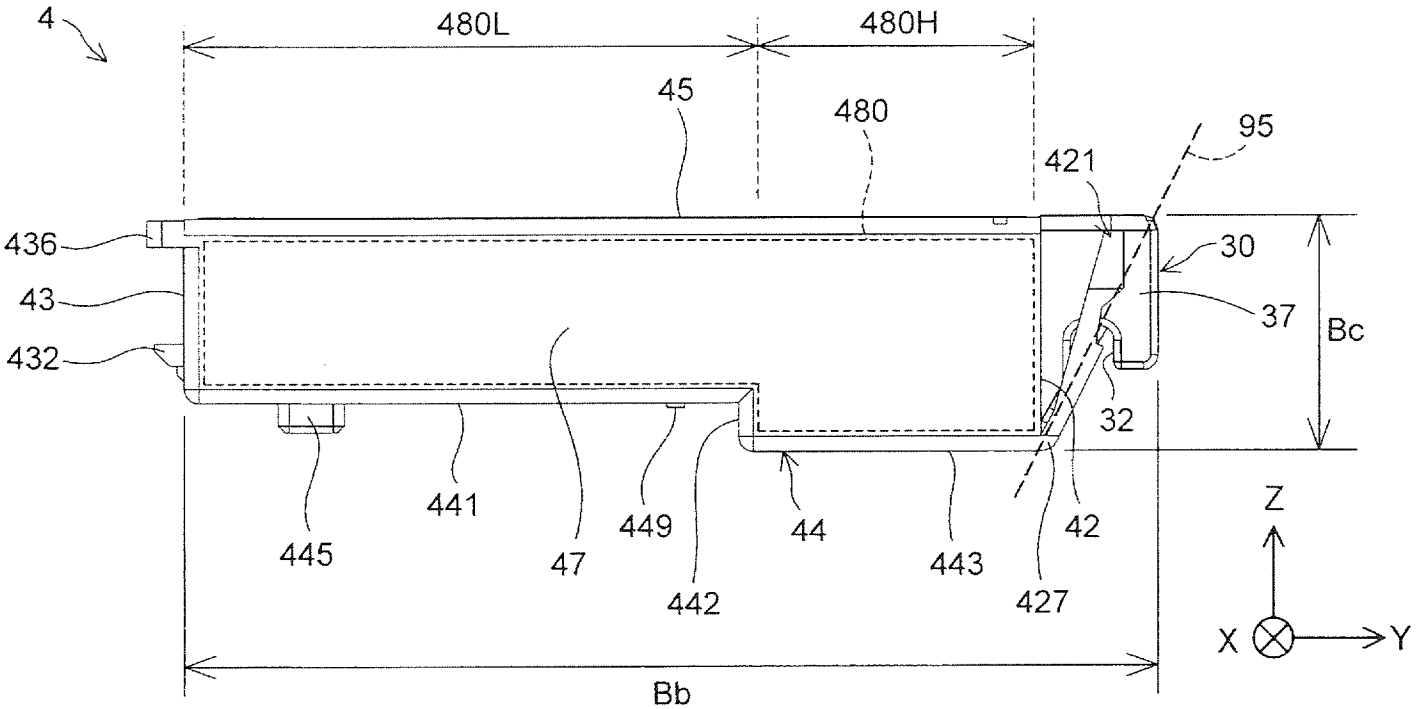
FIG. 17 is a second side view of the first cartridge.

The following describes mainly the configuration of the exterior of the first cartridge 4 with reference to FIGS. 9 to 17. FIG. 9 is an external perspective view of a first cartridge 4. FIG. 10A is an external perspective view of the first cartridge 4. FIG. 10B is a diagram for describing a first engaged portion 36. FIG. 10C is a diagram for describing a second engaged portion 37. 11 is an external perspective view of the first cartridge 4. FIG. 12 is a front view of the first cartridge 4. FIG. 13 is a rear view of the first cartridge 4. FIG. 14 is a bottom view of the first cartridge 4. FIG. 15 is a top view of the first cartridge 4. FIG. 16 is a first side view of the first cartridge 4, FIG. 17 is a second side view of the first cartridge 4. Here, FIG. 10A shows a state in which the circuit substrate 90 has been removed from the first cartridge 4.

As shown in FIGS. 9 and 16 to 17, the first cartridge 4 is shaped as a rectangular column. As shown in FIGS. 9 and 12, the first cartridge 4 includes an outer shell 41, a sheet member 456 (FIG. 11), and the circuit substrate 90. A space for storing ink (liquid storage portion 480) is defined inside the outer shell 41. The outer shell 41 forms at least part of the outer surface of the first cartridge 4. The outer shell 41 is formed from a synthetic resin such as polyethylene or polypropylene. Note that part of the outer shell 41 may be formed by a sheet member made of resin.

As shown in FIGS. 13 and 17, regarding the dimensions of the first cartridge 4, a length Bb has the highest value, and the values of the length Bb (dimension in the Y axis direction), a width Ba (dimension in the X axis direction), and a height Bc (dimension in the Z axis direction) decrease in the stated order. Note that the magnitude relationship between the various dimensions of the first cartridge 4 can be changed arbitrarily.

As shown in FIGS. 9 and 13, the first cartridge 4 includes a first wall 44, a second wall 42, a third wall 43, a fourth wall 45, a fifth wall 46, and a sixth wall 47. These walls 42 to 47 define the internal space of the first cartridge 4. Note that in the following description, the reference signs 42 to 47 will be used to refer to particularly the outer surfaces among the walls constituting the outer shell of the first cartridge 4. Accordingly, the first to sixth walls 42 to 47 can also be called first to sixth planes 42 to 47. The second to sixth planes 42, 43, 45, 46, and 47 are generally flat. The first plane 44 is formed by multiple generally flat planes. The term "generally flat" includes the case where the entirety of the plane is completely flat, and also the case where part of the plane has unevenness. In other words, the term "generally flat" includes the case where even if part of the plane is somewhat uneven, the plane can be understood to be a plane or wall constituting the outer shell of the first cartridge 4. Also, the terms "plane" and "wall" also include the case of being constituted by a combination of elements located in different planes. The outer shapes of the second to sixth planes 42, 43, 45, 46, and 47 are all substantially rectangular.

Here, the first plane 44 will also be referred to as the bottom plane 44, the second plane 42 will also be referred to as the front plane 42, the third plane 43 will also be referred to as the rear plane 43, the fourth plane 45 will also be referred to as the upper plane 45, the fifth plane 46 will also be referred to as the right side plane 46, and the sixth plane 47 will also be referred to as the left side plane 47, As shown in FIG. 17, the first plane 44 and the fourth plane 45 oppose each other in the Z axis direction. The second plane 42 and the third plane 43 oppose each other in the Y axis direction. As shown in FIG. 13, the fifth plane 46 and the sixth plane 47 oppose each other in the X axis direction. The first plane 44 is located on the −Z axis direction side of the internal space of the outer shell 41. The fourth plane 45 is located on the +Z axis direction side of the internal space of the outer shell 41. The second plane 42 is located on the +Y axis direction side of the internal space of the outer shell 41. The third plane 43 is located on the −Y axis direction side of the internal space of the outer shell 41. The fifth plane 46 is located on the +X axis direction side of the internal space of the outer shell 41. The sixth plane 47 is located on the −X axis direction side of the internal space of the outer shell 41.

As shown in FIGS. 9 and 16, the first plane 44 has a first section plane 441, a second section plane 442, and a third section plane 443. The first to third section planes 441 to 443 are all generally flat. Also, the outer shapes of the first to third section planes 441 to 443 are all substantially rectangular. The first section plane 441 and the third section plane 443 are horizontal planes in the mounted state. The third section plane 443 is located on the −Z axis direction side (vertically downward direction side) of the first section plane 441. The second section plane 442 is a vertical plane. The second section plane 442 is connected to the first section plane 441 and the third section plane, thus forming a level change. Accordingly, as shown in FIG. 17, the internal space of the first cartridge 4 includes a first portion 480L and a second portion 480H whose height is greater than that of the first portion 480L. In other words, the liquid storage portion 480 includes the first portion 480L and the second portion 480H having different heights.

As shown in FIGS. 9 and 14, the liquid supply portion 447 is formed in the first section plane 441 of the first plane 44. As shown in FIG. 14, the liquid supply portion 447 is a circular opening. The liquid supply portion 447 has a center 4CX. The liquid supply portion 447 puts the liquid storage portion 480 and the outside in communication with each other. The liquid introduction portion 703 of the printer 10 is connected to (inserted into) the liquid supply portion 447. When the liquid introduction portion 703 is connected to the liquid supply portion 447, ink stored in the liquid storage portion 480 can be introduced to the liquid introduction portion 703.

As shown in FIG. 16, a mounting direction SD when the first cartridge 4 is mounted to the cartridge mounting portion 7 is the −Z axis direction (the vertically downward direction in this embodiment). Here, it is not always the case that the state of the first cartridge 4 is constant when the first cartridge 4 is actually inserted into the cartridge mounting portion 7. There are cases where the first cartridge 4 is in a state of being tilted relative to the Z axis at an intermediate stage in an attempt to mount the first cartridge 4 to the cartridge mounting portion 7. However, the liquid supply portion 447 (FIG. 14) receives insertion of the liquid introduction portion 703, which has the central axis 7CX that conforms to the Z axis direction, immediately before mounting and in the mounted state. Accordingly, the first cartridge 4 can be mounted to the cartridge mounting portion 7 in the −Z axis direction.

As shown in FIG. 9, the first section plane 441 of the first plane 44 further includes an engaged portion 445 and a contact portion 449. The engaged portion 445 is a projection. The engaged portion 445 is arranged so as to be in the vicinity of the portion of the first plane 44 where the sixth plane 47 and the third plane 43 intersect. The engaged portion 445 is a member for positioning the liquid supply portion 447 relative to the cartridge mounting portion 7. The outer periphery of the engaged portion 445 is formed so as to be somewhat smaller than the inner periphery of the bottom wall engaging portion 704*a* (FIG. 6) of the cartridge mounting portion 7. In the mounted state, the engaged portion 445 is inserted into the bottom wall engaging portion 704*a* (FIG. 6) of the cartridge mounting portion 7. This enables the liquid supply portion 447 to be positioned relative to the liquid introduction portion 703*a* in the X axis direction and the Y axis direction.

As shown in FIG. 9, the contact portion 449 is a projection. The contact portion 449 is a member for preventing the liquid introduction portion 703 from being inserted too far into the liquid supply portion 447 in the mounted state of the first cartridge 4. The contact portion 449 is arranged at a position in the vicinity of the liquid supply portion 447. In the mounting process, the contact portion 449 comes into contact with the contact portion 707*a* (FIG. 6) of the cartridge mounting portion 7. This therefore prevents the first cartridge 4 from being pressed in the vertically downward direction beyond the state in which the two members 449 and 707*a* are in contact with each other. The following effect is achieved if at least one of the contact portions 707 and 449 is a projection. Specifically, the first cartridge 4 can be prevented from being pressed too far by ensuring the precision of the projection rather than the precision of the entire portion on which the projection is formed.

As shown in FIGS. 13 and 16, the third plane 43 includes engaged portions 432 and a protrusion portion 436. The engaged portions 432 are projections. Two engaged portions 432 are provided side-by-side in the X axis direction. The reference sign "432" will be used when referring to the two engaged portions 432 collectively or mentioning either one of them, and reference signs "432*a*" and "432*b*" will be used when distinguishing between the two engaged portions 432. In the mounted state, the engaged portion 432*a* engages with the engaging portion 733*a* (FIG. 4A), and the engaged portion 432*b* engages with the engaging portion 733*b* (FIG. 4A). The engagement of the members 432 and 733 restricts the third plane 43 side of the first cartridge 4 from moving in the vertically upward direction in the mounted state. The protrusion portion 436 is provided on the upper side portion of the third plane 43 on the fourth plane 45 side. In the mounted state, the protrusion portion 436 is located on the vertically upward direction side of the second device-side side wall 73 (FIGS. 3A and 4).

As shown in FIG. 9, the second plane 42 includes the lever 421 and a contact mechanism 30 that includes the terminals 930. As shown in FIG. 12, the lever 421 and the contact mechanism 30 are arranged side-by-side in the X axis direction.

The lever 421 is used when removing the first cartridge 4 from the cartridge mounting portion 7. Also, the lever 421 engages with the mounting/removal portion 722 (FIG. 4A) of the cartridge mounting portion 7 so as to restrict the +Y axis direction side of the first cartridge 4 from moving in the +Z axis direction (vertically upward direction). As shown in FIG. 9, the lever 421 includes a support 427, a contact portion 424, and an operation portion 426. The support 427 is located farthest on the −Z axis direction side, and the support 427, the contact portion 424, and the operation portion 426 are arranged in the +Z axis direction in the stated order. The lever 421 can undergo elastic deformation so as to pivot about the support 427. The contact portion 424 engages with the mounting/removal portion 722 in the mounted state. The operation portion 426 is a portion to which the user applies external force. When the user applies external force to the operation portion 426 in the −Y axis direction (direction approaching the second plane 42), the engagement of the mounting/removal portion 722 and the contact portion 424 is canceled.

As shown in FIGS. 9 and 12, the contact mechanism 30 includes a first engaged portion 36, a second engaged portion 37, an arrangement portion 39, and the circuit substrate 90. The arrangement portion 39 and the circuit substrate 90 are each arranged between the first engaged portion 36 and the second engaged portion 37.

As shown in FIG. 10A, the arrangement portion 39 is substantially shaped as a triangular column. An outer plane 39*a* of the arrangement portion 39 is inclined relative to the first section plane 441 in which the liquid supply portion 447 is formed. Specifically, the outer plane 39*a* is inclined so as to move away from the second plane 42 as it extends from the first plane 44 to the fourth plane 45. In other words, the outer plane 39*a* is inclined so as to face a direction that includes a vertically downward direction (−Z axis direction) component and a +Y axis direction component. That is to say, the normal line of the plane that conforms to the outer plane 39*a* is inclined so as to face a direction that includes a −Z axis direction component and a +Y axis direction component.

As shown in FIG. 16, a first side plane 33 of the arrangement portion 39 located on the +X axis direction side is exposed from the first engaged portion 36. Also, as shown in FIG. 10A, a second side plane 31 of the arrangement portion 39 located on the −X axis direction side is exposed from the second engaged portion 37.

As shown in FIG. 9, the circuit substrate 90 is provided on the outer plane 39*a* of the arrangement portion 39. As shown in FIG. 12, a terminal group 900 is arranged on an outer plane 90*a* of the circuit substrate 90. The outer plane 90*a* is a flat plane. As shown in FIG. 12, the terminal group 900 is made up of nine terminals 931 to 939. A storage device 99 (FIG. 18B) is arranged on the reverse side of the circuit substrate 90. The storage device 99 stores information regarding the ink in the first cartridge 4 (e.g., the remaining amount of ink and the stored ink color), for example. When the terminal group 900 comes into contact with the contact member group 82 (FIG. 7A) of the printer, data signals are exchanged between the storage device 99 of the circuit substrate 90 and the control unit 60 of the printer 10. Here, the reference sign "930" will be used when referring to the nine terminals 931 to 939 collectively, or when mentioning any one of them.

Here, the terminal 931 will also be referred to as the "first terminal 931", the terminal 932 will also be referred to as the "second terminal 932", the terminal 933 will also be referred to as the "third terminal 933", the terminal 934 will also be referred to as the "fourth terminal 934", the terminal 935 will also be referred to as the "fifth terminal 935", the terminal 936 will also be referred to as the "sixth terminal 936", the terminal 937 will also be referred to as the "seventh terminal 937", the terminal 938 will also be referred to as the "eighth terminal 938", and the terminal 939 will also be referred to as the "ninth terminal 939".

As shown in FIG. 12, the terminals 930 are located between the first and second engaged portions 36 and 37. Specifically, in terms of the X axis direction (width direction), the terminals 930 are arranged at positions sandwiched by the first and second engaged portions 36 and 37. The nine terminals 931 to 939 are each substantially rectangular in shape. The nine terminals 931 to 939 are arranged so as to form two rows 9R1 and 9R2. The two rows 9R1 and 9R2 are located at different heights. The two rows 9R1 and 9R2 each extend along the width direction (X axis direction) of the first cartridge 4. Out of the two rows 9R1 and 9R2, the row on the −Z axis direction side will also be referred to as the first terminal row 9R1, and the row on the +Z axis direction side will also be referred to as the second terminal row 9R2. The first terminal row 9R1 is made up of the five terminals 935 to 939. The second terminal row 9R2 is made up of the four terminals 931 to 934. The central portion of each of the terminals 931 to 939 has a contact portion cp for coming into contact with the contact members 800. The first and second terminal rows 9R1 and 9R2 can also be thought to be rows formed by multiple contact portions cp.

The contact portions cp of the terminals 935 to 939 that form the first terminal row 9R1 are arranged at different positions from the contact portions cp of the terminals 931 to 934 that form the second terminal row 9R2. Specifically, the contact portions cp are arranged in a so-called zigzag arrangement. The contact portions cp are formed on end planes of the terminals 930. These end planes are flat planes.

As shown in FIG. 16, a flat plane 95, which includes end planes 930*a* of the terminals 930 on which the contact portions cp are formed, is inclined relative to the first section plane 441 in which the liquid supply portion 447 is formed. The flat plane 95 can also be said to be a flat planes that is defined by the contact portions cp. The flat plane 95 is inclined likewise to the outer plane 39*a* of the arrangement portion 39. In other words, the flat plane 95 is inclined so as to face a direction that includes a vertically downward direction (−Z axis direction) component and a +Y axis direction component. For example, the flat plane 95 is inclined at a predetermined angle in a range of 25 degrees to 45 degrees relative to the horizontal plane (first section plane 441).

As shown in FIGS. 10A and 16, the first engaged portion 36 is hook-shaped. Specifically, as shown in FIG. 10B, the first engaged portion 36 has a recessed portion 34 that is open on the vertically downward direction side (first plane 44 side). The recessed portion 34 is shaped as a cutout in an intermediate portion of the end portion of the first engaged portion 36 on the vertically downward direction. The first engaged portion 36 is configured such that when it is engaged with the first engaging portion 84 (FIG. 7A), it restricts the terminals 930 from moving away from the contact members 800 in resistance to the elastic force Ft of the contact members 800.

As shown in FIG. 10B, the recessed portion 34 includes a first contact portion 341, a first opposing portion 342, and a first side plane portion 343. The recessed portion 34 is defined by these elements 341, 342, and 343. In the mounted state of the first cartridge 4, the first contact portion 341 engages with the first contact portion 84*fa* of the first engaging portion 84. The first opposing portion 342 is the bottom portion of the recessed portion. The first opposing portion 342 opposes the first end portion 84*fb* (FIG. 7A) of the first engaging portion 84 in the mounting process. The first engaged portion 36 will also be referred to as the "first hook 36". The recessed portion 34 will also be referred to as the "first recessed portion 34".

As shown in FIG. 10A, the second engaged portion 37 is hook-shaped. Specifically, as shown in FIG. 10C, the second engaged portion 37 has a recessed portion 32 that is open on the vertically downward direction side (first plane 44 side). The recessed portion 32 is shaped as a cutout in an intermediate portion of the end portion of the second engaged portion 37 on the vertically downward direction. The second engaged portion 37 is configured such that when it is engaged with the second engaging portion 85 (FIG. 7A), it restricts the terminals 930 from moving away from the contact members 800 in resistance to the elastic force Ft of the contact members 800.

The recessed portion 32 includes a second contact portion 321, a second opposing portion 322, and a second side plane portion 323. The recessed portion 32 is defined by these elements 321, 322, and 323. In the mounted state of the first cartridge 4, the second contact portion 321 engages with the second contact portion 85*fa* of the second engaging portion 85 (FIG. 7A). The second opposing portion 322 is the bottom portion of the recessed portion. The second opposing portion 322 opposes the second end portion 85*fb* (FIG. 7A) of the second engaging portion 85 in the mounting process. The second engaged portion 37 will also be referred to as the "second hook 37". The recessed portion 32 will also be referred to as the "second recessed portion 32".

As shown in FIG. 9, the first and second recessed portions 34 and 32 have the same shape. Also, the first and second recessed portions are formed at the same height.

As shown in FIG. 11, the fourth plane 45 includes an air release flow channel 450. The air release flow channel 450 puts the outside and the liquid storage portion 480 of the first cartridge 4 in communication with each other. The air release flow channel 450 introduces air into the liquid storage portion 480 as the liquid in the liquid storage portion 480 is consumed. As shown in FIGS. 11 and 15, the air release flow channel 450 is formed by a groove 455 formed in the fourth plane 45 and a sheet member 456 affixed to the fourth plane 45. The sheet member 456 is formed from a member that is not permeable to liquids. A first end 451 of the air release flow channel 450 is in communication with the outside, and a second end 452 is in communication with the liquid storage portion 480. The air release flow channel 450 is a tortuous channel. This enables extending the length of the flow channel in a limited range. Accordingly, it is possible to prevent ink inside the liquid storage portion 480 from evaporating to the outside through the air release flow channel 450.

As shown in FIG. 16, the fifth plane 46 includes a sunken portion 461. The sunken portion 461 is provided at a position in the fifth plane 46 that corresponds to the partition wall 741 (FIG. 4A) of the cartridge mounting portion 7. The sunken portion 461 is configured so as to be able to receive insertion of the partition wall 741. This allows the slot 70 of the cartridge mounting portion 7 to be used efficiently when mounting the first cartridge 4, thus making it possible to reduce the size of the cartridge mounting portion 7.

A-5: Positional Relationship Between Elements (Members) of First Cartridge 4

Figure 18A:
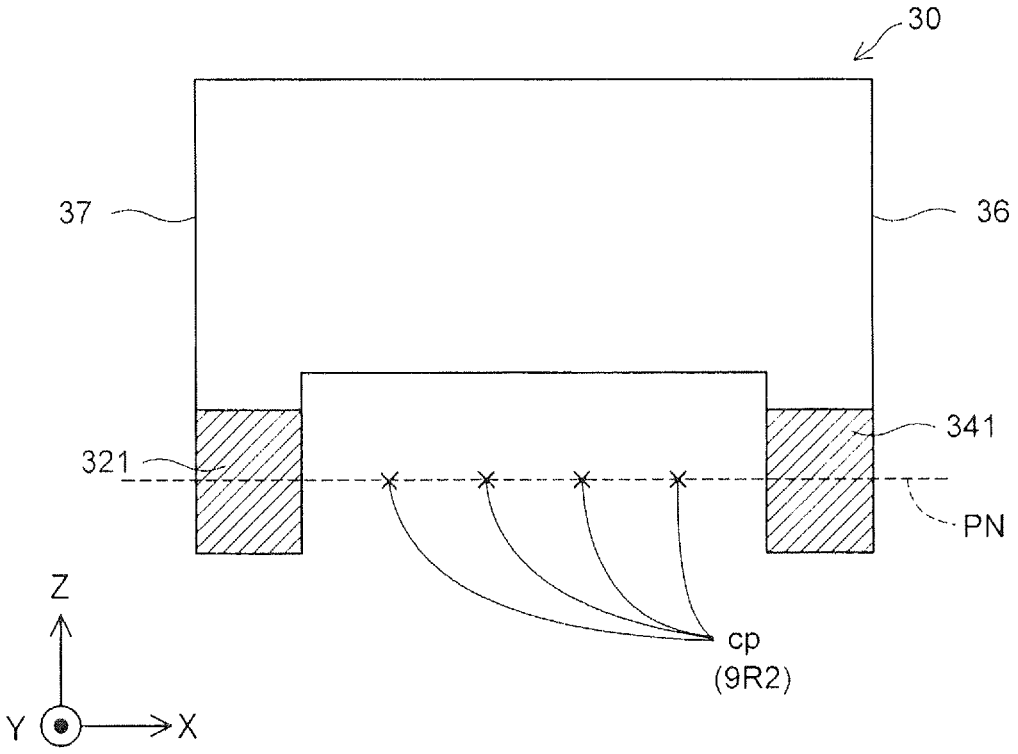
FIG. 18A is a diagram schematically showing the positional relationship between contact portions and first and second engaged portions.

The following describes the positional relationship between elements that the first cartridge 4 includes with reference to FIGS. 9 to 18A. FIG. 18A is a diagram schematically showing the positional relationship between contact portions cp and the first and second engaged portions 36 and 37.

As shown in FIG. 12, the first and second engaged portions 36 and 37 are arranged with a gap therebetween in the width direction of the first cartridge 4. In terms of the width direction (X axis direction) of the first cartridge 4, a plane CT is a plane that passes through the central point between the first and second engaged portions 36 and 37 and is parallel to the Y axis direction and the Z axis direction. The contact portion cp of the seventh terminal 937 passes through the plane CT. The contact portion cp of the seventh terminal 937 is located at the center among the contact portions cp forming the first terminal row 9R1. Also, the contact portion cp of the seventh terminal 937 is located at the center of the circuit substrate 90 in the width direction thereof. As shown in FIG. 12, the terminals 931 to 939 are located between the first and second engaged portions 36 and 37 in terms of the width direction of the first cartridge 4. Due to the contact portion cp of the seventh terminal 937 passing through the plane CT, it is possible to prevent positional shift of the terminals 931 to 939 relative to the contact member 800.

As shown in FIG. 18A, the portion 341 (first contact portion 341) of the first engaged portion 36 that comes into contact with the first engaging portion 84 (FIG. 7A) and the portions cp (contact portions cp) of the terminals 931 to 934, which form the second terminal row 9R2, that come into contact with the contact members 801 to 804 (FIG. 7A) are arranged on the same plane PN. Also, the portion 321 (second contact portion 321) of the second engaged portion 37 that comes into contact with the second engaging portion 85 (FIG. 7A) and the portions cp (contact portions cp) of the terminals 931 to 934, which form the second terminal row 9R2, that come into contact with the contact members 801 to 804 (FIG. 7A) are arranged on the same plane PN. In other words, when the first cartridge 4 is viewed from a predetermined position, the portion 321, the portion 341, and the portions cp are arranged on the same straight line. Accordingly, the plane PN can also be called a straight line PN as shown in FIG. 18A.

This predetermined position is at position at the height at which the plane PN is located in this embodiment. Note that the portions 341 and 321 that come into contact with the contact members 801 to 804 are indicated by hatching in order to facilitate understanding.

As shown in FIG. 14, distances from the center 4CX of the liquid supply portion 447 to the portions cp where the contact members 800 (FIG. 7A) and the terminals 930 come into contact with each other are distances La1 and La2. The distance La1 is the distance from the center 4CX to the contact portions cp that form the first terminal row 9R1 (FIG. 12). The distance La2 is the distance from the center 4CX to the contact portions cp that form the second terminal row 9R2 (FIG. 12). Also, the distance from the center 4CX to the portion 341 where the first engaging portion 84 (FIG. 7A) and the first engaged portion 36 come into contact with each other is a distance Lb. The distance from the center 4CX to the portion 321 where the second engaging portion 85 (FIG. 7A) and the second engaged portion 37 come into contact with each other is also the distance Lb. The distances La1 to Lb are distances in terms of the Y axis direction. The following relationships hold in the first cartridge 4. Specifically, the distance Lb is greater than both of the distances La1 and La1.

As shown in FIG. 14, the engaged portion 445 and the first engaged portion 36 have a first positional relationship. The first positional relationship is a relationship in which, when viewing the first plane 44 from the −Z axis direction side, the engaged portion 445 is located in the vicinity of one corner portion that forms an opposing corner of the first plane 44, and the first engaged portion 36 is located in the vicinity of the other corner portion. In other words, the first positional relationship is a relationship in which the engaged portion 445 and the first engaged portion 36 are arranged at positions that sandwich an XZ plane C3 that passes through the center with respect to the length Bb of the first cartridge 4, and sandwich a YZ plane C2 that passes through the center with respect to the width Ba of the first cartridge 4. Also, the first positional relationship is a relationship in which, when viewing the first plane 44 from the −Z axis direction side, the engaged portion 445 and the first engaged portion 36 are located on opposite sides with the center 4CX therebetween. Accordingly, the engaged portion 445 and the first engaged portion 36 (specifically, the first contact portion 341) can be arranged at separated positions. The XZ plane C3 is a plane that is parallel to the X axis direction and the Z axis direction. The YZ plane C2 is a plane that is parallel to the Y axis direction and the Z axis direction.

Also, the engaged portion 445 and the second engaged portion 37 have a second positional relationship. The second positional relationship is a relationship in which the engaged portion 445 and the second engaged portion 37 are arranged at positions that sandwich the XZ plane C3 and also sandwich a predetermined YZ plane C2a. Also, the second positional relationship is a relationship in which, when viewing the first plane 44 from the −Z axis direction side, the engaged portion 445 and the second engaged portion 37 are located on opposite sides with the center 4CX therebetween. Accordingly, the engaged portion 445 and the second engaged portion 37 can be arranged at separated positions. The YZ plane C2a is a plane that is parallel to the Y axis direction and the Z axis direction.

As shown in FIG. 16, the first engaged portion 36 (specifically, the recessed portion 34) is arranged at a position that passes through a plane 95. Specifically, the first engaged portion 36 (specifically, the recessed portion 34) is, relative to the terminals 930, located in an extending direction of the planes 930*a* (planes 930*a* that include the contact portions cp) of the terminals 930 that can come into contact with the contact members 800. Also, as shown in FIG. 17, the second engaged portion 37 (specifically, the recessed portion) is arranged at a position that passes through the plane 95. Specifically, the second engaged portion 37 (specifically, the recessed portion 32) is, relative to the terminals 930, located in an extending direction of the planes 930*a* (planes 930*a* that include the contact portions cp) of the terminals 930 that can come into contact with the contact members 800.

A-6: Internal Configuration of First Cartridge 4

Figure 18B:
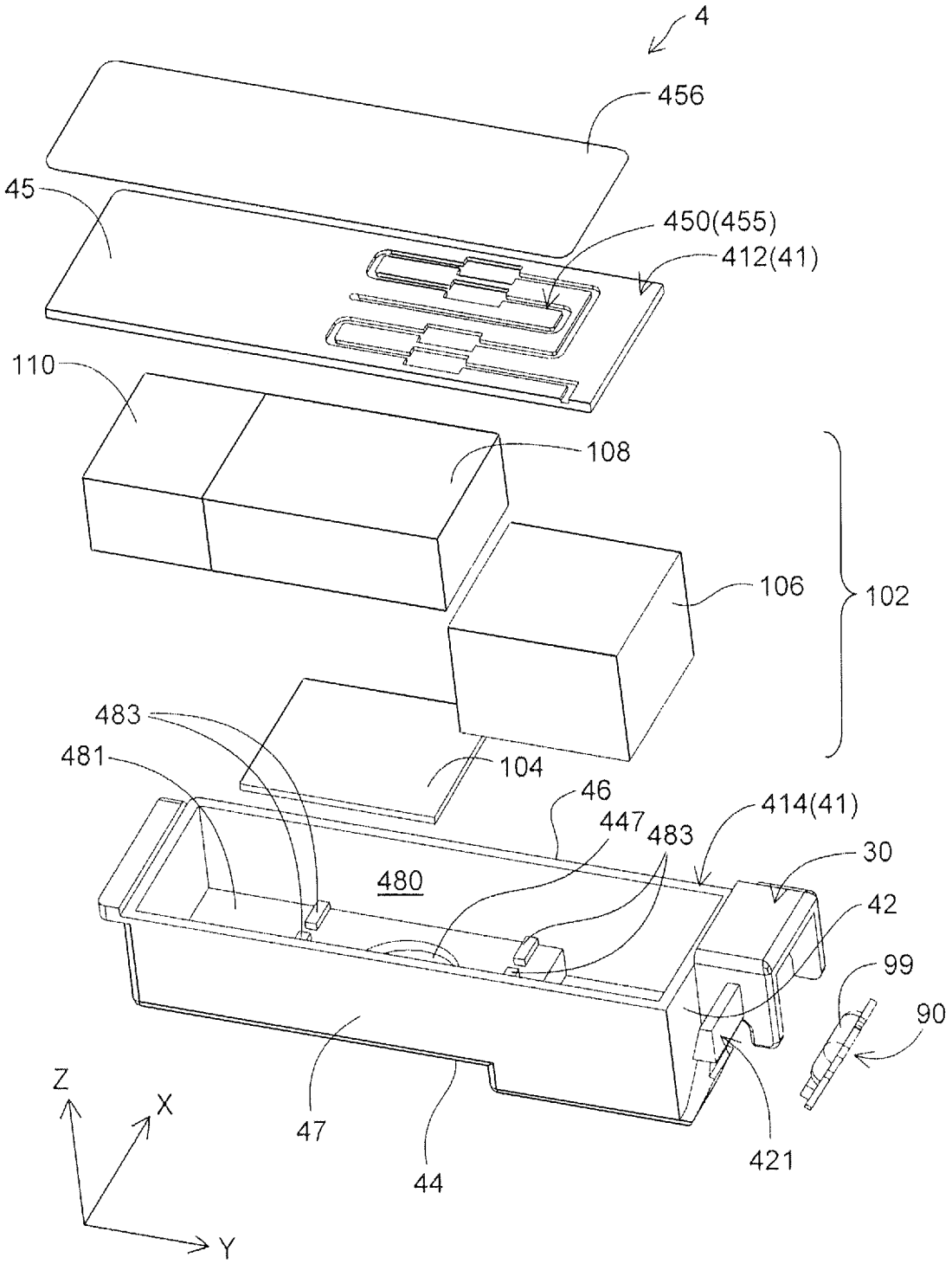
FIG. 18B is an exploded perspective view of the first cartridge.
Figure 18C:
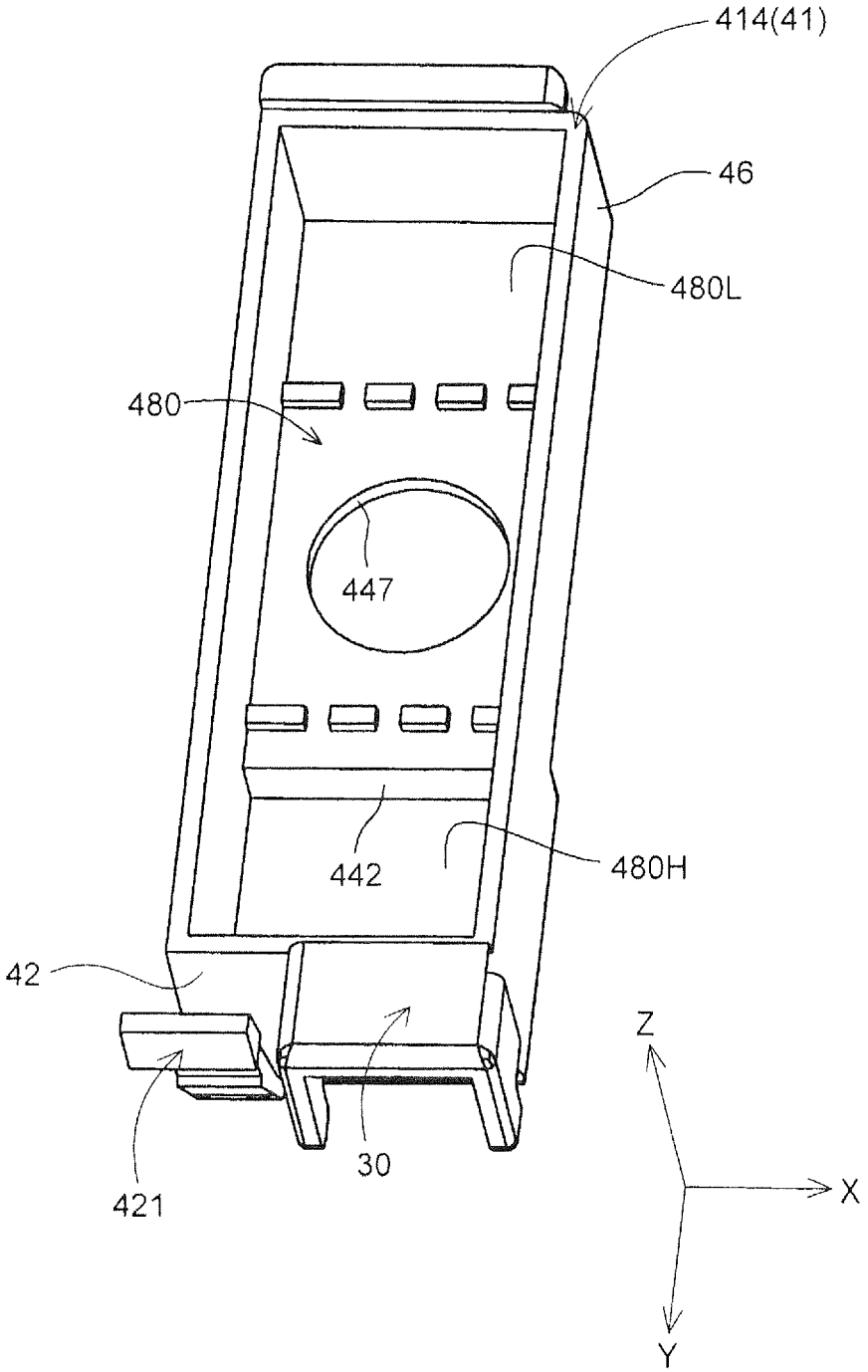
FIG. 18C is an external perspective view of a container body.
Figure 19:
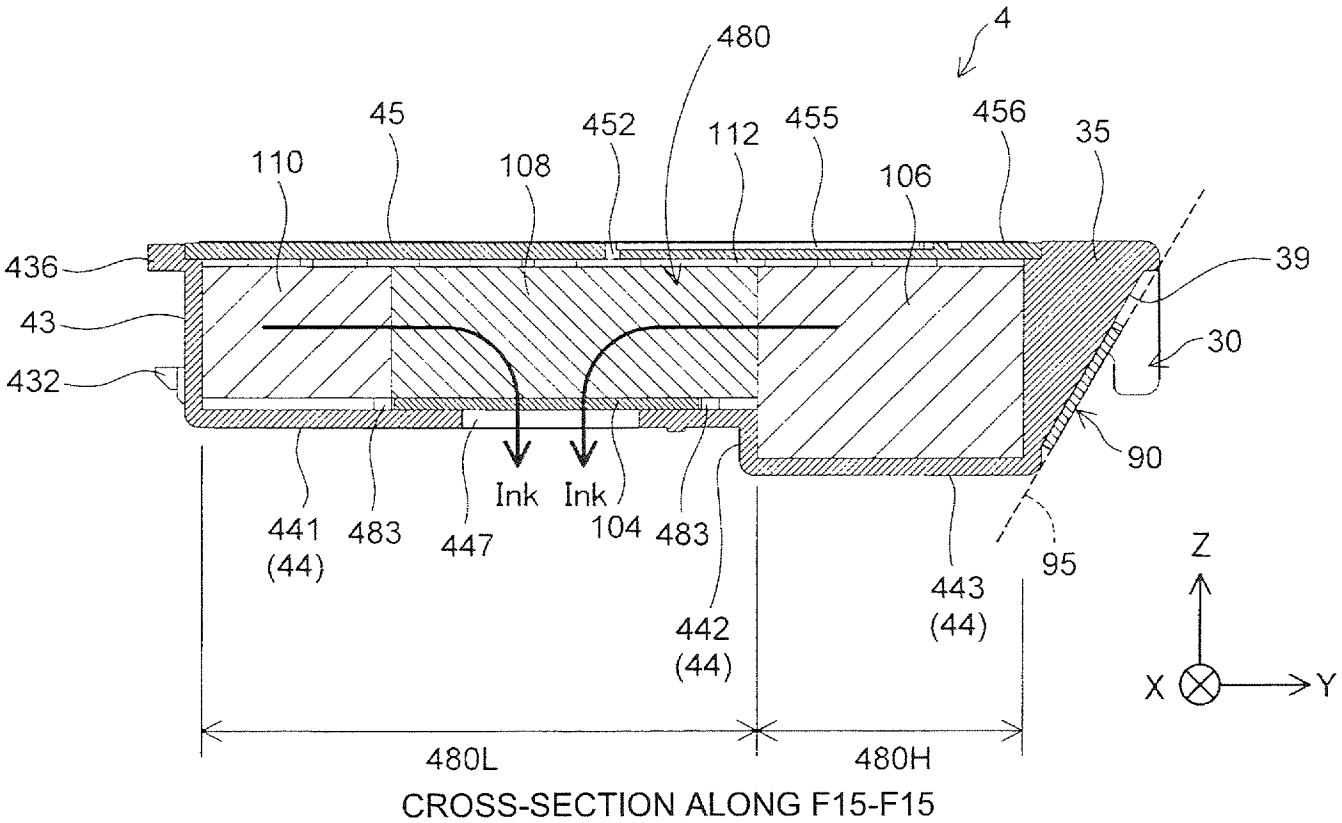
FIG. 19 is a cross-sectional view taken along F15-F15 in FIG. 15.

The following describes the internal configuration of the first cartridge 4 with reference to FIGS. 18B to 19. FIG. 18B is an exploded perspective view of the first cartridge 4. FIG. 18C is an external perspective view of a container body 414. FIG. 19 is a cross-sectional view taken along F15-F15 in FIG. 15.

As shown in FIG. 18B, the outer shell 41 of the first cartridge 4 includes the container body 414 and a cover member 412. The container body 414 is shaped as a recession. A holding member 102 is accommodated in the container body 414. The cover member 412 is precisely attached to the end plane of the container body 414 on the +Z axis direction side so as to block the opening formed on the +Z axis direction side of the container body 414. This defines the liquid storage portion 480 inside the container body 414.

As shown in FIG. 18B, the liquid storage portion 480 has the holding member 102 for holding ink. The holding member 102 has a first liquid holding member 104, a second liquid holding member 106, a third liquid holding member 108, and a fourth liquid holding member 110, Internal flow channels through which ink can be distributed are formed inside the first to fourth liquid holding members 106 to 110. Also, the first to fourth liquid holding members 104 to 110 can hold ink through capillary force. The first to fourth liquid holding members 104 to 110 are formed from a non-woven fabric material. The first to fourth liquid holding members 104 to 110 are formed from a synthetic resin. In this embodiment, the first to fourth liquid holding members 106 to 110 are formed from a composite material including polypropylene and polyethylene. Note that the first to fourth liquid holding members are not limited to being a non-woven material, and may be a porous member made of polyurethane or the like, as long as they are members that can distribute ink and hold ink through capillary force.

As shown in FIG. 19, the first liquid holding member 104 is in contact with the liquid supply portion 447, Also, the first liquid holding member 104 is arranged so as to cover the liquid supply portion 447, which is an opening. The first liquid holding member 104 is a member for coming into contact with the opening in the end plane of the liquid introduction portion 703 (FIG. 5) of the printer 10. Accordingly, ink held in the first liquid holding member 104 is introduced to the liquid introduction portion 703.

The third liquid holding member 108 is joined to the first liquid holding member 104 at a position higher than the first liquid holding member 104. The second liquid holding member 106 is accommodated in the second portion 480H of the liquid storage portion 480. The second liquid holding member 106 is joined to the third liquid holding member 108. The fourth liquid holding member 110 is accommodated in the first portion 480L of the liquid storage portion 480. The fourth liquid holding member 110 is joined to the third liquid holding member 108. The second and fourth liquid holding members 106 and 110 are arranged at positions where they sandwich the third liquid holding member 108 in the Y axis direction. As described above, due to the adjacent liquid holding members 104 to 110 being arranged so as to be joined to each other, the first to fourth liquid holding members 104 to 110 are configured so as to be able to distribute ink.

As shown in FIGS. 18B and 180, multiple projections 483 are formed on an inner plane of the liquid storage portion 480. The projections 483 are formed on the plane of the liquid storage portion 480 in which the liquid supply portion 447 is formed, and the projections 483 are arranged so as to sandwich the liquid supply portion 447 in the Y axis direction. The projections 483 restrict movement of the first liquid holding member 104 so as to prevent positional shift of the first liquid holding member 104 relative to the liquid supply portion 447.

The first to fourth liquid holding members 104 to 110 each have different liquid holding characteristics. The density of the first liquid holding member 104 is higher than the density of the third liquid holding member 108. The density of the third liquid holding member 108 is higher than the density of the second liquid holding member 106. The density of the third liquid holding member 108 is higher than the density of the fourth liquid holding member 110. The density of the second liquid holding member 106 is substantially the same as the density of the fourth liquid holding member.

According to the above density magnitude relationship, the first to fourth liquid holding members 104 to 110 have the following magnitude relationship in terms of capillary force. Specifically, the capillary force of the first liquid holding member 104 is higher than the capillary force of the third liquid holding member 108. The capillary force of the third liquid holding member 108 is higher than the capillary force of the second liquid holding member 106. Also, the capillary force of the third liquid holding member 108 is higher than the capillary force of the fourth liquid holding member 110. The capillary force of the second liquid holding member 106 is substantially equal to the capillary force of the fourth liquid holding member 110.

Due to the first to fourth liquid holding members 104 to 110 having the above magnitude relationship in terms of capillary force, ink in the liquid storage portion 480 is distributed in the sequence described below. Specifically, ink flows from a member having lower capillary force to a member having higher capillary force. As shown in FIG. 19, when ink in the first liquid holding member 104 is consumed, ink in the third liquid holding member 108 moves to the first liquid holding member 104. The drive force for the movement of ink from the third liquid holding member 108 to the first liquid holding member 104 is mainly the capillary force of the first liquid holding member 104.

When ink in the third liquid holding member 108 is consumed due to ink in the third liquid holding member 108 moving to the first liquid holding member 104, ink in the second and fourth liquid holding members 106 and 110 moves to the third liquid holding member 108. The drive force for the movement of ink from the second and fourth liquid holding members 106 and 110 to the third liquid holding member 108 is mainly the capillary force of the third liquid holding member 108.

As described above, multiple types of liquid holding members 104 to 110 having different characteristics are accommodated in the liquid storage portion 480, and the higher the capillary force of a liquid holding member is, the closer to the liquid supply portion 447 it is arranged, thus making it possible for ink stored in the liquid storage portion 480 to be consumed efficiently. In other words, the amount of ink remaining inside the liquid storage portion 480 can be reduced.

Note that the density magnitude relationship between the first to fourth liquid holding members 104 to 110 is not limited to the relationship described in the this embodiment, as long the capillary force of the first to fourth liquid holding members 104 to 110 decreases the farther the liquid holding member is separated from the liquid supply portion 447. For example, even in the case where the first to fourth liquid holding members 104 to 110 have the same density, a holding member 102 having the above-described capillary force magnitude relationship can be formed by performing hydrophobic treatment and hydrophilic treatment on the first to fourth liquid holding members 104 to 110.

A-7: Description of Exterior of Second Cartridge 5

Figure 20:
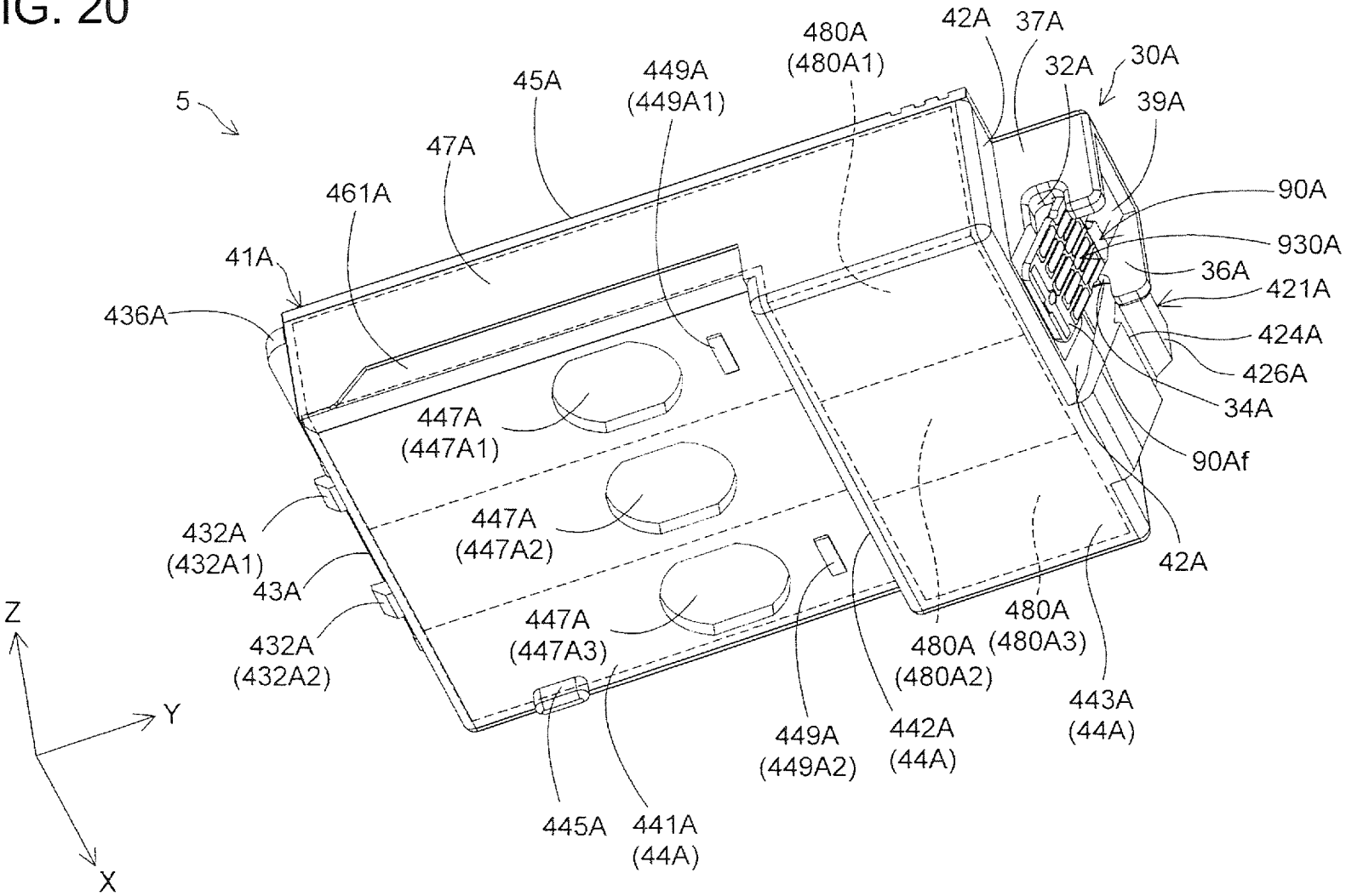
FIG. 20 is an external perspective view of a second cartridge.
Figure 21:
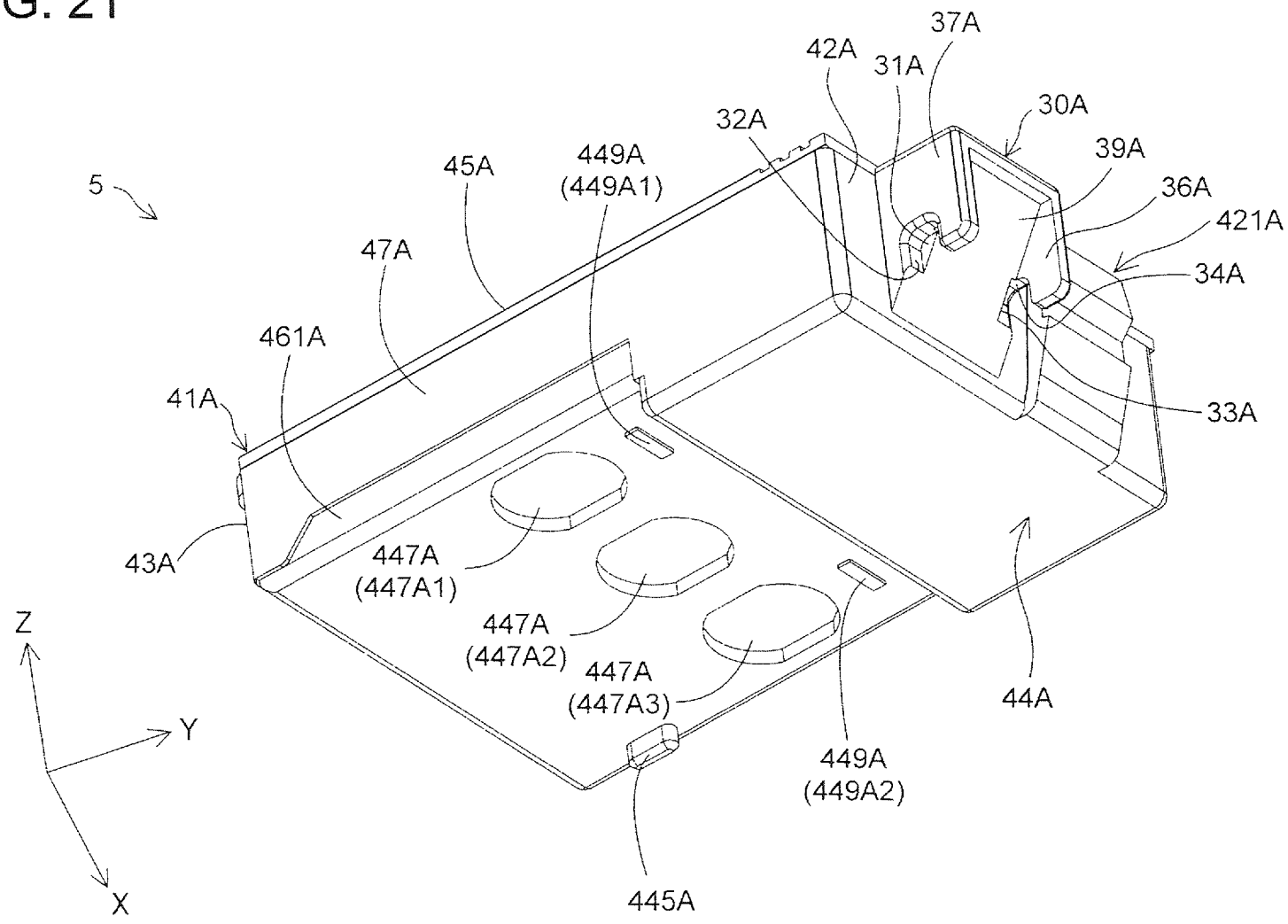
FIG. 21 is an external perspective view of the second cartridge.
Figure 22:
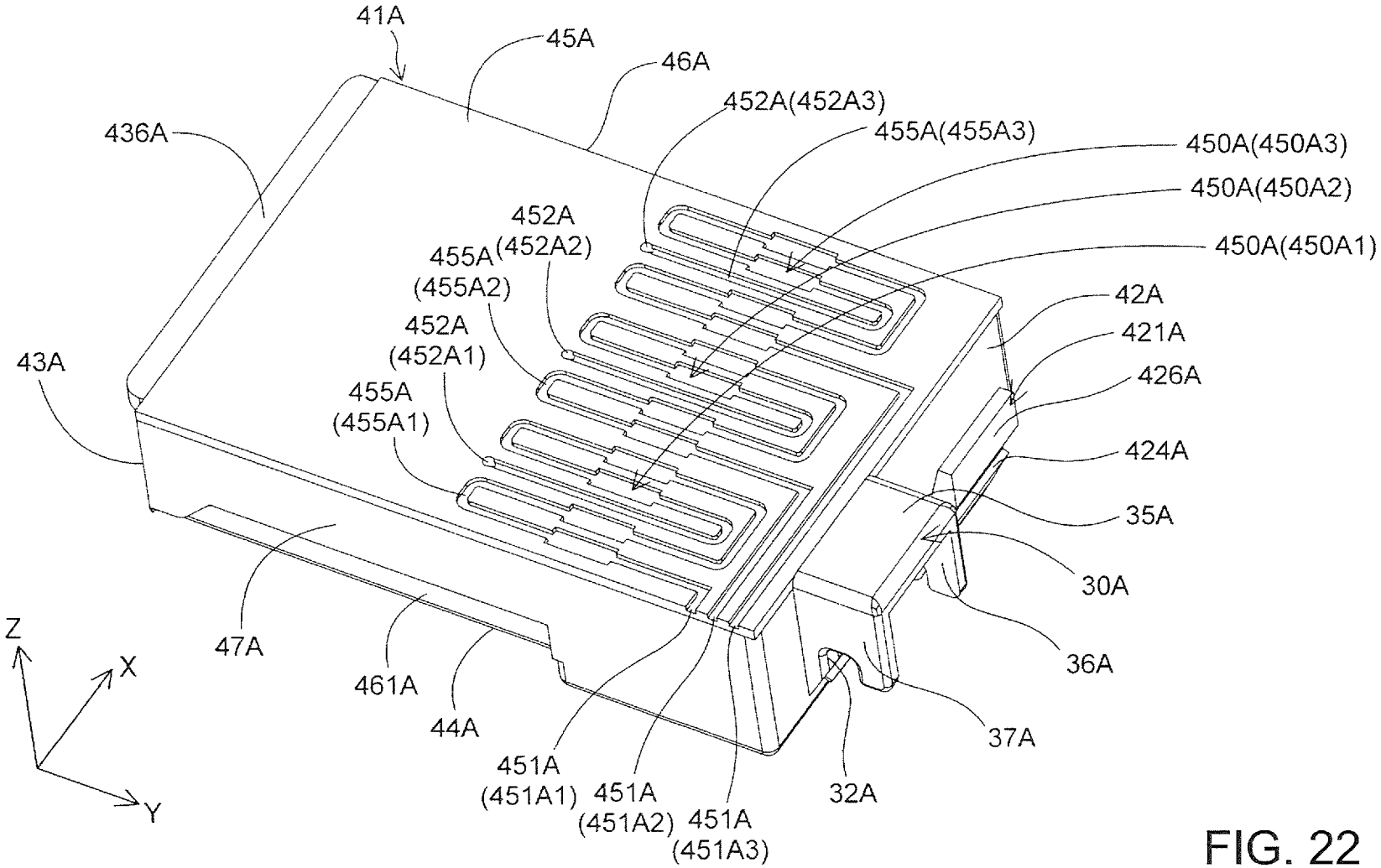
FIG. 22 is an external perspective view of the second cartridge.
Figure 23:
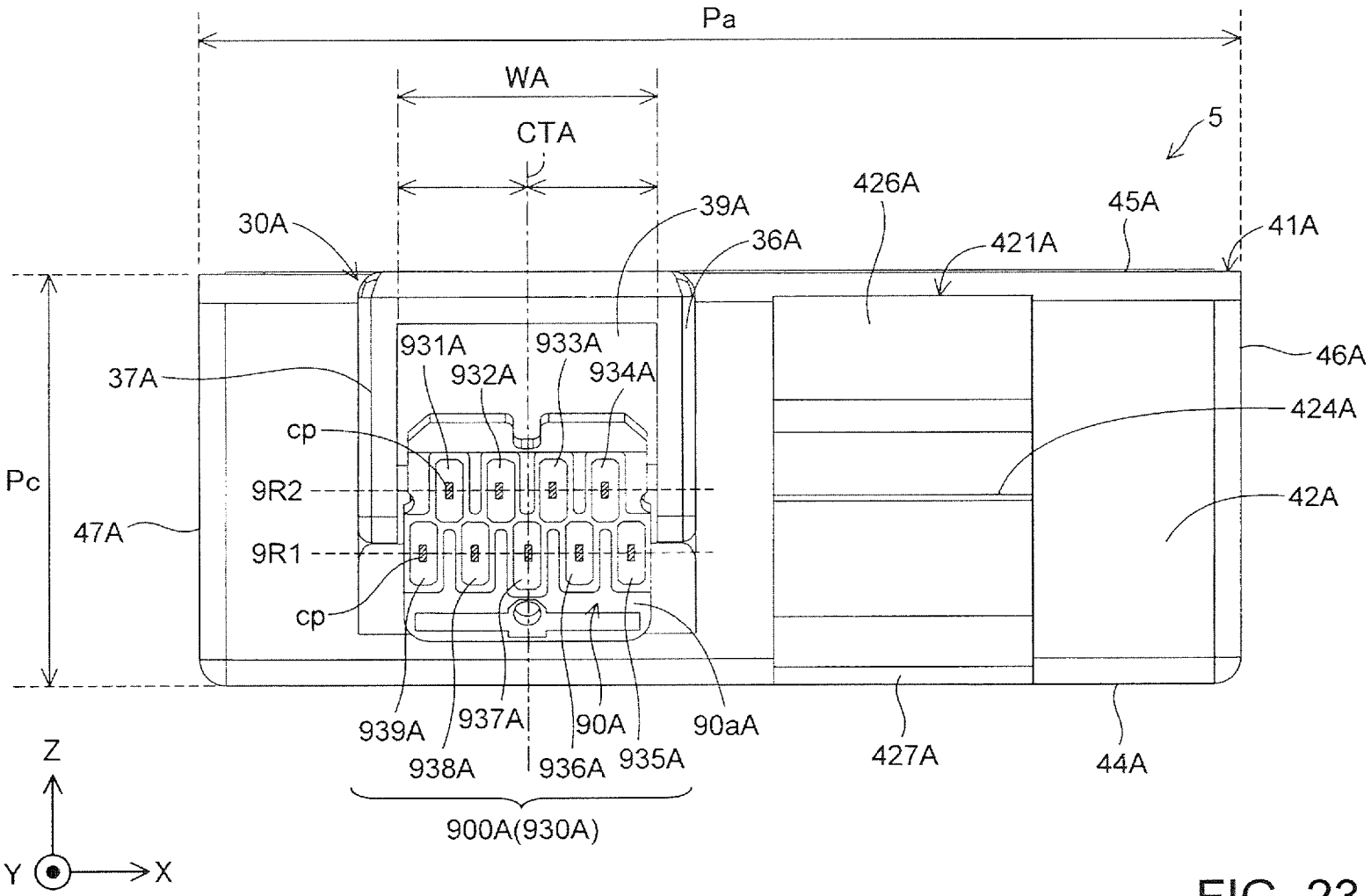
FIG. 23 is a front view of the second cartridge.
Figure 24:
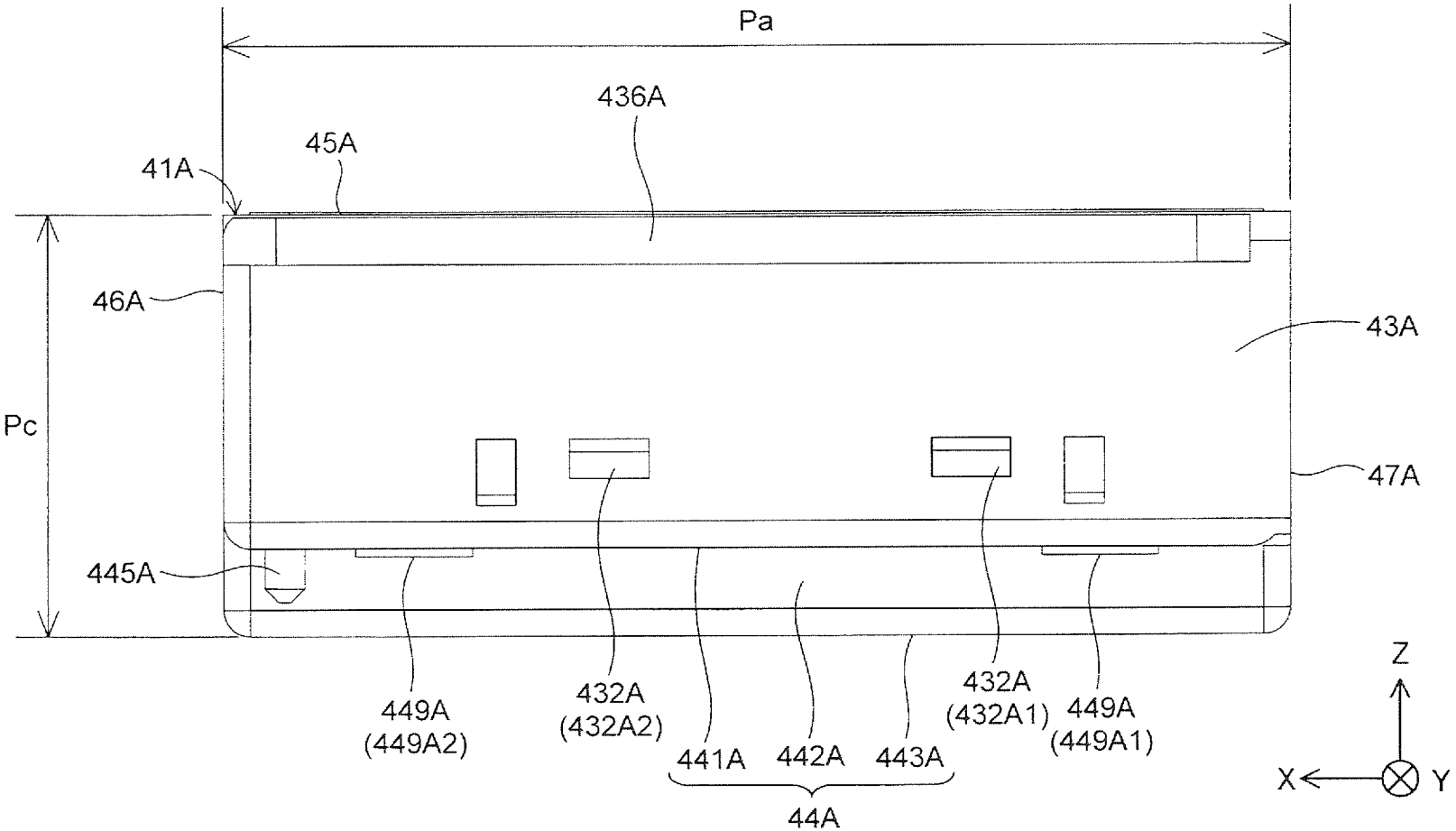
FIG. 24 is a rear view of the second cartridge.
Figure 25:
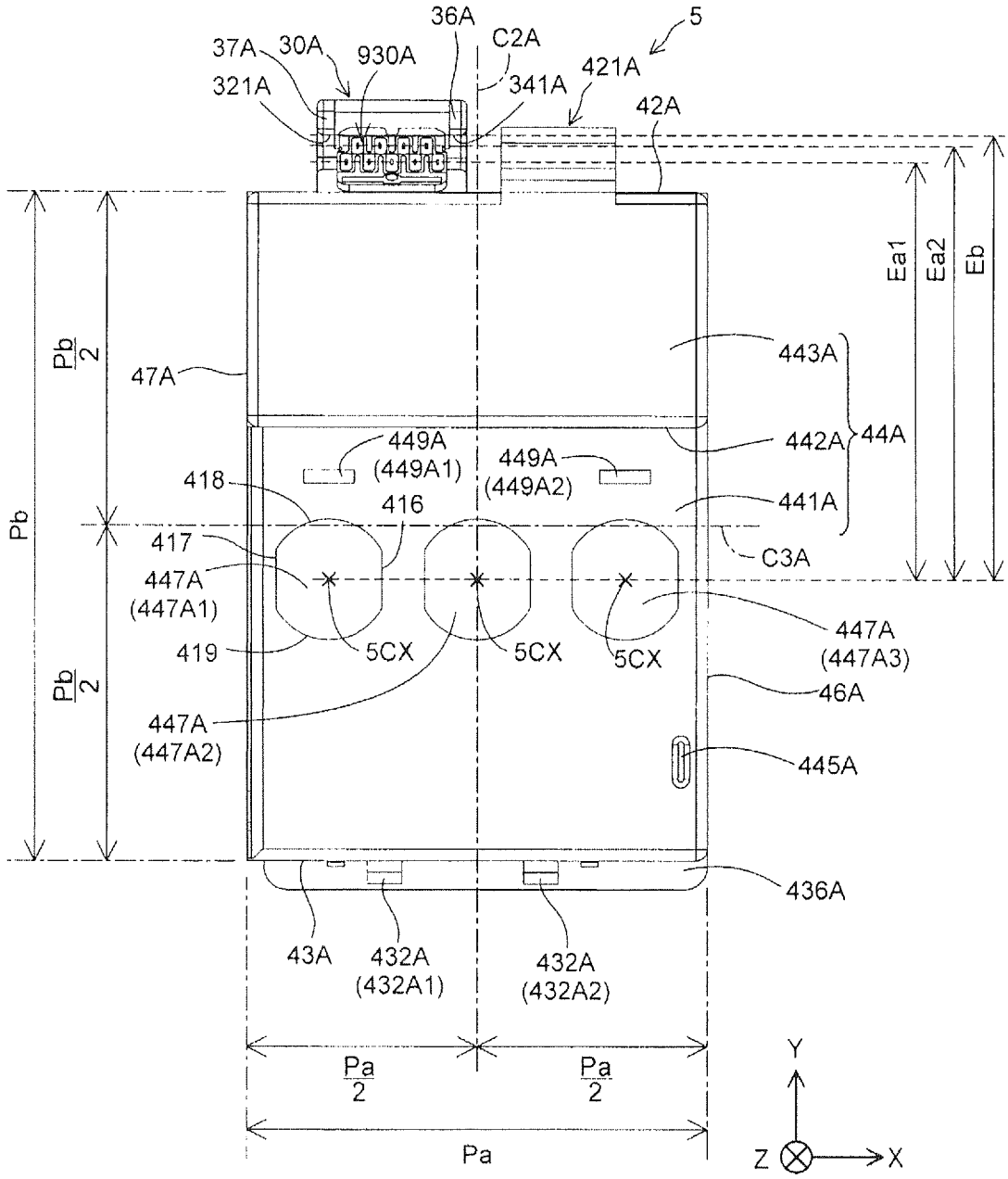
FIG. 25 is a bottom view of the second cartridge.
Figure 26:
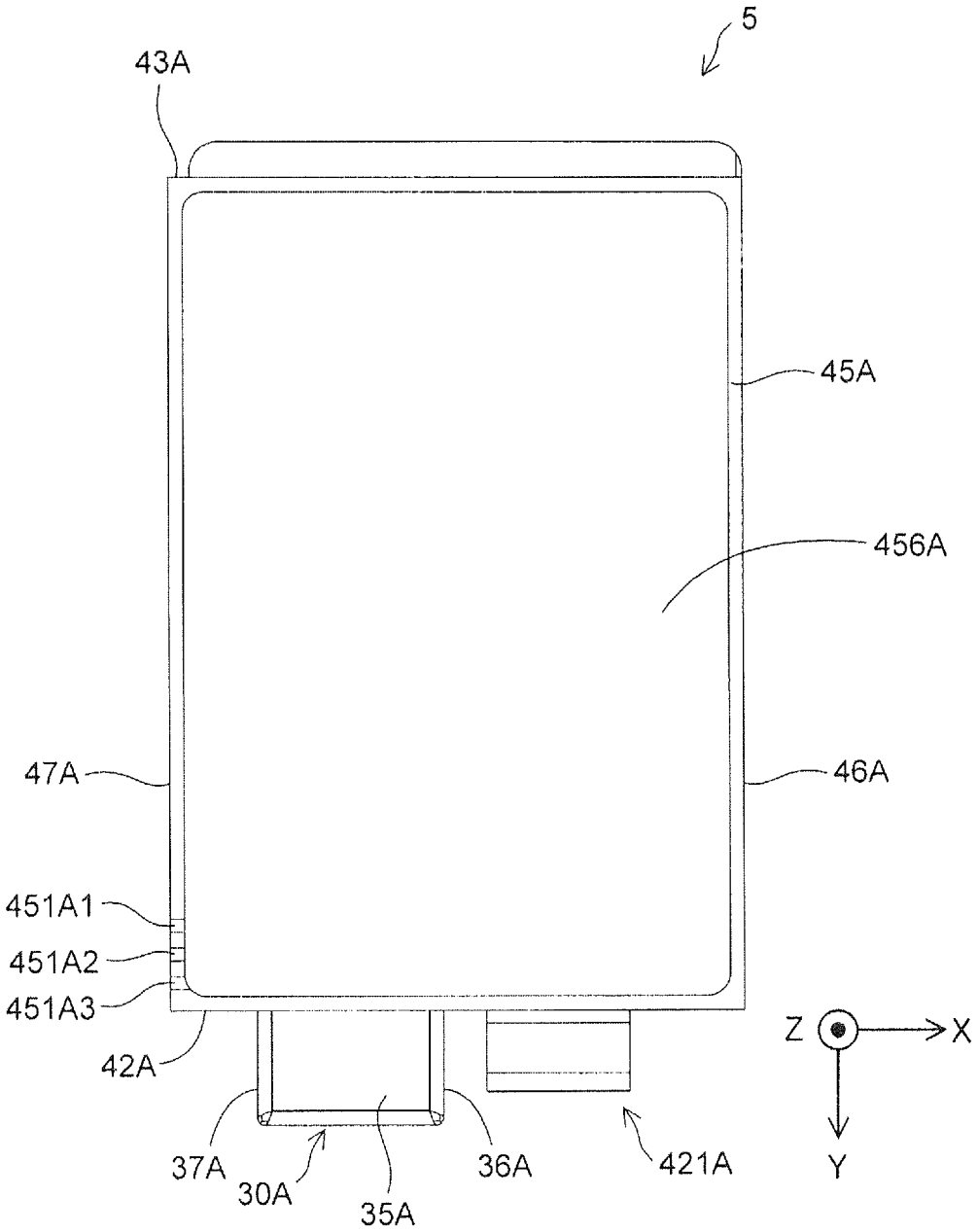
FIG. 26 is a top view of the second cartridge.
Figure 27:
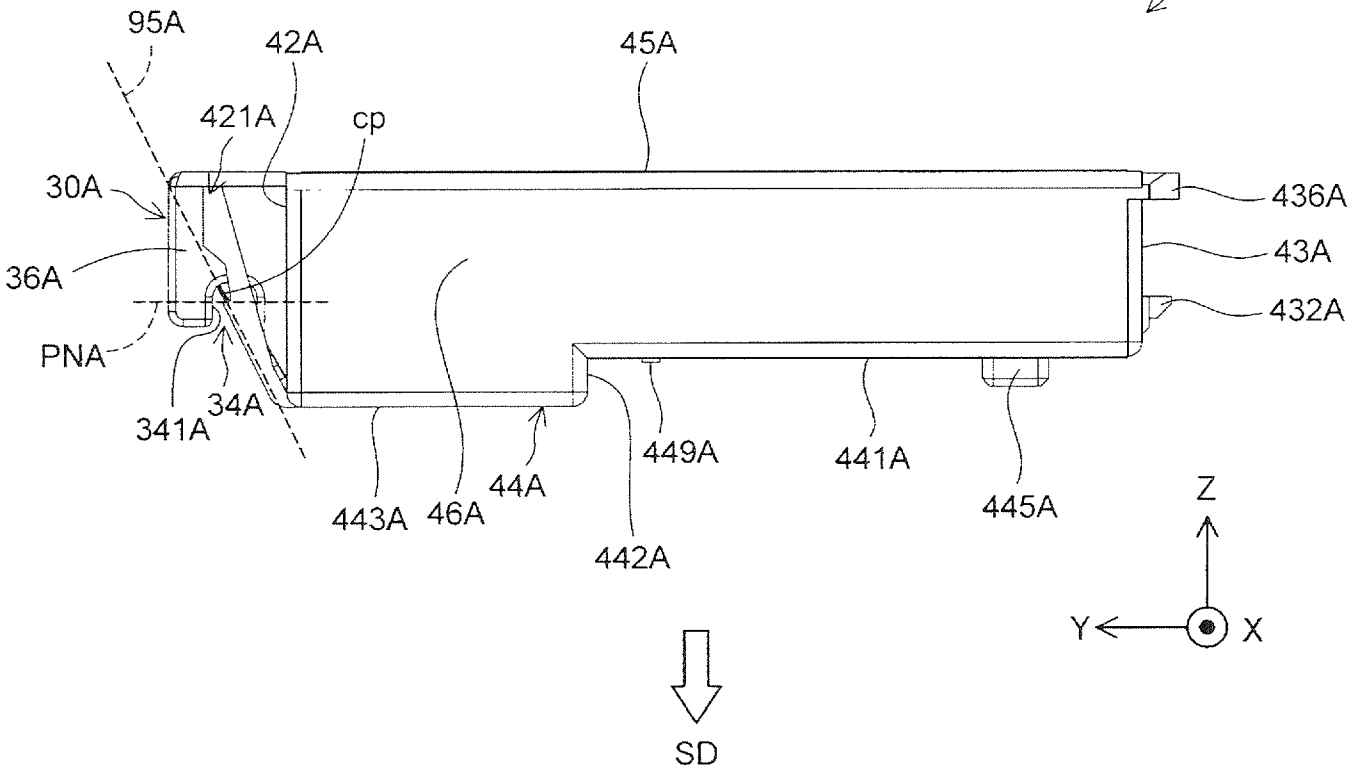
FIG. 27 is a right side view of the second cartridge.
Figure 28A:
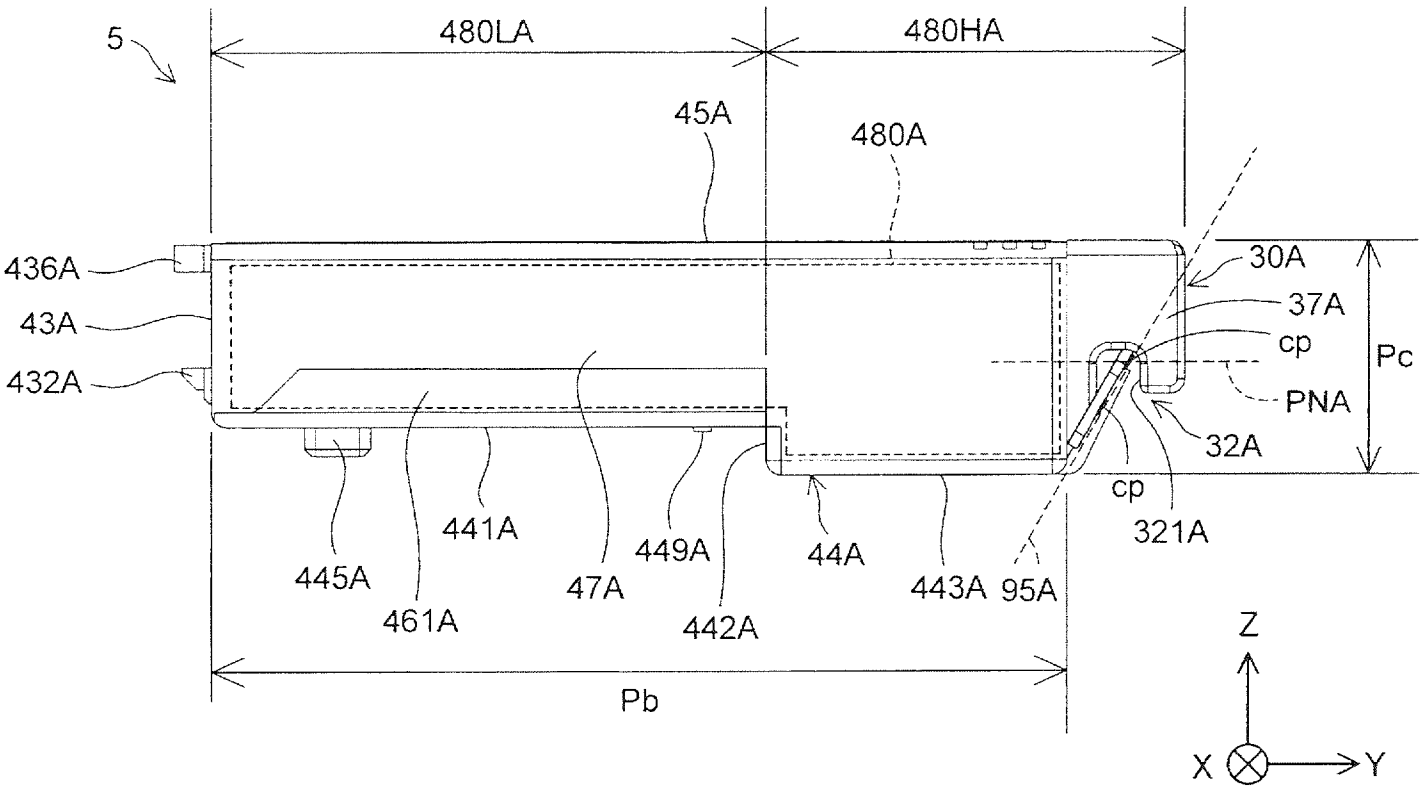
FIG. 28A is a left side view of the second cartridge.
Figure 28B:
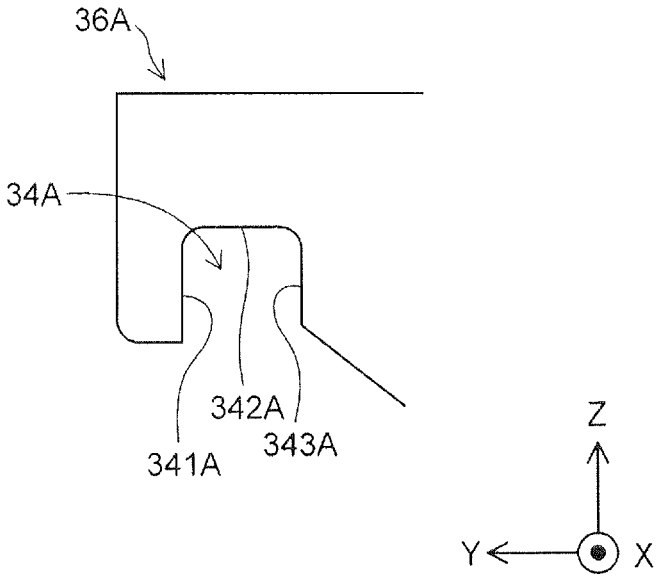
FIG. 28B is a diagram for describing a first engaged portion.
Figure 28C:
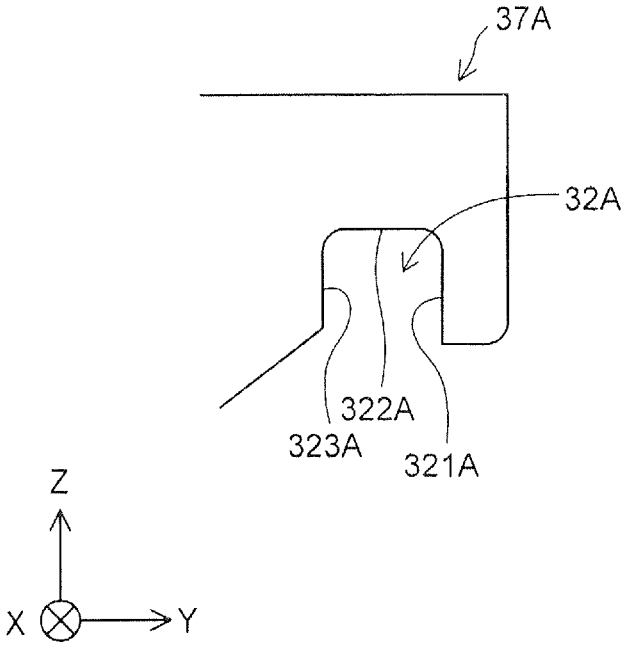
FIG. 28C is a diagram for describing a second engaged portion.

Next, mainly the configuration of the exterior of the second cartridge 5 will be described with reference to FIGS. 20 to 28C. FIG. 20 is an external perspective view of the second cartridge 5. FIG. 21 is an external perspective view of the second cartridge 5. FIG. 22 is an external perspective view of the second cartridge 5. FIG. 23 is a front view of the second cartridge 5. FIG. 24 is a rear view of the second cartridge 5. FIG. 25 is a bottom view of the second cartridge 5. FIG. 26 is a top view of the second cartridge 5. FIG. 27 is a right side view of the second cartridge 5. FIG. 28A is a left side view of the second cartridge 5. FIG. 28B is a diagram for describing a first engaged portion 36A. FIG. 28C is a diagram for describing a second engaged portion 37A.

In the description of the second cartridge 5, configurations of the second cartridge 5 that are the same as or correspond to configurations of the first cartridge 4 will be given the same reference signs appended with "A", and will generally not be described. The main differences between the first cartridge 4 and the second cartridge 5 are the length in the X axis direction, the number of liquid storage portions 480A, the number of liquid supply portions 447A, and the number of contact portions 449. The following describes the main configuration of the second cartridge 5 in order to facilitate understanding.

As shown in FIG. 20, the second cartridge 5 is shaped as a rectangular column. Also, spaces for storing ink (three liquid storage portions 480A1 to 480A3) are defined in the second cartridge 5. As shown in FIGS. 23 and 25, regarding the dimensions of the second cartridge 5, a length Pb has the highest value, and the values of the length Pb (Y axis direction dimension), a width Pa (X axis direction dimension), and a height Pc (Z axis direction dimension) decrease in the stated order. In this embodiment, the length Pb of the second cartridge 5 is equal to the length Bb of the first cartridge 4. Also, the height Pc of the second cartridge 5 is equal to the height Bc of the first cartridge. Furthermore, the width Pa of the second cartridge 5 is greater than the width Ba of the first cartridge 4. The magnitude relationship between the length, width, and height of the second cartridge 5 can be changed arbitrarily. The reference sign "480A" will be used when referring to the liquid storage portions 480A collectively or mentioning any one of them, and reference signs "480A1", "480A2", and "480A3" will be used when distinguishing between the liquid storage portions 480A. Cyan ink is stored in the liquid storage portion 480A1, magenta ink is stored in the liquid storage portion 480A2, and yellow ink is stored in the liquid storage portion 480A3.

As shown in FIGS. 20, 23, and 24, the second cartridge 5 includes a first wall 44A, a second wall 42A, a third wall 43A, a fourth wall 45A, a fifth wall 46A, and a sixth wall plane 47A. Similarly to the first cartridge 4, the first to sixth walls 42A to 47A can also be called the first to sixth planes 42A to 47A. The second to sixth planes 42A, 43A, 45A, 46A, and 47A are all generally flat. The first plane 44A is formed by multiple generally flat planes. Here, the first plane 44A will also be referred to as the bottom plane 44A, the second plane 42A will also be referred to as the front plane 42A, the third plane 43A will also be referred to as the rear plane 43A, the fourth plane 45A will also be referred to as the upper plane 45A, the fifth plane 46A will also be referred to as the right side plane 46A, and the sixth plane 47A will also be referred to as the left side plane 47A.

The positional relationship between the first to sixth planes 44A to 47A is similar to that of the corresponding first to sixth planes 44 to 47 of the first cartridge 4. For example, the first plane 44A and the fourth plane 45A oppose each other in the Z axis direction. The second plane 42A and the third plane 43A oppose each other in the Y axis direction. The fifth plane 46A and the sixth plane 47A oppose each other in the X axis direction Similarly to the first plane 44 of the first cartridge 4, the first plane 44A has a first section plane 441A, a second section plane 442A, and a third section plane 443A. Liquid supply portions 447A are formed in the first section plane 441A of the first plane 44A. Three liquid supply portions 447A are formed. The reference sign "447A" will be used when referring to the three liquid supply portions 447 collectively or mentioning any one of them, and reference signs "447A1", "447A2", and "447A3" will be used when distinguishing between the three liquid supply portions 447. The three liquid supply portions 447A1 to 447A3 are arranged along the width direction (X axis direction) of the second cartridge 5. The liquid supply portion 447A1 is connected to the liquid introduction portion 703*b* (FIG. 6) of the cartridge mounting portion 7. The liquid supply portion 447A2 is connected to the liquid introduction portion 703*c*. The liquid supply portion 447A3 is connected to the liquid introduction portion 703*d*. The liquid supply portions 447A1 to 447A3 introduce ink stored in the corresponding liquid storage portions 480A1 to 480A3 to the corresponding liquid introduction portions 703*b* to 703*d*.

As shown in FIG. 25, the liquid supply portions 447A are substantially elliptical openings. Specifically, when viewing the first plane 44A from the −Z axis direction side, the liquid supply portion 447A is formed by two parallel straight lines 417 and 416 and two arcs 418 and 419 that have the same center 5CX. The centers of the liquid supply portions 447A are the centers 5CX of the two arcs 418 and 419.

As shown in FIG. 25, the first section plane 441A of the first plane 44A includes contact portions 449A and an engaged portion 445A. Two contact portions 449A are formed. The reference sign "449A" will be used when referring to the two contact portions 449A collectively or mentioning either one of them, and reference signs "449A1" and "449A2" will be used when distinguishing between the two contact portions 449A. The engaged portion 445A is arranged so as to be in the vicinity of the portion of the first plane 44A where the third plane 43A and the sixth plane 47A intersect.

The two contact portions 449A1 and 449A2 are arranged at positions that sandwich a YZ plane C2A that passes through the center in terms of the width Pa of the second cartridge 5. Also, in terms of the X axis direction, the two contact portions 449A1 and 449A2 are arranged at positions that sandwich the liquid supply portion 447A2, which is the one of the three liquid supply portions 447A1 to 447A3 that is located in the center. Also, the two contact portions 449A1 and 449A2 are arranged at positions in the vicinity of the three liquid supply portions 447A1 to 447A3.

As shown in FIGS. 24 and 27, the third plane 43A includes engaged portions 432A and a protrusion portion 436A. The configurations of the elements 432A and 436A are similar to the elements 432 and 436 (FIG. 13) of the first cartridge 4.

As shown in FIG. 23, the second plane 42A includes a lever 421A and a contact mechanism 30A that includes terminals 930A. The lever 421A and the contact mechanism 30A are arranged side-by-side in the X axis direction. Portions 426A, 424A, and 427A of the lever 421A have a constant width. Other configurations of the lever 421A are similar to the configurations in the first cartridge 4.

As shown in FIG. 23, the contact mechanism 30A includes a first engaged portion 36A, a second engaged portion 37A, an arrangement portion 39A, and a circuit substrate 90A. These elements 30A, 36A, 37A, 39A, and 90A have similar configurations to the corresponding elements 30, 36, 37, 39, and 90 of the first cartridge 4. Main configurations of the elements 30A, 36A, 37A, 39A, and 90A will be described again below.

As shown in FIG. 23, the arrangement portion 39A and the circuit substrate 90A are each arranged between the first engaged portion 36A and the second engaged portion 37A. As shown in FIG. 21, the arrangement portion 39A includes a first side plane 33A and a second side plane 31A. Four terminals 931A to 934A that the circuit substrate 90A includes form a second terminal row 9R2, and five terminals 935A to 939A form a first terminal row 9R1 (FIG. 23). As shown in FIG. 28A, a flat plane 95A, which includes end planes 930*a* of the terminals 930A on which the contact portions cp are formed, is inclined relative to the first section plane 441A, which is a horizontal plane. As shown in FIGS. 21, 27, and 28A, the first engaged portion 36A and the second engaged portion 37A are both hook-shaped.

As shown in FIG. 28B, the first engaged portion 36A has a recessed portion 34A. As shown in FIG. 28C, the second engaged portion 37A has a recessed portion 32A. The configuration of the recessed portion 34A is the same as the configuration of the recessed portion 34 (FIG. 10B) of the first cartridge 4. In other words, as shown in FIG. 28B, the recessed portion 34A includes a first contact portion 341A, a first opposing portion 342A, and a first side plane portion 343A. Also, as shown in FIG. 28C, the recessed portion 32A includes a second contact portion 321A, a second opposing portion 322A, and a second side plane portion 323A.

As shown in FIG. 22, each air release flow channel 450A is formed by a groove 455A formed in the fourth plane 45A and a sheet member 456A (see FIG. 26) affixed to the fourth plane 45A. Three air release flow channels 450A are formed. The reference sign "450A" will be used when referring to the three air release flow channels 450A collectively or mentioning any one of them, and reference signs "450A1", "450A2", and "450A3" will be used when distinguishing between the three air release flow channels 450A. The three air release flow channels 450A1 to 450A3 put the outside and the corresponding liquid storage portions 480A1 to 480A3 in communication with each other.

As shown in FIGS. 20 and 28, the sixth plane 47A includes a sunken portion 461A. The configuration of this sunken portion 461A is similar to that of the sunken portion 461 (FIG. 16) that the fifth plane 46 of the first cartridge 4 includes. The sunken portion 461A is provided at a position in the sixth plane 47A that corresponds to the partition wall 741 (FIG. 4A) of the cartridge mounting portion 7. The sunken portion 461A is configured so as to be able to receive insertion of the partition wall 741. In this way, the adjacent planes 46 and 47A of the cartridges 4 and 5 that are to be mounted to the cartridge mounting portion 7 respectively include the sunken portions 461 and 461A, and the sunken portions 461 and 461A are configured so as to be able to receive insertion of the partition wall 741. Accordingly, the slot 70 of the cartridge mounting portion 7 is partitioned by the partition wall 741, and the slot 70 can be used efficiently when mounting the cartridges 4 and 5. In other words, the size of the cartridge mounting portion 7 can be reduced.

A-8: Positional Relationship Between Elements (Members) of Second Cartridge 5

The above-described positional relationship between the elements that the first cartridge 4 includes is satisfied by the elements that the second cartridge 5 includes as well. The following describes the main relationships among the positional relationships in the second cartridge 5 in order to facilitate understanding.

As shown in FIG. 23, in terms of the width direction (X axis direction) of the second cartridge 5, a plane CTA is a plane that passes through the central point between the first and second engaged portions 36A and 37A and is parallel to the Y axis direction and the Z axis direction. The contact portion cp of the seventh terminal 937A passes through the plane CTA. Also, the terminals 931A to 939A are located between the first and second engaged portions 36A and 37A in terms of the width direction of the second cartridge 5.

As shown in FIG. 27, the portion 341A (first contact portion 341A) of the first engaged portion 36A that comes into contact with the first engaging portion 84 (FIG. 7A) and the portions cp (contact portions cp) of the terminals 931A to 934A that come into contact with the contact members 801 to 804 (FIG. 7A) are arranged on the same plane PNA. Also, as shown in FIG. 28A, the portion 321A (second contact portion 321A) of the second engaged portion 37A that comes into contact with the second engaging portion 85 (FIG. 7A) and the portions cp (contact portions cp) of the terminals 931A to 934A that come into contact with the contact members 801 to 804 (FIG. 7A) are arranged on the same plane PNA. In other words, when the second cartridge 5 is viewed from a predetermined position, the portion 321A, the portion 341A, and the portions cp are arranged on the same straight line. This predetermined position is at position at the height at which the plane PNA is located in this embodiment.

As shown in FIG. 25, distances from the centers 5CX of the liquid supply portions 447A to the portions cp where the contact members 800 (FIG. 7A) and the terminals 930A come into contact with each other are distances Ea1 and Ea2. Also, the distances from the centers 5CX to the portions 341A where the first engaging portion 84 (FIG. 7A) and the first engaged portion 36A come into contact, and the distances from the centers 5CX to the portions 321A where the second engaging portion 85 (FIG. 7A) and the second engaged portion 37A come into contact are a distance Eb. Here, the relationship Eb>Ea2>Ea1 is satisfied. Note that the distance Ea1 is equal to the distance La1 (FIG. 14), the distance Ea2 is equal to the distance La2 (FIG. 14), and the distance Eb is equal to the distance Lb (FIG. 14).

Also, the engaged portion 445A and the contact mechanism 30A have the following positional relationship. Specifically, as shown in FIG. 25, when viewing the first plane 44A from the −Z axis direction side, the engaged portion 445A is located in the vicinity of one corner portion that forms an opposing corner of the first plane 44A, and the contact mechanism 30A is located in the vicinity of the other corner portion. In other words, the engaged portion 445A and the contact mechanism 30A have a positional relationship in which they sandwich an XZ plane C3A (corresponding to the XZ plane C3 in FIG. 14) and also sandwich a YZ plane C2A (corresponding to the plane C2 in FIG. 14). Accordingly, the engaged portion 445A and the contact mechanism 30A can be arranged at separated positions.

Also, as shown in FIGS. 27 and 28A, the first and second engaged portions 36A and 37A are arranged at positions that pass through the plane 95A. Specifically, the first and second engaged portions 36A and 37A (specifically, the recessed portions 34A and 32A) are, relative to the terminals 930A, located in an extending direction of the planes 930*a* (planes 930*a* that include the contact portions cp) of the terminals 930A that can come into contact with the contact members 800.

A-9: Internal Configuration of Second Cartridge 5

Figure 29A:
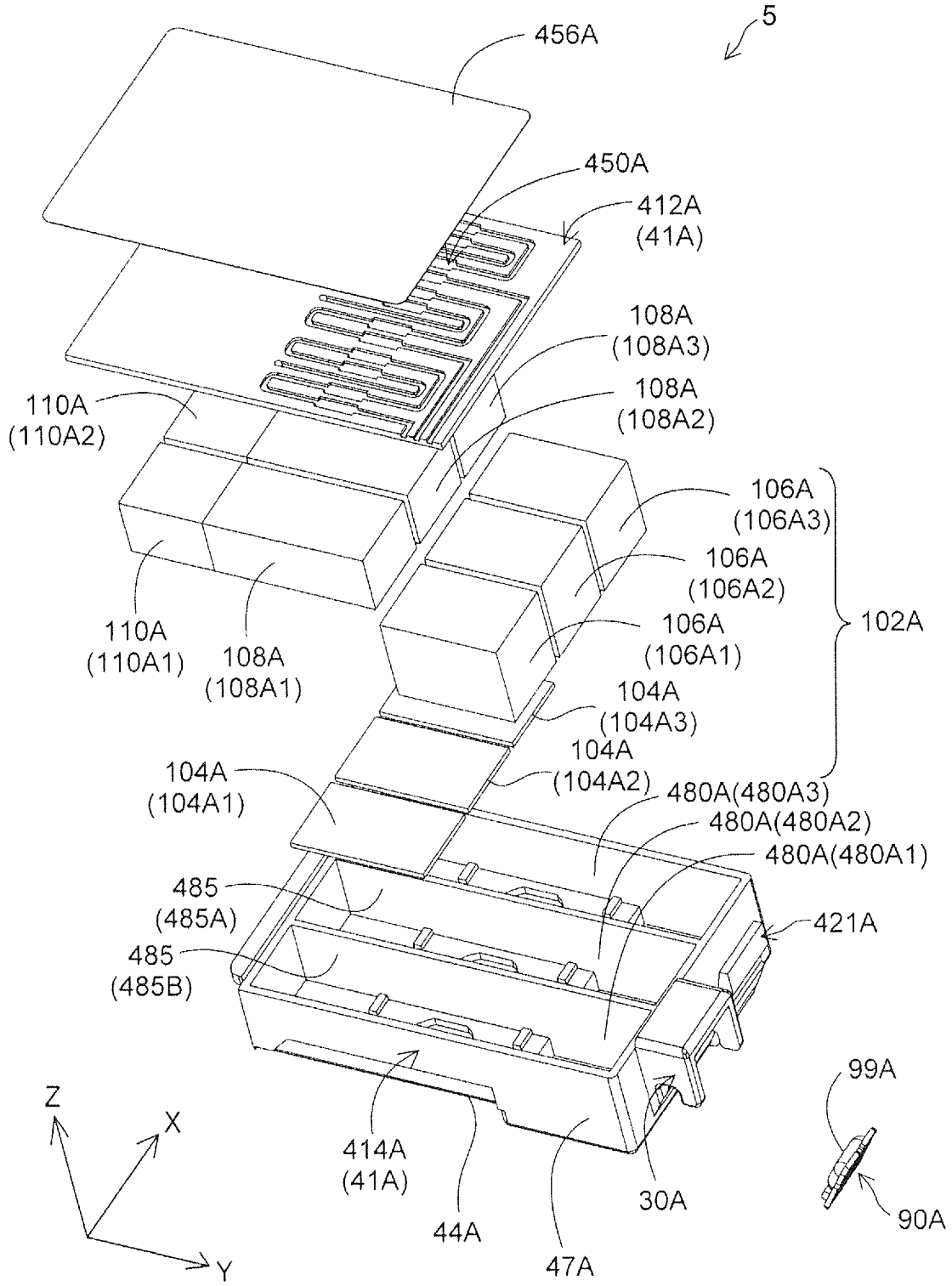
FIG. 29A is an exploded perspective view of the second cartridge.
Figure 29B:
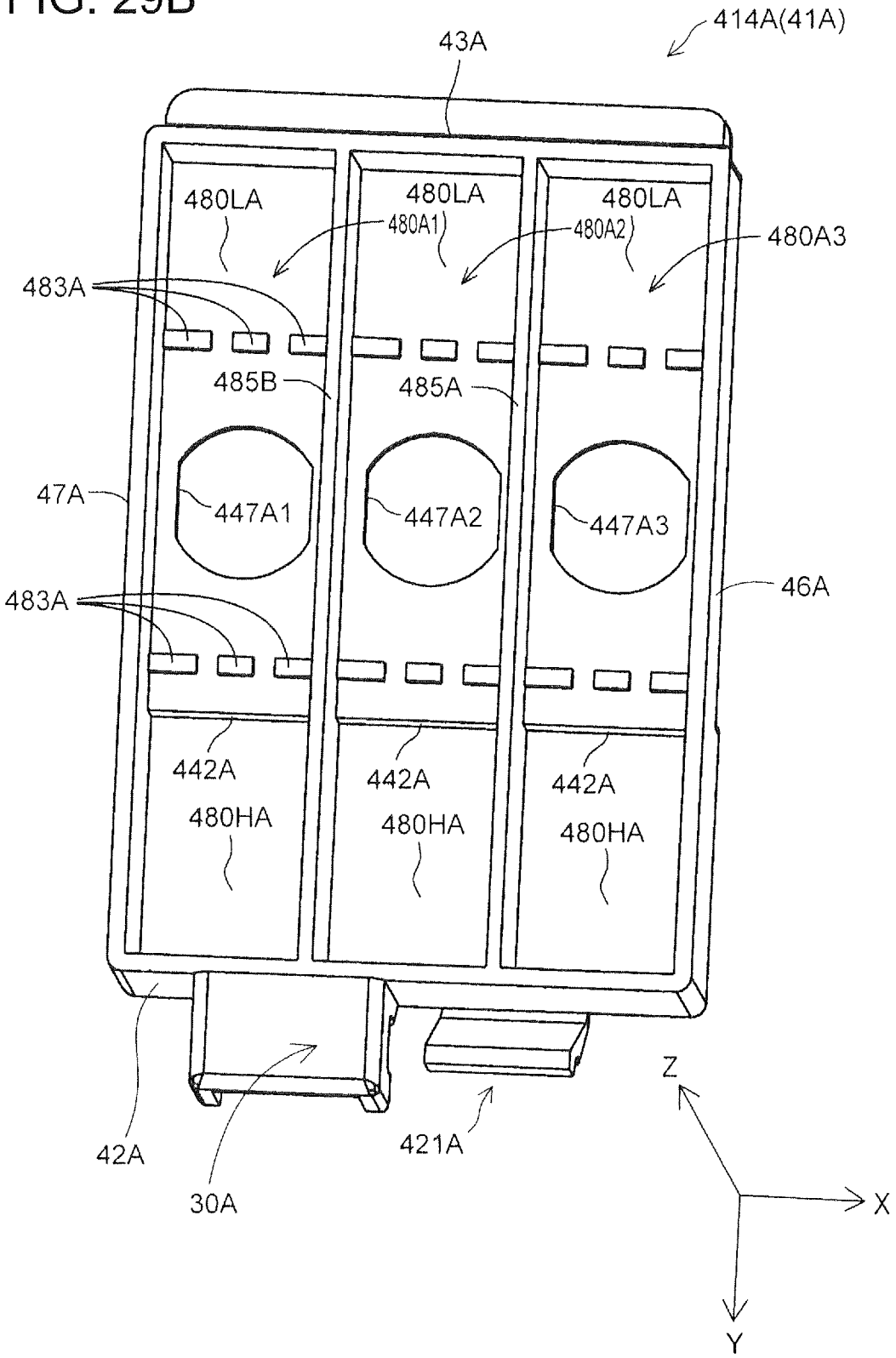
FIG. 29B is an external perspective view of a container body.

FIG. 29A is an exploded perspective view of the second cartridge 5. FIG. 29B is an external perspective view of a container body 414A. As shown in FIGS. 29A and 29B, two defining walls 485A and 485B for defining the three liquid storage portions 480A1 to 480A3 are provided inside the container body 414A. The reference sign "485" will be used when referring to the two defining walls 485A and 485B collectively, or when mentioning either one of them. A cover member 412A is precisely attached to the end planes forming the opening of the container body 414A and the end planes of the defining walls 485A and 485B, thus defining the three liquid storage portions 480A1 to 480A3. As shown in FIG. 29B, the defining wall 485A defines the liquid storage portion 480A2 and the liquid storage portion 480A3. The defining wall 485B defines the liquid storage portion 480A1 and the liquid storage portion 480A2.

As shown in FIG. 29A, the three liquid storage portions 480A1 to 480A3 each have a holding member 102A. The configuration and features of the holding member 102A are the same as those of the holding member 102 that the first cartridge 4 includes. In other words, the holding member 102A has first to fourth holding members 104A to 110A. As shown in FIG. 29B, multiple projections 483A are arranged on inner planes of the liquid storage portions 480A1 to 480A3.

A-10: Mounting Process and Mounted State of Cartridges 4 and 5

A-10-a: Mounting Process

Figure 30:
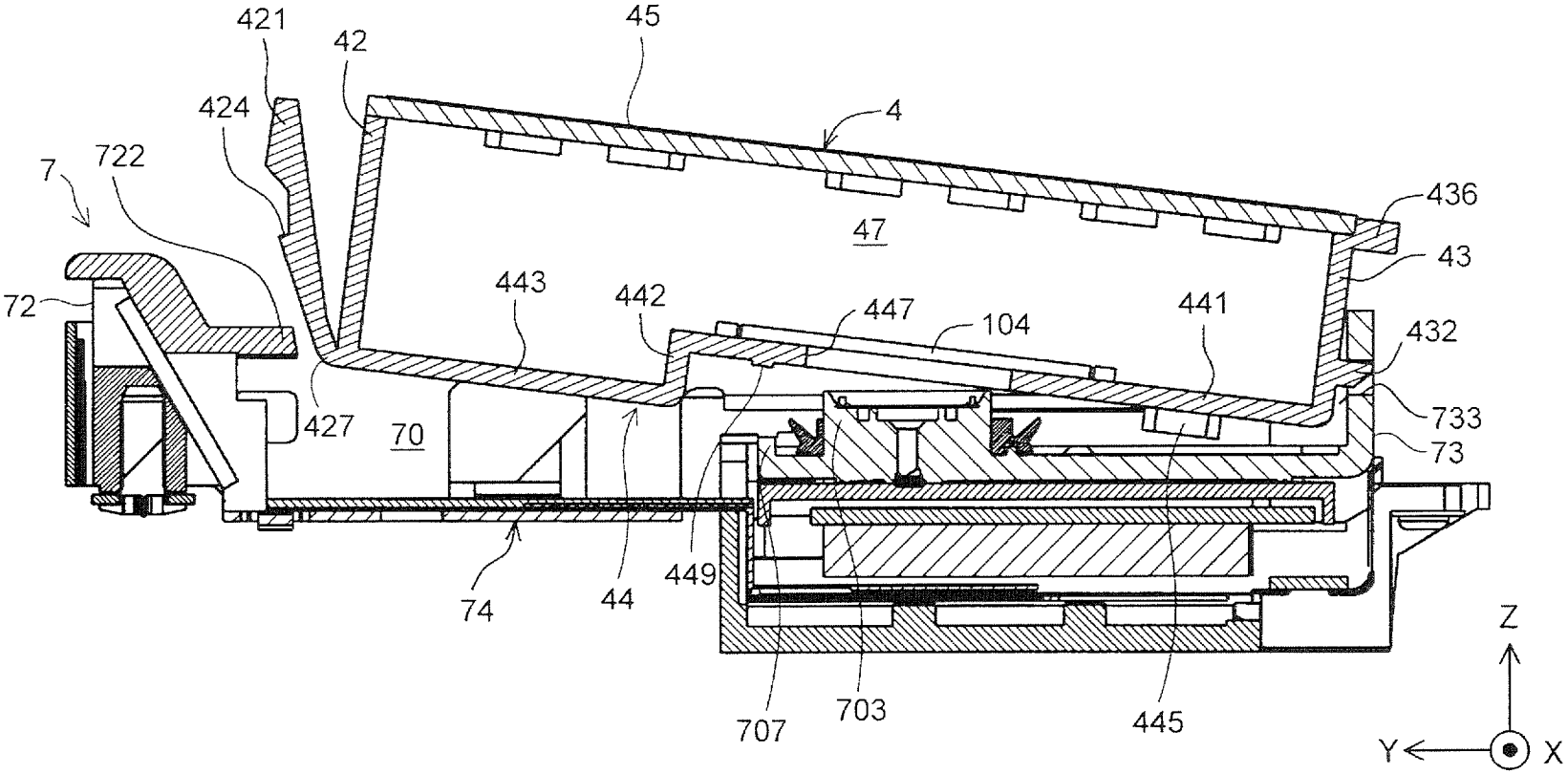
FIG. 30 is a first diagram for describing aspects of mounting.
Figure 31:
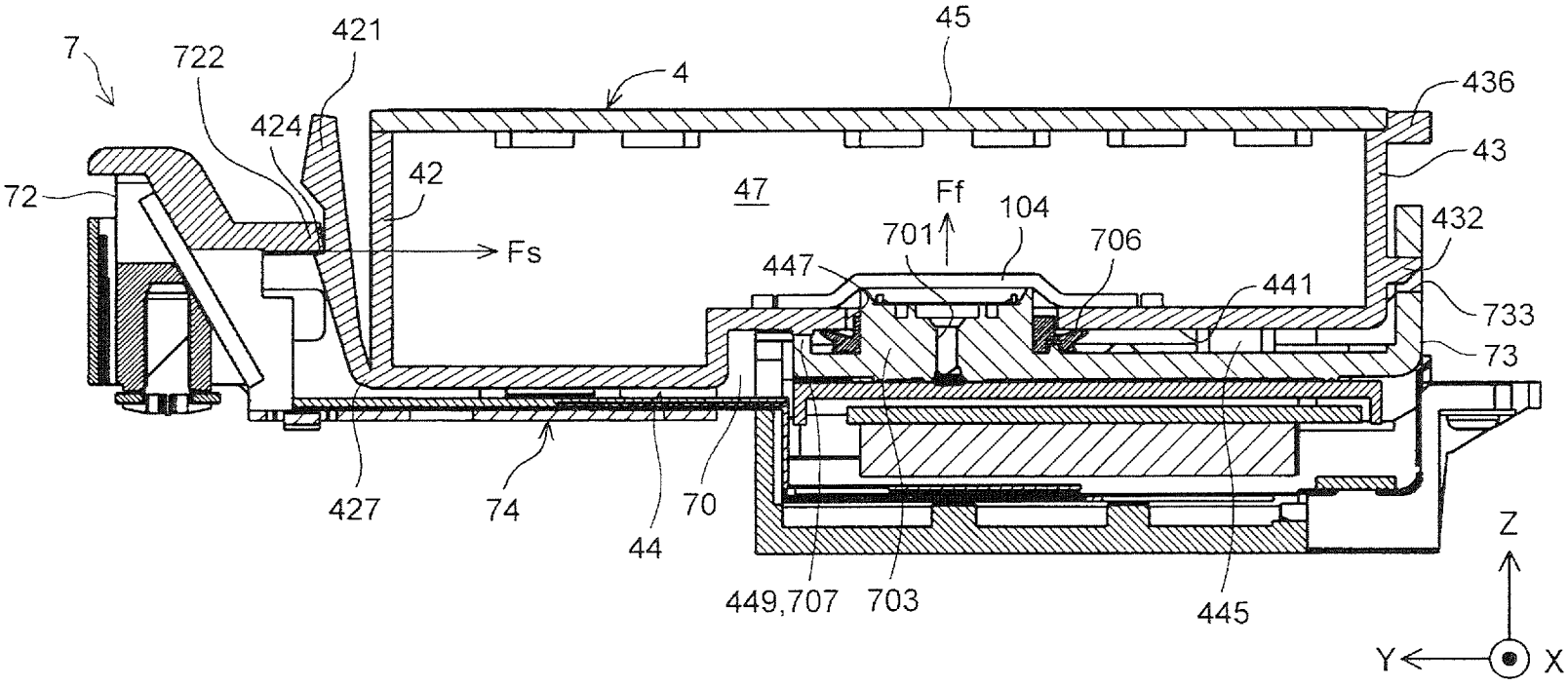
FIG. 31 is a second diagram for describing aspects of mounting.
Figure 32:
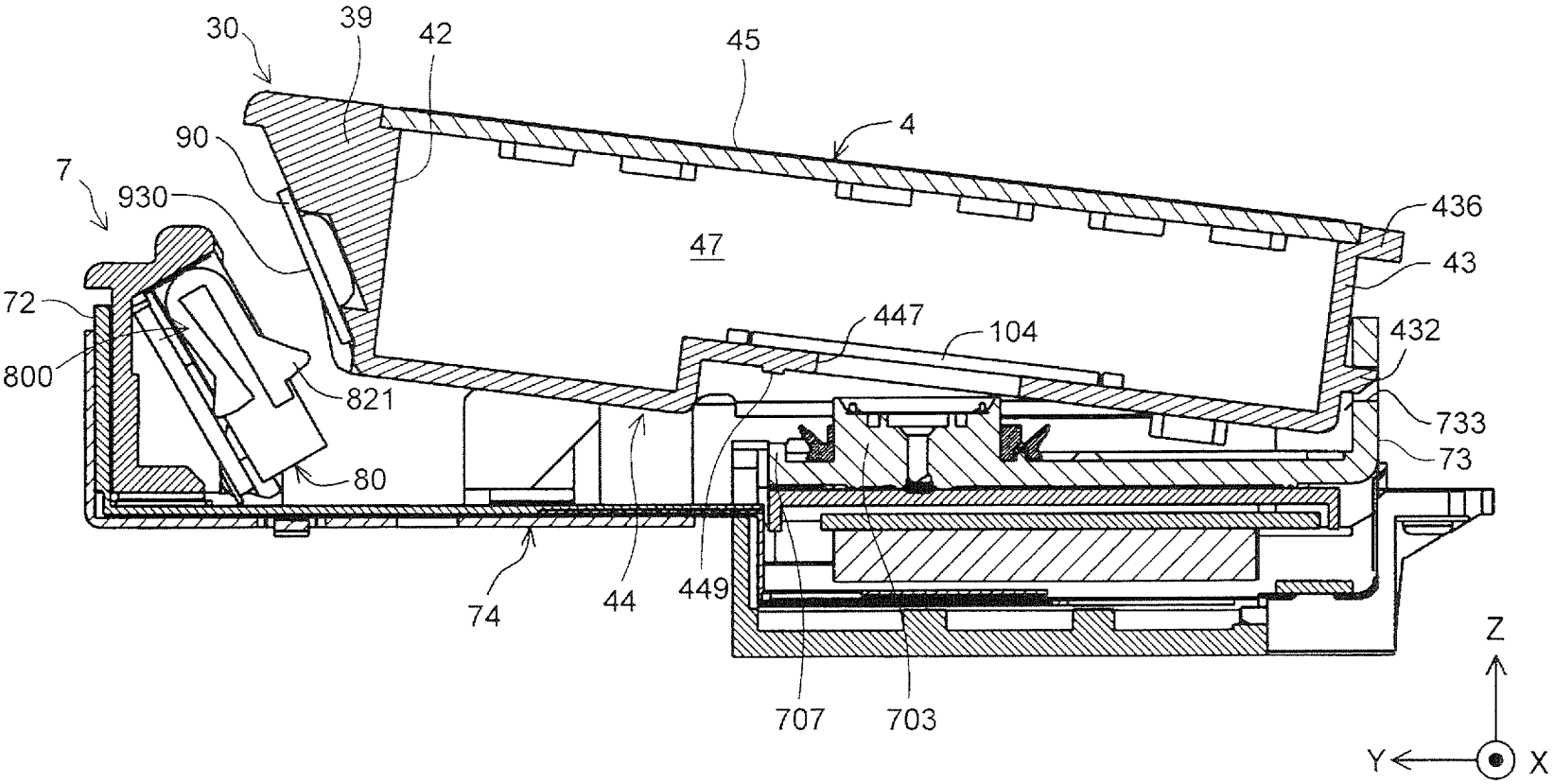
FIG. 32 is a third diagram for describing aspects of mounting.
Figure 33:
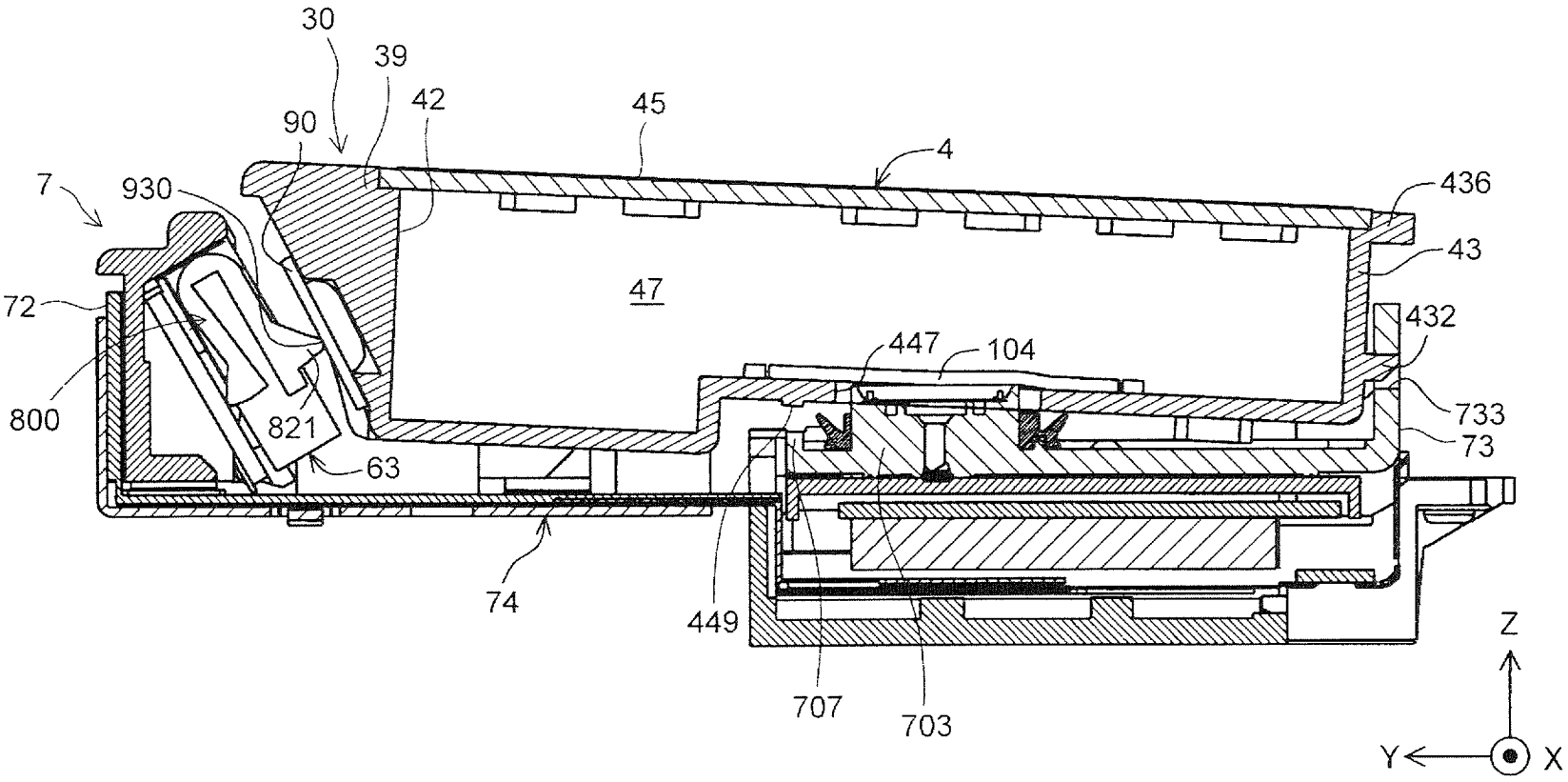
FIG. 33 is a fourth diagram for describing aspects of mounting.
Figure 34:
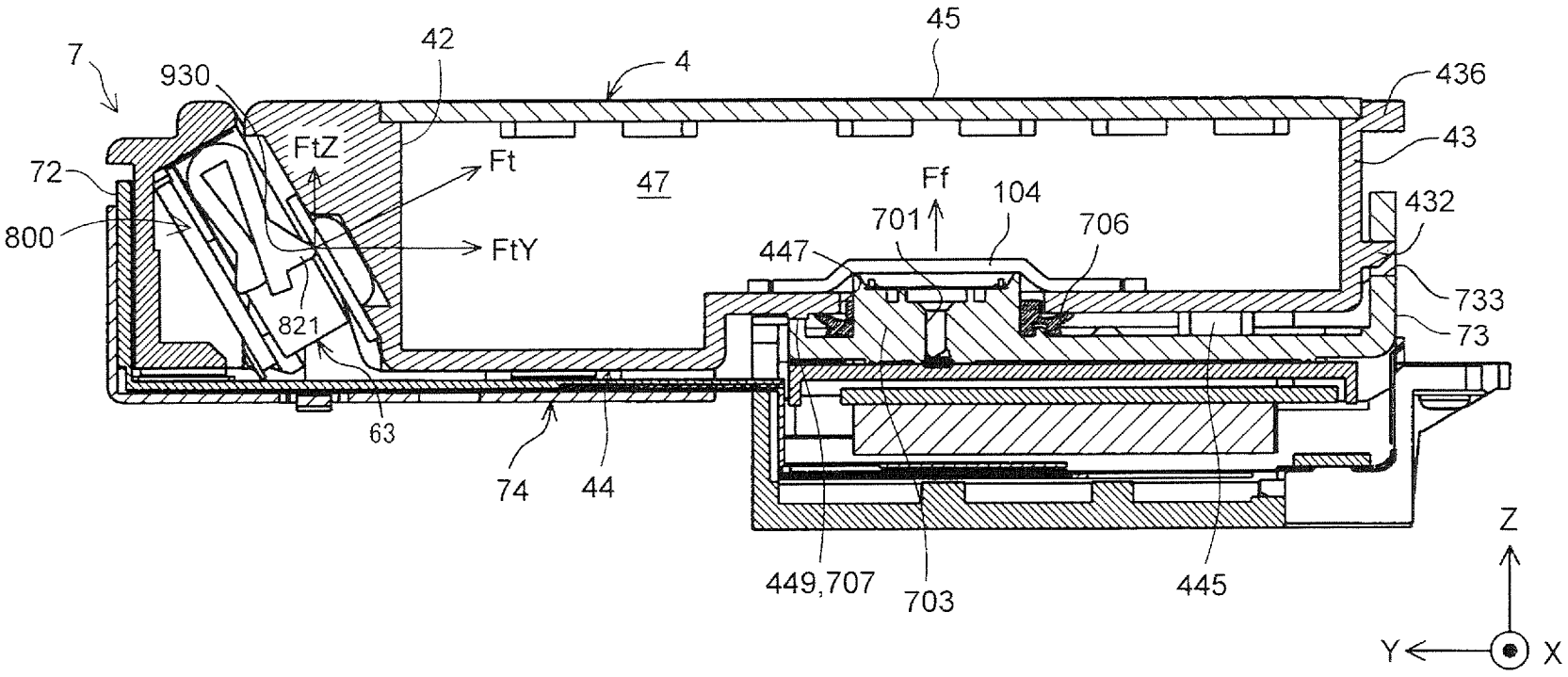
FIG. 34 is a fifth diagram for describing aspects of mounting.
Figure 35:
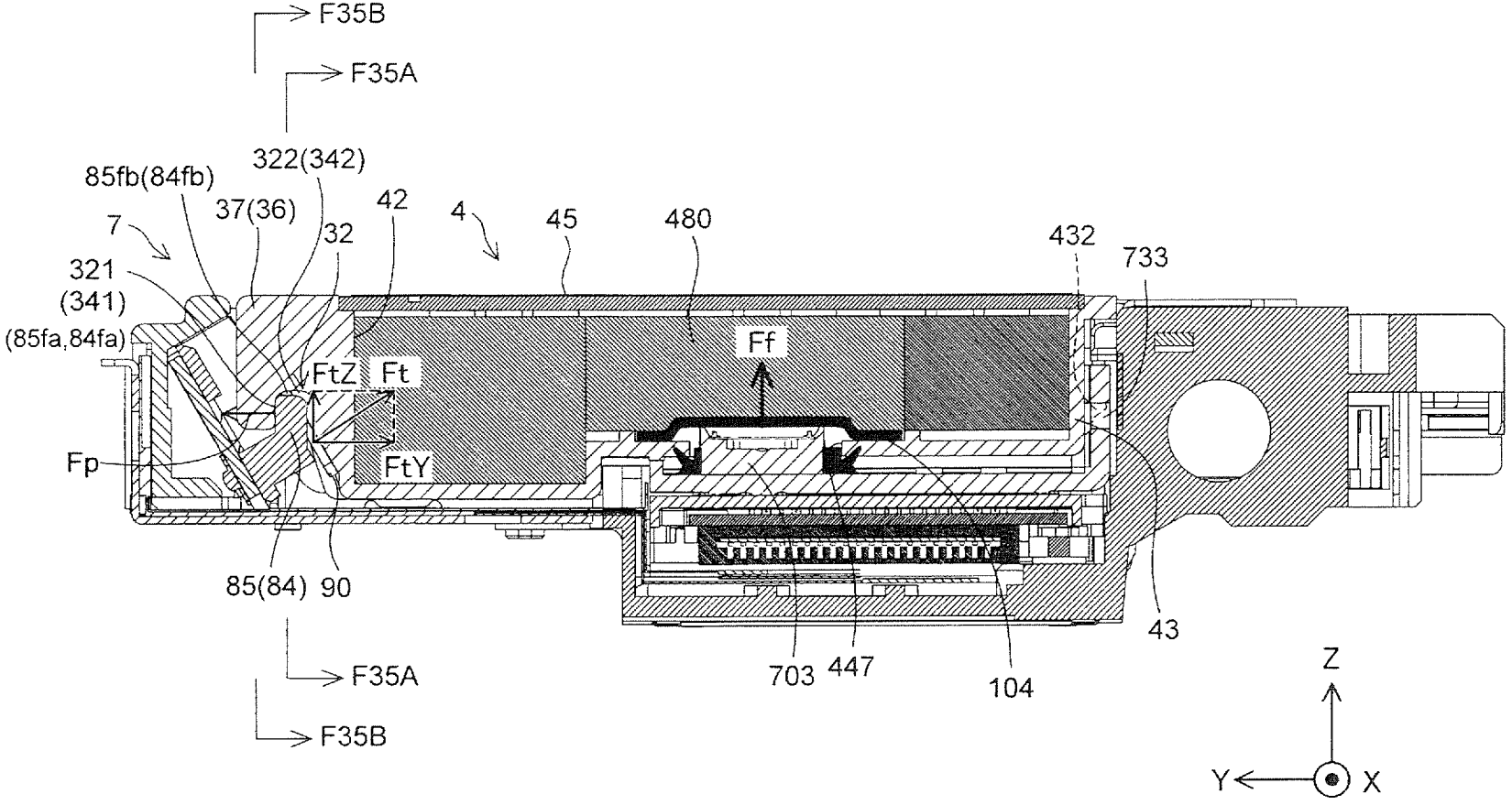
FIG. 35 is a sixth diagram for describing aspects of mounting.
Figure 36:
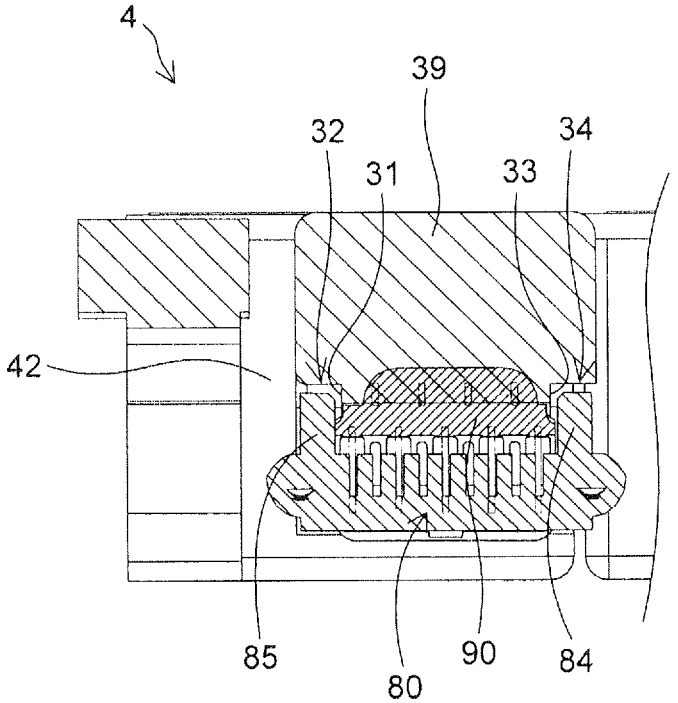
FIG. 36 is a cross-sectional view taken along F35A-F35A in FIG. 35.
Figure 36:
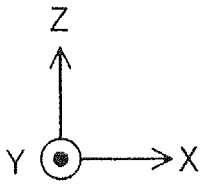
Figure 37:
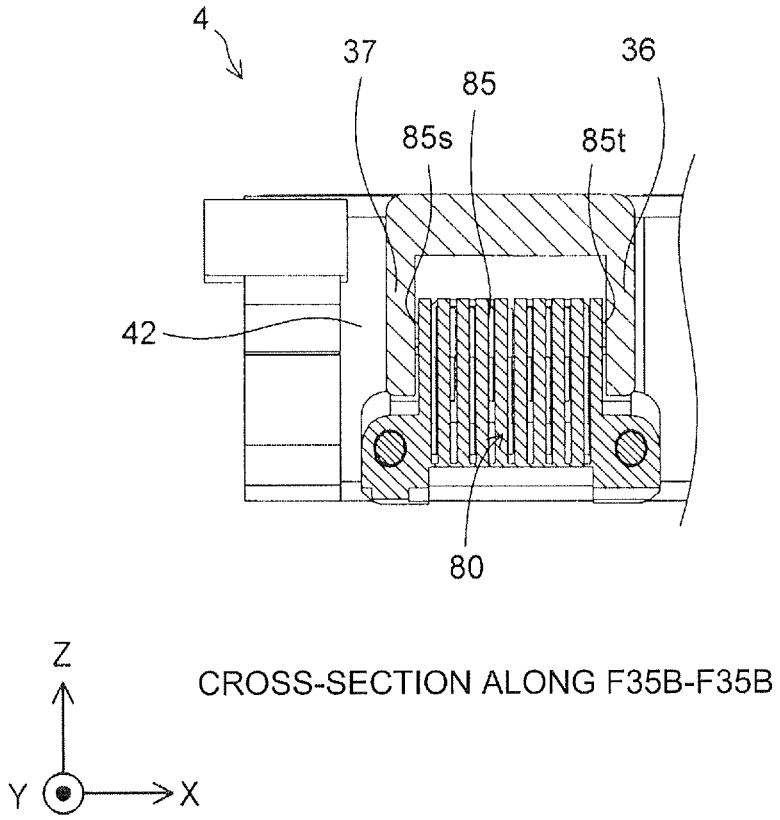
FIG. 37 is a cross-sectional view taken along F35B-F35B in FIG. 35.

The following describes how the cartridges 4 and 5 are mounted to the cartridge mounting portion 7 with reference to FIGS. 30 to 37. Since the aspects of mounting for the first cartridge 4 and the second cartridge 5 are similar to each other, the following description is given using the first cartridge 4. FIG. 30 is a first diagram for describing aspects of mounting. FIG. 31 is a second diagram for describing aspects of mounting. FIG. 32 is a third diagram for describing aspects of mounting. FIG. 33 is a fourth diagram for describing aspects of mounting. FIG. 34 is a fifth diagram for describing aspects of mounting. FIG. 35 is a sixth diagram for describing aspects of mounting. FIG. 36 is a cross-sectional view taken along F35A-F35A in FIG. 35. FIG. 37 is a cross-sectional view taken along F35B-F35B in FIG. 35. FIGS. 30 to 35 are cross-sectional views of the first cartridge 4 in the mounted state taken along the YZ plane. FIGS. 30 and 31 are cross-sectional views taken along a YZ plane that passes through the mounting/removal portion 722. FIGS. 32 to 34 are cross-sectional views taken along a YZ plane that passes through a contact member 800. FIG. 35 is a cross-sectional view taken along a YZ plane that passes through the second engaging portion 85.

As shown in FIG. 30, when mounting the first cartridge 4 to the cartridge mounting portion 7, the first cartridge 4 is tilted such that the third plane 43 side is more toward the vertically downward direction side than the second plane 42 side is. In this state, the engaged portion 432 is inserted into the engaging portion 733. Next, as shown in FIG. 31, the second plane 42 side is rotated in the vertically downward direction using the engaged portion 432 as the rotation support. Accordingly, the second plane 42 side is accommodated in the slot 70, and the contact portion 424 of the lever 421 engages with the mounting/removal portion 722 of the cartridge mounting portion 7. The first cartridge 4 is thus mounted to the cartridge mounting portion 7. In the mounted state, the lever 421 is undergoing elastic deformation so as to be closer to the second plane 42 side than when in the no-load state. For this reason, in the mounted state, the mounting/removal portion 722 applies, to the first cartridge 4, force Fs for pressing the first cartridge 4 toward the second device-side side wall 73. Also, in the mounted state, the engaged portion 445 is inserted into the bottom wall engaging portion 704 (FIG. 6).

Also, in the mounted state, due to the liquid introduction portion 703 coming into contact with the first liquid holding member 104, vertically upward direction force Ff is applied to the first cartridge 4. Here, in the mounted state, due to the contact portion 449 of the first cartridge 4 and the contact portion 707 of the cartridge mounting portion 7 coming into contact with each other, the liquid introduction portion 703 is prevented from being inserted too far into the liquid supply portion 447. In particular, providing the contact portion 449 in the vicinity of the liquid supply portion 447 enables reducing the possibility that the relative position of the liquid supply portion 447 in the vertical direction relative to the liquid introduction portion 703 will deviate from the designed position. For example, the Y axis direction dimension of the first cartridge 4 is greater than its dimensions in the other axis directions. For this reason, the first cartridge 4 is shaped such that it readily undergoes flexure in the vertically downward direction in the vicinity of the center in the Y axis direction. The liquid supply portion 447 is located in the vicinity of the center of the first cartridge 4 in the Y axis direction. Accordingly, in terms of the vertical direction, positional shift relative to the cartridge mounting portion 7 readily occurs in the vicinity of the liquid supply portion 447. Providing the contact portion 449 in the vicinity of the liquid supply portion 447 makes it possible to prevent flexure in the vicinity of the center of the first cartridge 4 in the Y axis direction, and prevent positional shift of the liquid supply portion 447 relative to the cartridge mounting portion 7 in the vertical direction. This makes it possible for an amount of ink that allows the printer 10 to favorably perform printing to be introduced from the liquid storage portion 480 to the liquid introduction portion 703. Also, due to the engaged portion 445 being formed in the third section plane 443, in which the liquid supply portion 447 is formed, the liquid supply portion 447 can be precisely positioned relative to the liquid introduction portion 703 in the XY plane.

FIG. 32 shows the same state as in FIG. 30, with the engaged portion 432 having been inserted into the engaging portion 733. The mounting of the first cartridge 4 to the cartridge mounting portion 7 proceeds when the second plane 42 side of the first cartridge 4 is pressed farther in the vertically downward direction beyond the state shown in FIG. 30. The state shown in FIG. 32 is a state in which the one end portion 821 of the contact member 800 starts to come into contact with the terminal 930.

In the mounting process, the second plane 42 side of the first cartridge 4 is pressed farther in the vertically downward direction beyond the state shown in FIG. 32. Accordingly, as shown in FIGS. 33 and 34, the contact member 800 rubs the surface of the terminal 930 while moving from when the members 800 and 930 start to come into contact until when the mounting of the first cartridge 4 is complete. This movement is also called "wiping". As the contact member 800 rubs the surface of the terminal 930, it is possible to remove impurities such as an oxide layer and foreign material on the surface of the terminal 930. This makes it possible to achieve a favorable electrical connection between the terminal 930 and the contact member 800.

As shown in FIG. 35, up to the mounted state of the first cartridge 4 in the mounting process, the first opposing portion 342 of the first engaged portion 36 opposes the first end portion 84*fb*, which is located on the vertically upward direction side of the first engaging portion 84. Also, up to the mounted state of the first cartridge 4 in the mounting process, the second opposing portion 322 of the second engaged portion 37 opposes the second end portion 85*fb*, which is located on the vertically upward direction side of the second engaging portion 85. The first opposing portion 342 opposes the first end portion 84*fb*, and the second opposing portion 322 opposes the second end portion 85*fb* at least in the mounted state of the first cartridge 4. In the first cartridge 4 mounting process, the third plane 43 side is pressed slightly farther in the vertically downward direction than in the mounted state. Then, after the first cartridge 4 mounting operation performed by the user is complete, the first cartridge 4 moves in the vertically upward direction due to the forces Ff and FtZ. This movement in the vertically upward direction continues until the lever 421 is engaged with the mounting/removal portion 722.

It is preferable that the distances between the members 342, 84*fb*, 322, and 85*fb* in the vertical direction are designed so as to satisfy the following predetermined state. Specifically, the predetermined state is a state in which, when the members 342, 84*fb*, 322, and 85*fb* are brought into contact with each other due to the second plane 42 side being pressed in the vertically downward direction when in the mounted state, the contact between the contact member 800 and the terminal 930 is maintained.

A-10-b: Mounted State

As shown in FIG. 35, in the mounted state, the first contact portion 341 of the first engaged portion 36 is engaged with the first contact portion 84*fa* of the first engaging portion 84 (also referred to as "first engagement"). Also, in the mounted state, the second contact portion 321 of the second engaged portion 37 is engaged with the second contact portion 85*fa* of the second engaging portion 85 (also referred to as "second engagement"). In both the first engagement and the second engagement, the first cartridge 4 is restricted from moving in the direction of separation from the contact member 800 (−Y axis direction) in resistance to force Ft that includes a −Y axis direction component. In other words, the cartridge mounting portion 7 applies force Fp to the first cartridge 4.

Also, as shown in FIG. 36, in the mounted state, the arrangement portion 39 is located between the first engaging portion 84 and the second engaging portion 85 in terms of the X axis direction. In other words, in the mounted state, the first engaging portion 84 opposes the first side plane 33 of the arrangement portion 39, and the second engaging portion 85 opposes the second side plane 31 of the arrangement portion 39.

Specifically, the first cartridge 4 includes the arrangement portion 39 that is provided so as to protrude from the second plane 42, the circuit substrate 90 that is provided on the outer plane 39*a* of the arrangement portion 39 and includes the terminals 930, the first engaged portion 36 that is provided on one side plane of the arrangement portion 39, and the second engaged portion 37 that is provided on the other side plane of the arrangement portion 39. The first engaged portion 36 has the first recessed portion 34 that can receive insertion of the projection-shaped first engaging portion 84 of the cartridge mounting portion 7, the second engaged portion 37 has a second recessed portion 32 that can receive insertion of the projection-shaped second engaging portion 85 of the cartridge mounting portion 7, the one side plane 33 of the arrangement portion 39 and one side plane of the circuit substrate 90 oppose the first recessed portion 34, and the other side plane 31 of the arrangement portion 39 and the other side plane of the circuit substrate 90 oppose the second recessed portion 32. In other words, the one side plane 33 of the arrangement portion 39 and the one side plane of the circuit substrate 90 are arranged at a position where they are visible from the outside through first recessed portion 34, and the other side plane 31 of the arrangement portion 39 and the other side plane of the circuit substrate 90 are arranged at a position where they are visible from the outside through the second recessed portion 34.

Also, as shown in FIG. 37, in the mounted state, the connectors 80 are located between the first engaged portion 36 and the second engaged portion 37 in terms of the X axis direction. In other words, in the mounted state, the first engaged portion 36 opposes the first side plane 85*t* of the connector body 855, and the second engaged portion 37 opposes the second side plane 85*s* of the connector body 855.

A-11: Effects

For the purpose of illustration, the following describes effects of this embodiment using the configuration of the first cartridge 4 and the configuration of the first slot 70*a* to which the first cartridge 4 is mounted. However, similar effects are achieved also with the configurations of the second cartridge 5 that correspond to those of the first cartridge 4 and the configurations of the second slot 70*b*, to which the second cartridge 5 is mounted, that correspond to those of the first slot 70*a*.

A-11-a: First Group of Effects

In this embodiment, the first cartridge 4 includes the terminals 930 that are arranged so as to be able to come into contact with the contact members 800, and the first engaged portion 36 that is able to engage with the first engaging portion 84 (FIGS. 9 and 12). Also, the first engaging portion 84 is provided on the printer 10. Accordingly, it is possible to raise the reliability of contact between the contact members 800 and the terminals 930 using the elastic force Ft of the contact members 800 and the force Fp (restricting force Fp) generated by engagement of the members 84 and 36 (FIG. 3C). Specifically, the first engaged portion 36 is configured so as to, when engaged with the first engaging portion 84, restrict the terminals 930 from moving away from the contact members 800 in resistance to the elastic force Ft of the contact members 800. Accordingly, in this embodiment, it is possible to favorably maintain contact between the members 800 and 930. In particular, in this embodiment, the contact members 800 of the printer 10 and the first engaging portion 84 are arranged so as to be adjacent to each other (FIG. 7A). Specifically, the terminals 930 of the first cartridge 4 that correspond to the contact members 800 are arranged at positions adjacent to the first engaged portion 36 of the first cartridge 4 that corresponds to the first engaging portion 84. Accordingly, movement of the terminals 930 is restricted at a position close to the terminals 930, thus making it possible to raise the reliability of contact between the contact members 800 and the terminals 930.

Also, in the above embodiment, the first cartridge 4 includes the first plane 44 in which the liquid supply portion 447 is formed, and the second plane 42 that has the terminals 930 and the first engaged portion 36 (FIG. 9). The first engaged portion 36 is configured so as to, when engaged with the first engaging portion 84, restrict the terminals 930 from moving away from the contact members 800 in resistance to the elastic force Ft of the contact members 800 (FIG. 9). Accordingly, it is possible to favorably maintain contact between the members 800 and 930. Also, the first engaged portion 36 is provided on the second plane 42, on which the terminals 930 are provided. The second plane 42 is a different plane from the first plane 44 in which the liquid supply portion 447 is provided. According to this configuration, it is possible to reduce the possibility of the first engaged portion 36 colliding with the cartridge mounting portion 7 in the first cartridge 4 mounting process. This makes it possible to reduce the possibility of the cartridge mounting portion 7 and the first cartridge 4 becoming damaged.

Also, in the above embodiment, the distance Lb from the center 4CX to the portion 341 where the first engaging portion 84 and the first engaged portion 36 are in contact with each other is greater than the distances La1 and La2 from the center 4CX of the liquid supply portion 447 to the portions cp where the contact members 800 and the terminals 930 are in contact with each other (FIG. 14). Also, in the above embodiment, the distance Lb from the center 4CX to the portion 321 where the second engaging portion 85 and the second engaged portion 37 are in contact with each other is greater than the distances La1 and La2 (FIG. 14). Accordingly, the contact portions 341 and 321 can be formed at a position protruding father outward from the outer wall 42 of the first cartridge 4 compared to the contact portions cp. Other constituent members are not densely arranged outside the outer wall 42 of the first cartridge 4. This makes it possible to give a degree of freedom in the shapes and arrangement positions of the first engaged portion 36 and the second engaged portion 37, thus enabling raising the reliability of contact between the contact members 800 and the terminals 930. For example, the first engaged portion 36 can be arranged so as to be adjacent to the lever 421. Also, in terms of shape, the first and second engaged portions 36 and 37 can be formed so as to be hook-shaped.

Also, in the above embodiment, the terminals 930 are arranged between the first engaged portion 36 and the second engaged portion 37. Also, the contact members 800 are arranged between the first engaging portion 84 and the second engaging portion 85. Accordingly, it is possible to generate restricting force Fp on both sides of the terminals 930 by engaging the first and second engaged portions 36 and 37 with the corresponding first and second engaging portions 84 and 85 (FIG. 35). This makes it possible to further raise the reliability of contact between the contact members 800 and the terminals 930.

Also, in this embodiment, the first engaged portion 36 is arranged, relative to the terminals 930, at a position that passes through the plane 95 that includes the planes of the terminals 930 that can come into contact with the contact members 800 (FIG. 16). Specifically, the first engaged portion 36 is, relative to the terminals 930, located in an extending direction of the planes 930*a* of the terminals 930 that can come into contact with the contact members 800 (FIG. 16). This makes it possible to arrange the first engaged portion 36 at a position that passes through the plane 95, thus enabling arranging the first engaged portion 36 at a position in the vicinity of the terminals 930. Specifically, the first recessed portion 34 that receives insertion of the first engaging portion 84 so as to engage therewith can be arranged at a position in the vicinity of the terminals 930. In the mounted state, the first engaged portion 36 (specifically, the first recessed portion 34) that engages with the first engaging portion 84 so as to restrict movement of the terminals 930 is arranged at a position in the vicinity of the terminals 930, thus making it possible to further raise the reliability of contact between the contact members 800 and the terminals 930. Accordingly, it is possible to further raise the reliability of contact between the members 800 and 930 even if the first cartridge 4 is subjected to elastic force Ft in the mounted state.

Also, similarly to the first engaged portion 36, the second engaged portion 37 is also arranged at a position that passes through the plane 95 relative to the terminals 930 (FIG. 17). Specifically, the second engaged portion 37 is, relative to the terminals 930, located in an extending direction of the planes 930*a* of the terminals 930 that can come into contact with the contact members 800. Accordingly, similarly to the first engaged portion 36, the second engaged portion 37 can also be arranged at a position in the vicinity of the terminals 930. This makes it possible to further raise the reliability of contact between the contact members 800 and the terminals 930.

Also, in this embodiment, the first engaged portion 36 has the first opposing portion 342 that opposes the first end portion 84*fb*, which is located on the vertically upward direction side of the first engaging portion 84, in the first cartridge 4 mounting process (FIG. 35). Accordingly, when mounting the first cartridge 4 to the cartridge mounting portion 7, the first end portion 84*fb* collides with the first opposing portion 342, thus making it possible for the distance for which the contact members 800 rub against the terminals 930 to fall in an appropriate range. This makes it possible to raise the reliability of contact between the contact members 800 and the terminals 930. In particular, in this embodiment, the second engaged portion 37, which opposes the first engaged portion 36 with the terminals 930 therebetween, also has the second opposing portion 322 that opposes the second end portion 85*fb* of the printer 10 in the mounting process (FIG. 35). Accordingly, the first cartridge 4 can be prevented from tilting toward the fifth plane 46 side or the sixth plane 47 side using collision of the first end portion 84*fb* with the first opposing portion 342 as well as collision of the second end portion 85*fb* with the second opposing portion 322. In other words, it is possible to prevent the terminals 930 from tilting toward the fifth plane 46 side or the sixth plane 47 side in the mounting process. Also, reliability of contact between the contact members 800 and the terminals 930 can be further raised using the first opposing portion 342 and the second opposing portion 322. For example, it is possible to prevent the rubbing region of the contact members 800 from moving beyond the terminals 930 and arriving at a portion where the terminals 930 are not arranged (member restricting effect). The member restricting effect will be described in further detail below.

As shown in FIG. 33, in the first cartridge 4 mounting process, the second plane 42 side, which opposes the third plane 43 on which the engaged portion 432 is provided, moves in the vertically downward direction by rotating using the engaged portion 432 as the rotation support. In the mounting process, there are cases where the second plane 42 side is pressed farther in the vertically downward direction beyond the mounted state shown in FIG. 35. If the first cartridge 4 is pressed too far in the vertically downward direction in the cartridge mounting portion 7, the distance for which the contact members 800 rub the surface of the circuit substrate 90 is too large. This makes it possible for the contact members 800 to rub portions other than the terminals 930. If the contact members 800 rub portions other than the terminals 930, there are cases where, for example, shavings are created by the stripping of portions of the member on which the terminals 930 are arranged (circuit substrate 90), specifically portions where the terminals 930 are not formed. When an attempt to press the first cartridge 4 too far in the vertically downward direction is made, the first opposing portion 342 and the second opposing portion 322 collide with the first end portion 84*fb* and the second end portion 85*fb* of the cartridge mounting portion 7. The collision of the members 342 and 322 with the members 84*fb* and 85*fb* enables preventing the first cartridge 4 from being pressed too far in the vertically downward direction. This makes it possible for the distance for which the contact members 800 rub the terminals 930 to fall in an appropriate range.

Also, in this embodiment, the first engaged portion 36 and the second engaged portion 37 are both hooks. Specifically, the first engaged portion 36 and the second engaged portion 37 are both plate-shaped members, and respectively have the recessed portions 34 and 32 that are open in the vertically downward direction (FIGS. 10B and 100). The first recessed portion 34 is configured so as to be able to receive insertion of the first engaging portion 84, and the second recessed portion 32 is configured so as to be able to receive insertion of the second engaging portion 85. Accordingly, the first and second engaged portions 36 and 37 can be formed with a simple configuration.

A-11-b: Second Group of Effects

Also, as shown in FIG. 18A, in the above embodiment, the portion 321, the portion 341, and the portions cp are arranged on the same straight line. Accordingly, it is possible to prevent positional shift of the portions of the terminals (contact portions cp) that come into contact with the conductive contact members, compared with the case where the portions 321, 341, and cp are located on different straight lines. In other words, by arranging the portions 321, 341, and cp on the same line, it is possible to shorten the distance between the portions cp and the portion 321 and the distance between the portions cp and the portion 341. This makes it possible to restrict movement of the portions cp using the portions 321 and 341 at positions close to the portions cp.

In this embodiment, it is possible to prevent movement of the terminals 930 relative to the contact members 800 in three orthogonal directions (the X axis direction, the Y axis direction, and the Z axis direction). In other words, in this embodiment, it is possible to restrict the terminals 930 from moving so as to separate from the contact members 800. The following describes the reason for this in detail.

Restriction of Movement in X Axis Direction

Even if external force is applied to the first cartridge 4 such that the terminals 930 move in the X axis direction, as shown in FIG. 36, the side planes 31 and 33 of the arrangement portion 39 and the side plane of the circuit substrate 90 collide with the first and second engaging portions 84 and 85. This enables restricting movement of the terminals 930 in the X axis direction.

Restriction of Movement in Y Axis Direction

Even if external force (e.g., the external force Ft) is applied to the first cartridge 4 such that the terminals 930 move in the −Y axis direction, as shown in FIG. 35, movement of the terminals 930 in the −Y axis direction can be restricted by the engagement of the first engaged portion 36 with the first engaging portion 84. Similarly, movement of the terminal 930 in the −Y axis direction can be restricted by the engagement of the second engaged portion 37 with the second engaging portion 85.

Restriction of Movement in Z Axis Direction

Even if external force is applied to the first cartridge 4 such that the terminals 930 move in the −Z axis direction, as shown in FIG. 35, movement of the terminals 930 in the −Z axis direction can be restricted by the first engaged portion 36 colliding with the first engaging portion 84. Similarly, movement of the terminal 930 in the −Z axis direction can be restricted by the second engaged portion 37 colliding with the second engaging portion 85.

Even if external force (e.g., the external force FtZ shown in FIG. 34) is applied to the first cartridge 4 such that the terminals 930 move in the +Z axis direction, as shown in FIG. 31, movement of the terminals 930 in the +Z axis direction can be restricted by the engagement of the lever 421 with the mounting/removal portion 722.

Also, due to the members 36, 37, 90, 46, 47, and 421 for restricting movement of the terminals 930 in three directions in the mounted state being provided on the second plane 42 on which the terminals 930 are provided, it is possible for the movement restricting members to be arranged so as to be adjacent to the terminals 930. This enables the members 36, 37, 90, 46, 47, and 421 to more precisely restrict movement of the terminals 930.

A-11-c: Other Effects

In the above embodiment, as shown in FIG. 14, the engaged portion 445 and the first engaged portion 36 have the first positional relationship. Accordingly, the engaged portion 445 and the first engaged portion 36 can be arranged at separated positions. As shown in FIG. 14, there are cases where in the mounted state, the first cartridge 4 is subjected to an external force according to which the third plane 43 side of the first cartridge 4 rotates in an arrow ST direction with the first engaged portion 36 serving as the support. The arrow ST direction is a direction that conforms to the XY plane. In such cases, it is possible to restrict movement of the third plane 43 side of the first cartridge 4 in the arrow ST direction due to the engaged portion 445 being arranged at a position separated from the first engaged portion 36.

Also, in the above embodiment, as shown in FIG. 16, the level change 442 is formed within a path from the liquid supply portion 447 on the outer surface of the first cartridge 4 to the terminals 930. Accordingly, even if ink leaks out of the liquid supply portion 447, the level change 442 enables reducing the possibility of the leaked ink reaching the terminals 930. This makes it possible to more favorably maintain contact between the terminal 930 and the contact member 800.

B: Second Embodiment

Figure 38:
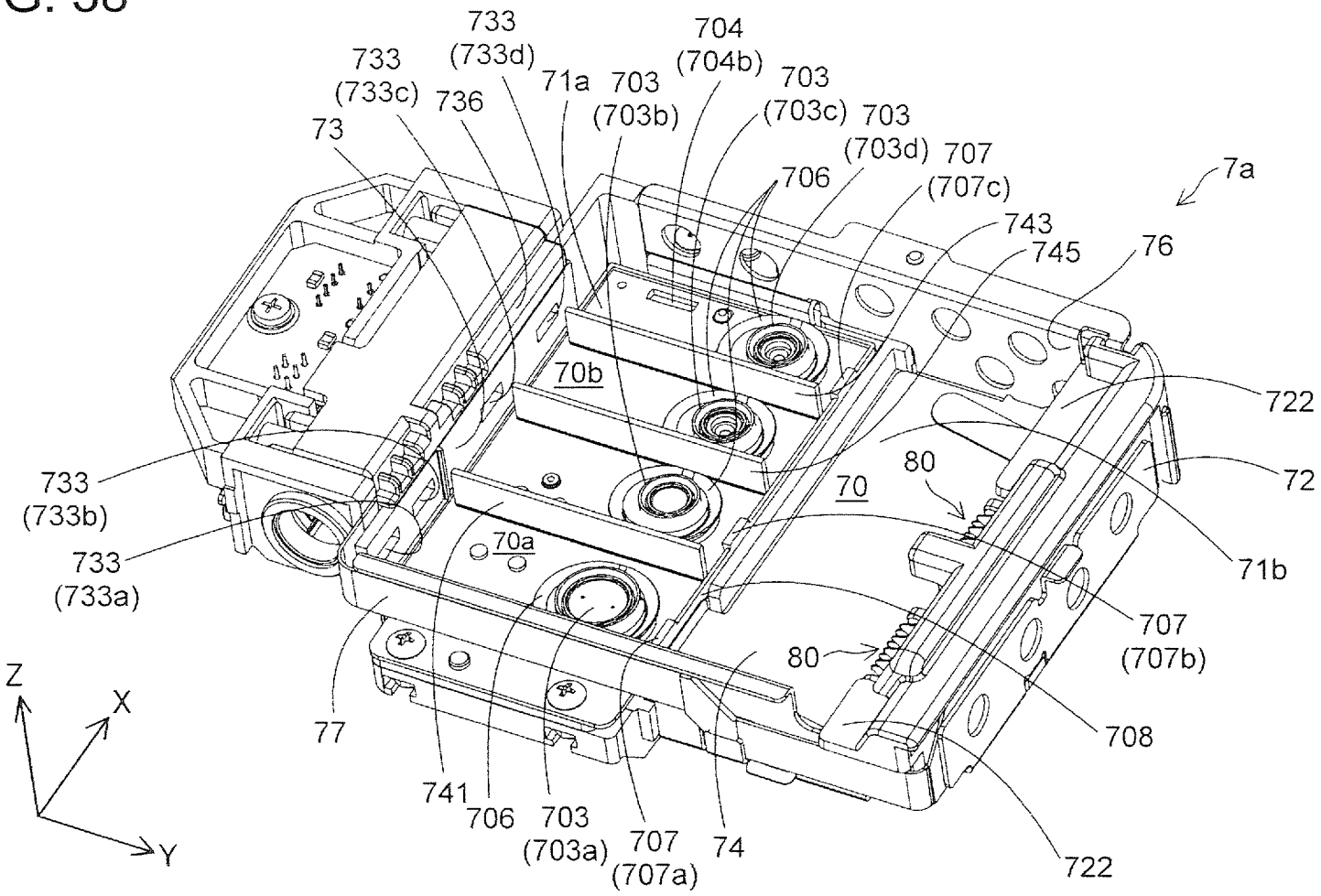
FIG. 38 is a diagram for describing a cartridge mounting portion according to a second embodiment.

FIG. 38 is a diagram for describing a cartridge mounting portion 7*a* of a second embodiment. A difference between the cartridge mounting portion 7*a* and the cartridge mounting portion 7 (FIG. 4A) of the first embodiment is that the cartridge mounting portion 7*a* includes partition walls 743 and 745. Since the other configurations are similar to those of the cartridge mounting portion 7, the same reference signs will be used for the similar configurations, and descriptions will not be given for them. Besides the cartridge mounting portion 7*a*, the configuration of the printer 10 is also similar to the configuration in the first embodiment.

The partition walls 743 and 745 extend in the vertically upward direction from the device-side bottom wall 74. They are located between the liquid introduction portion 703*c* and the liquid introduction portion 703*d*. The partition wall 745 is located between the liquid introduction portion 703*b* and the liquid introduction portion 703*c*.

Figure 39:
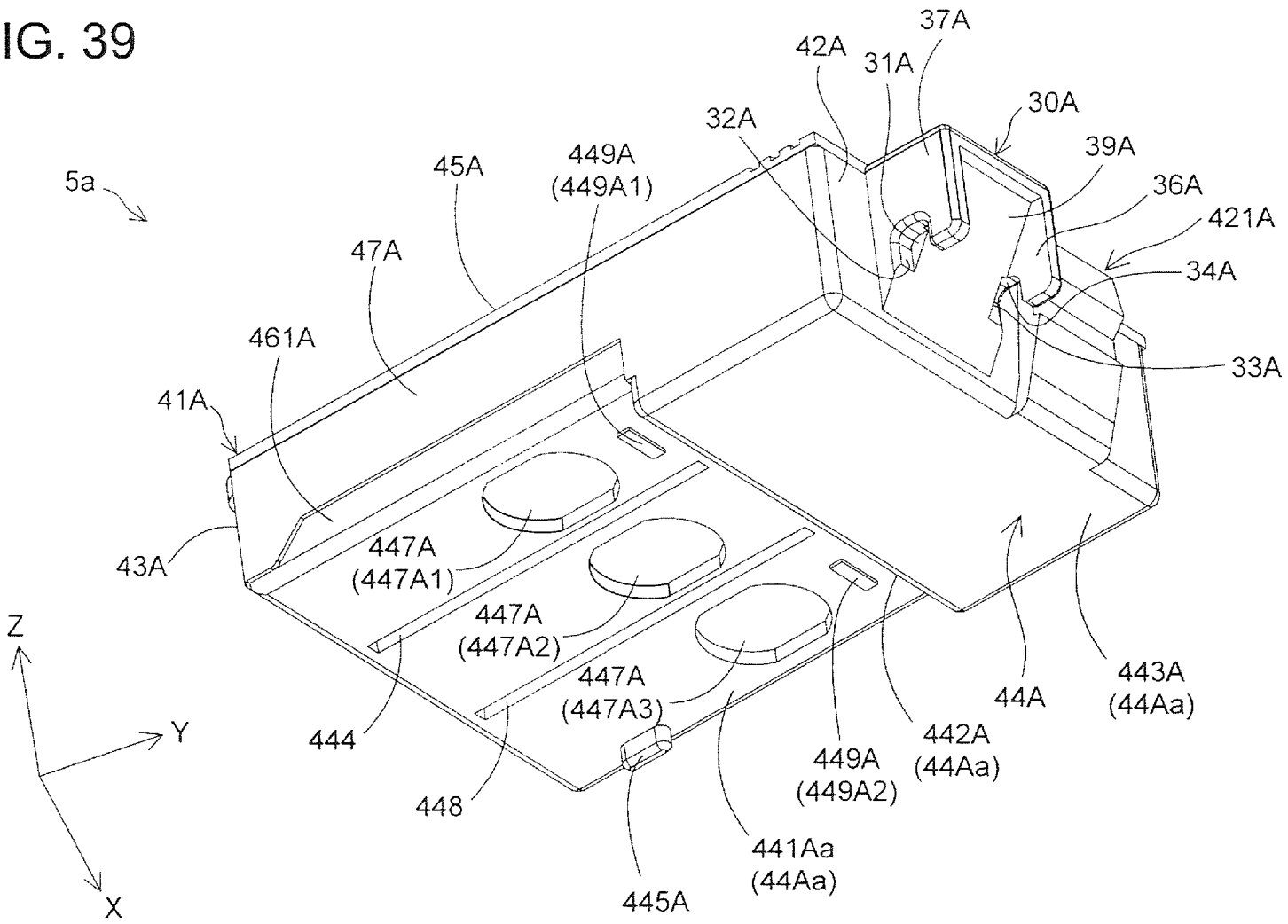
FIG. 39 is a diagram for describing a second cartridge according to the second embodiment.
Figure 40:
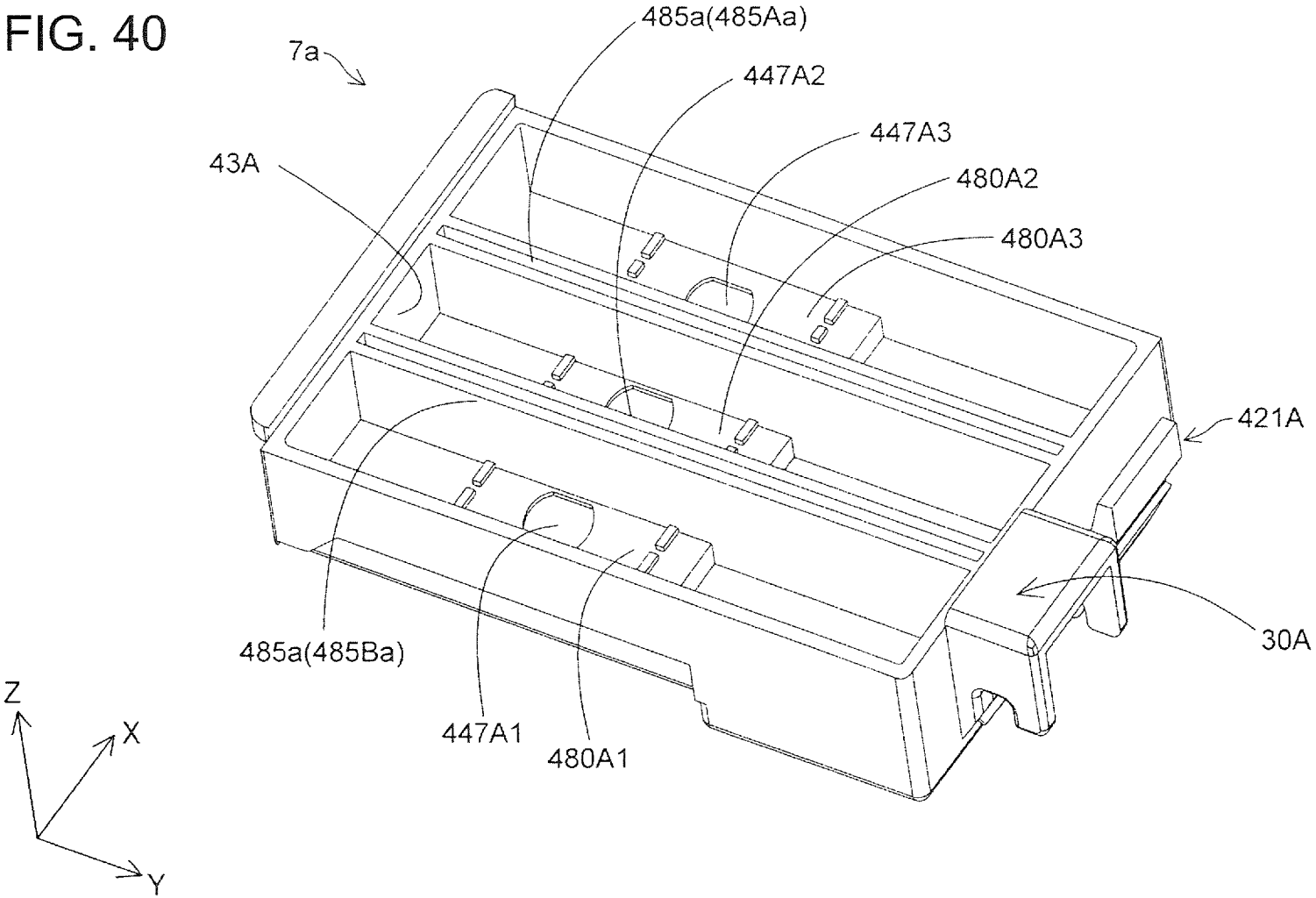
FIG. 40 is a diagram for describing the second cartridge according to the second embodiment.

FIG. 39 is a diagram for describing a second cartridge 5*a* of the second embodiment. FIG. 40 is a diagram for describing the second cartridge 5*a* of the second embodiment. A difference between the second cartridge 5*a* and the second cartridge 5 (FIG. 21) of the first embodiment is that groove portions 444 and 448 are formed in the first section plane 441A of the first plane 44A. Since the other configurations are similar to those of the second cartridge 5, the same reference signs will be used for the similar configurations, and descriptions will not be given for them.

As shown in FIG. 39, the groove portion 448 is formed between the liquid supply portion 447A2 and the liquid supply portion 447A3. The groove portion 444 is formed between the liquid supply portion 447A1 and the liquid supply portion 447A2. The groove portion 444 is configured so as to be able to receive insertion of the partition wall 745. The groove portion 448 is configured so as to be able to receive insertion of the partition wall 743.

As shown in FIG. 40, the partition wall 485Aa and the partition wall 485Ba define the liquid storage portions 480A1 to 480A3. A groove is formed in the end portion of each of the partition walls 485Aa and 485Ba on the +Z axis direction side.

In this embodiment, in the mounted state, the groove portions 444 and 448 of the second cartridge 5*a* receive insertion of the corresponding partition walls 745 and 743. This enables preventing movement of the second cartridge Sa in the X axis direction in the mounted state. Accordingly, in the mounted state, it is possible to prevent positional shift between the liquid introduction portions 703*b* to 703*d* and the liquid supply portions 447A1 to 447A3, and to introduce ink from the second cartridge 5*a* to the liquid introduction portions 703*b* to 703*d*.

C: Third Embodiment

C-1: Configuration and Effects of Second Cartridge 5*b*

Figure 41:
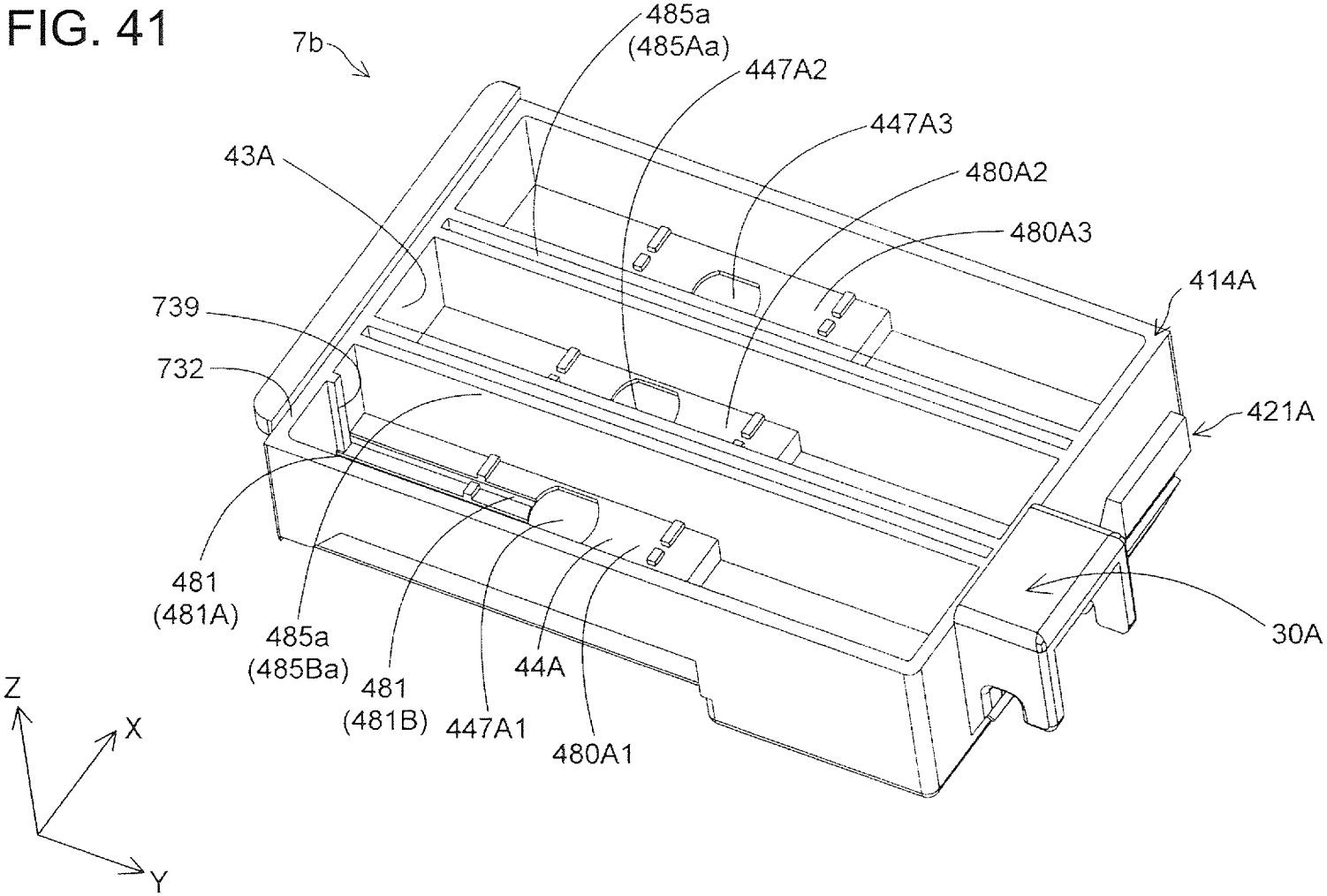
FIG. 41 is a diagram for describing a second cartridge according to a third embodiment.
Figure 42:
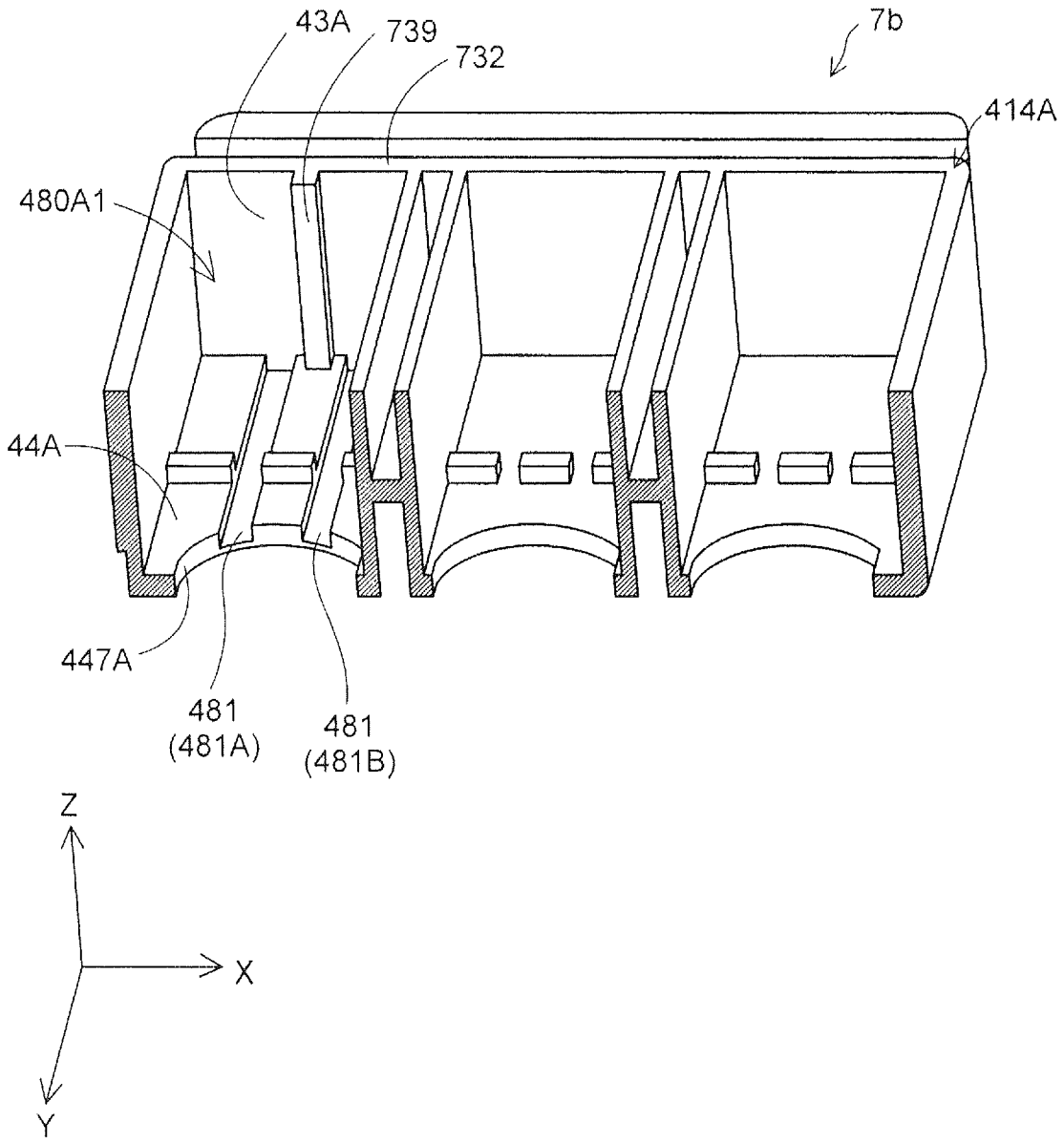
FIG. 42 is a cutaway view of the second cartridge according to the third embodiment.
Figure 43:
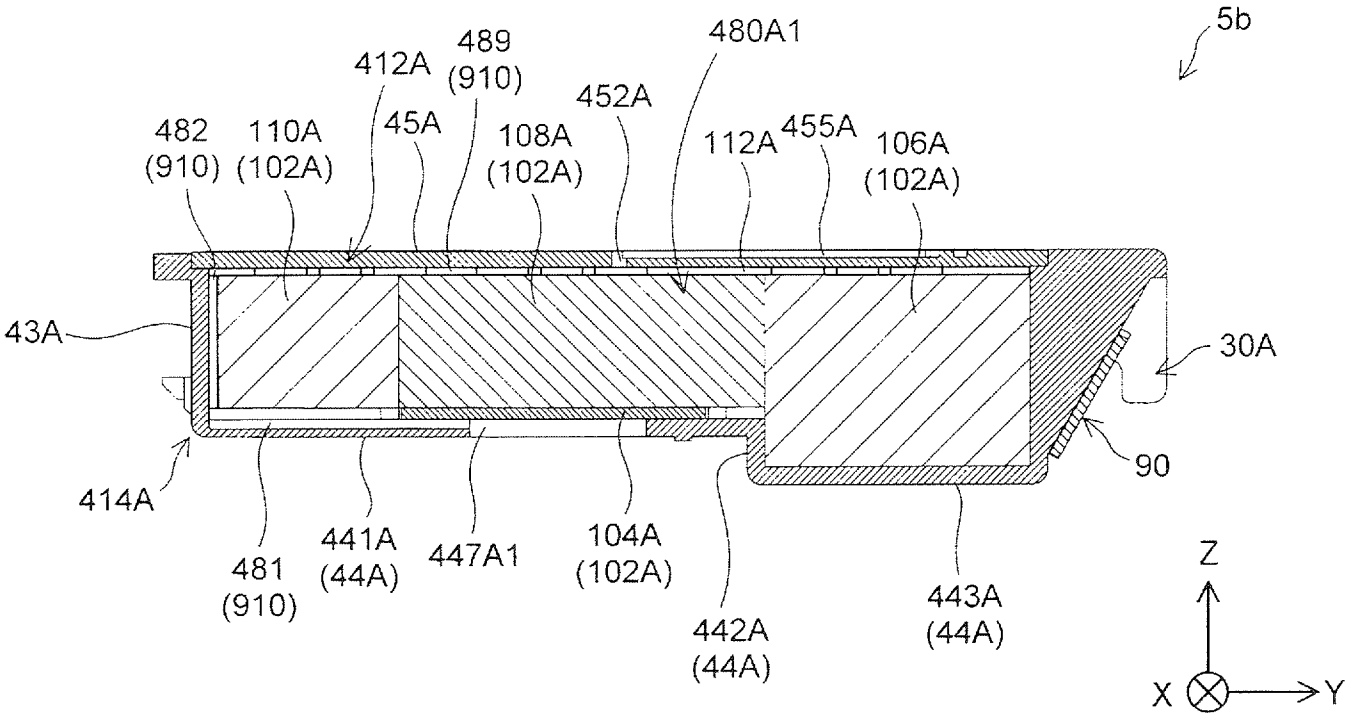
FIG. 43 is a cross-sectional view of the second cartridge.

FIG. 41 is a diagram for describing a second cartridge 5*b* of a third embodiment. FIG. 42 is a cutaway view of the second cartridge 5*b* of the third embodiment. FIG. 43 is a cross-sectional view of the second cartridge 5*b*. A difference between the second cartridge 5*b* and the second cartridge 5*a* (FIG. 40) of the second embodiment is that the second cartridge 5*b* has an interior release flow channel 910 (FIG. 43). Since the other configurations are similar to those of the second cartridge 5*a* (FIG. 40), the same reference signs will be used for the similar configurations, and descriptions will not be given for them. Also, the configuration of the printer to which the second cartridge 5*b* is mounted is similar to the configuration of the printer of the second embodiment.

As shown in FIGS. 41 and 42, two grooves 481A and 481B that extend from the liquid supply portion 480A1 to the third plane 43A are formed in the first plane 44A, which is one of the inner planes of the liquid storage portion 480A1. Also, a protrusion portion 739 is formed on the third plane 43A, which is one of the inner planes of the liquid storage portion 480A1. The protrusion portion 739 extends from the first plane 44A (bottom plane 44A) of the container body 414A to the end wall 732 that forms the opening. Here, the reference sign "481" will be used when referring to the two grooves 481A and 481B collectively.

As shown in FIG. 43, the second cartridge 5*b* has an interior release flow channel 910 for putting the liquid storage portion 480A1 in communication with the liquid supply portion 447A1 and the outside. One end of the interior release flow channel 910 is connected to the liquid supply portion 447A1, and the other end is connected to the air release flow channel 450. The interior release flow channel 910 has a first flow channel 481, a second flow channel 482, and a third flow channel 489 in the stated order from the one end to the other end.

The first flow channel 481 is defined by the gap between one of the grooves 481 and the holding member 102A. The second flow channel 482 is defined by the gap between the third plane 43A and the holding member 102A, which is formed by the protrusion portion 739. The third flow channel 489 is defined by the gap between the holding member 102A and the cover member 412A.

Here, in the mounting process for mounting the second cartridge 5*b* to the cartridge mounting portion 7*a*, there are cases where air flows into the liquid storage portion 480A1 via the liquid supply portion 447A1. In this embodiment, the second cartridge 5*b* has the interior release flow channel 910 for putting the liquid supply portion 447A1 and the outside in communication with each other. Accordingly, even if air flows into the liquid storage portion 480A1 via the liquid supply portion 447A1, the inflow air can be allowed to escape to the outside via the interior release flow channel 910. This enables reducing the possibility of the inflow air being retained in the vicinity of the liquid supply portion 447A1, and enables reducing the possibility of air being introduced to the liquid introduction portion 703. Reducing the introduction of air to the liquid introduction portion 703 enables reducing the occurrence of problems such as so-called blank firing of the printer 10.

C-2: Modified Example of Third Embodiment

C-2-1: First Modified Example

Although the interior release flow channel 910 is formed in the liquid storage portion 480A1 in the third embodiment, it may be formed in another liquid storage portion. For example, the interior release flow channel 910 may be formed in all of the liquid storage portions 480A1 to 480A3 of the second cartridge 5*b*, and the interior release flow channel 910 may be formed in the first cartridge 4. Also, the interior release flow channel 910 may be formed in the cartridges 4 and 5 of the first embodiment and the cartridge 5*a* of the second embodiment.

C-2-2: Second Modified Example

Although the first flow channel 481 is formed by providing a groove 481 in the third embodiment, the first flow channel 481 may be formed by providing a protrusion portion instead of the groove 481. Also, although the second flow channel 482 is formed by providing the protrusion portion 739, the second flow channel 482 may be formed by providing a groove instead of the protrusion portion 739 in the third plane 43A. Also, although the third flow channel 489 is formed by the gap between the holding member 102A and the cover member 412A, the third flow channel 489 may be formed by providing a groove in the inner plane of the cover member 412A.

D: Modified Examples Regarding Configuration of Cartridge

D-1: Modified Examples Regarding Outer Shape of Cartridge

Figure 44:
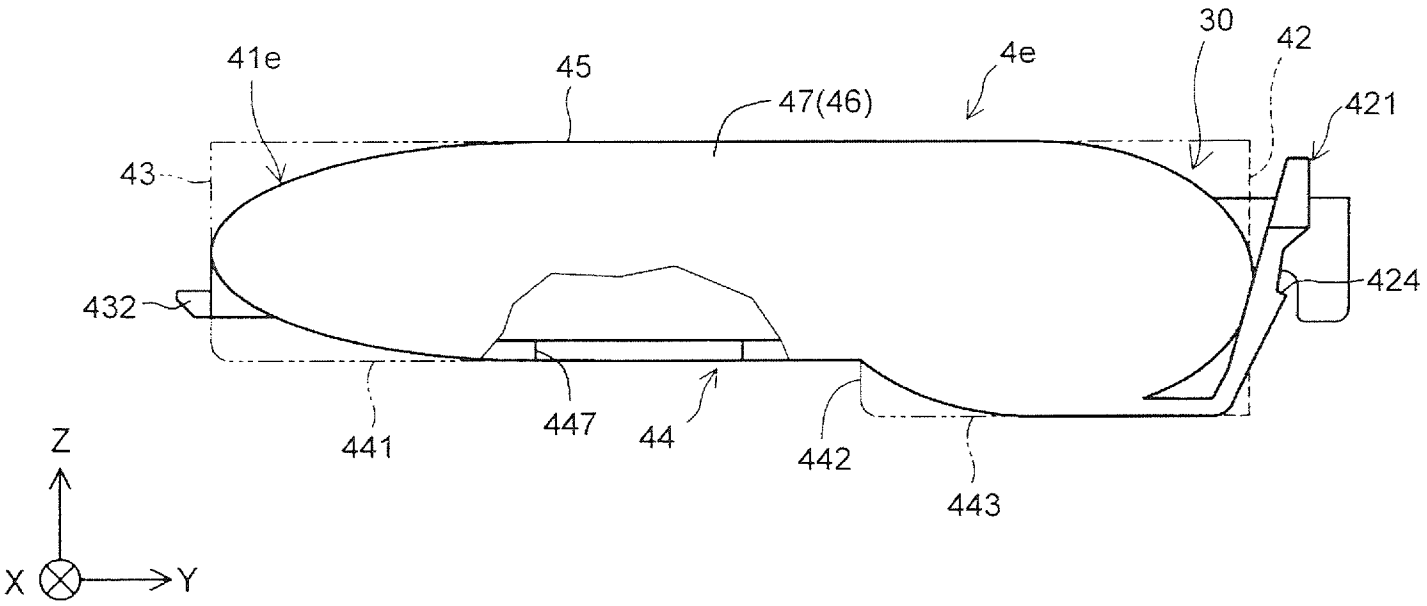
FIG. 44 is a conceptual diagram showing the shape of a cartridge according to a first modified example.
Figure 45:
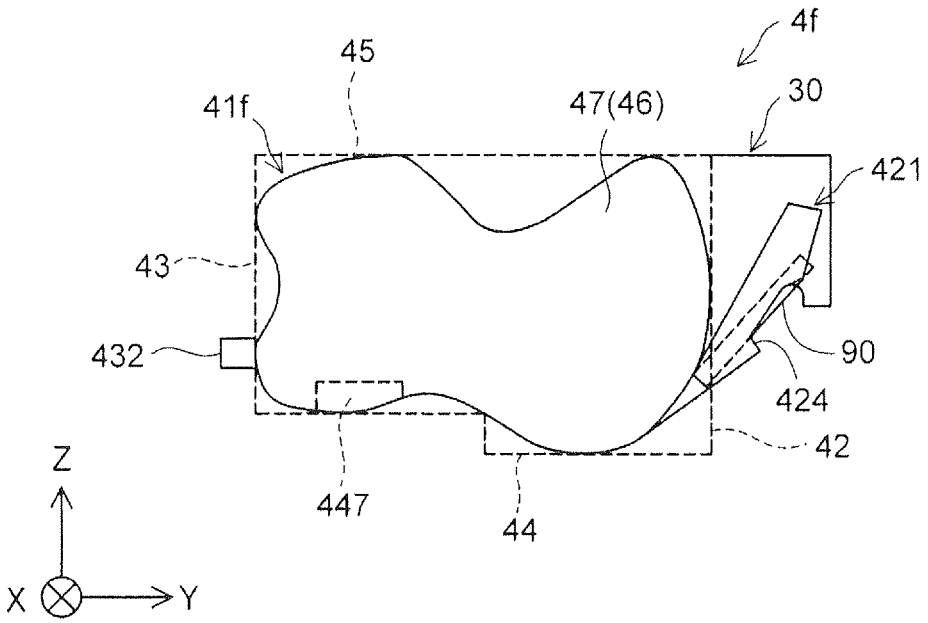
FIG. 45 is a conceptual diagram showing the shape of a cartridge according to a second modified example.
Figure 46:
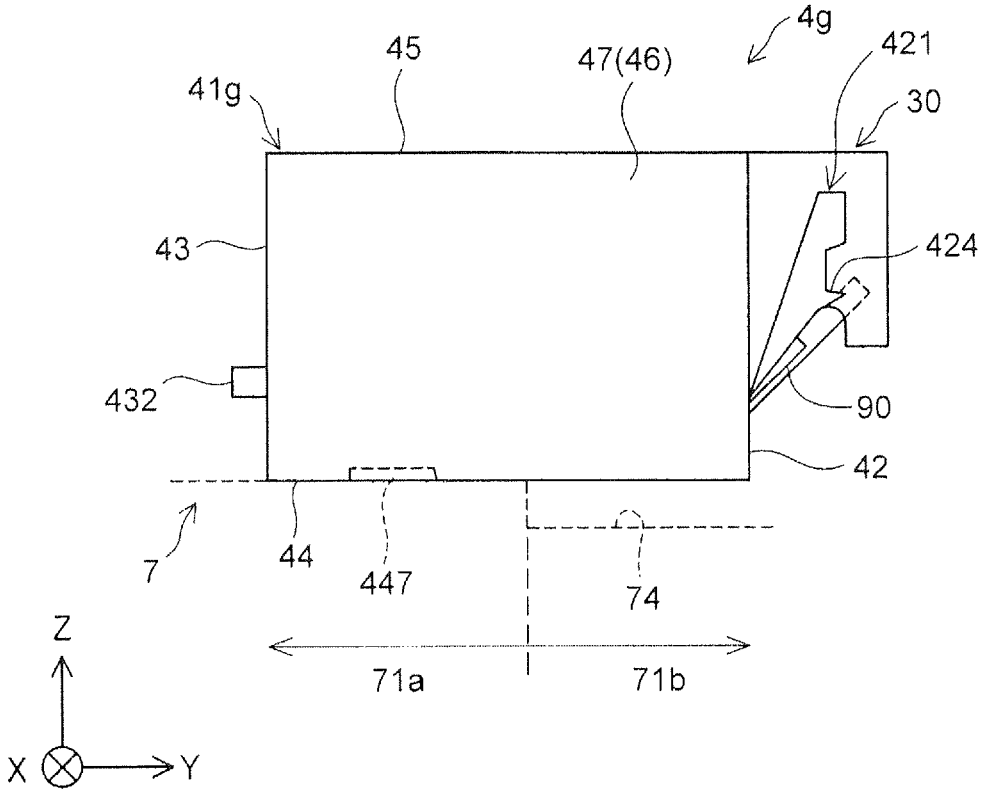
FIG. 46 is a conceptual diagram showing the shape of a cartridge according to a third modified example.
Figure 47:
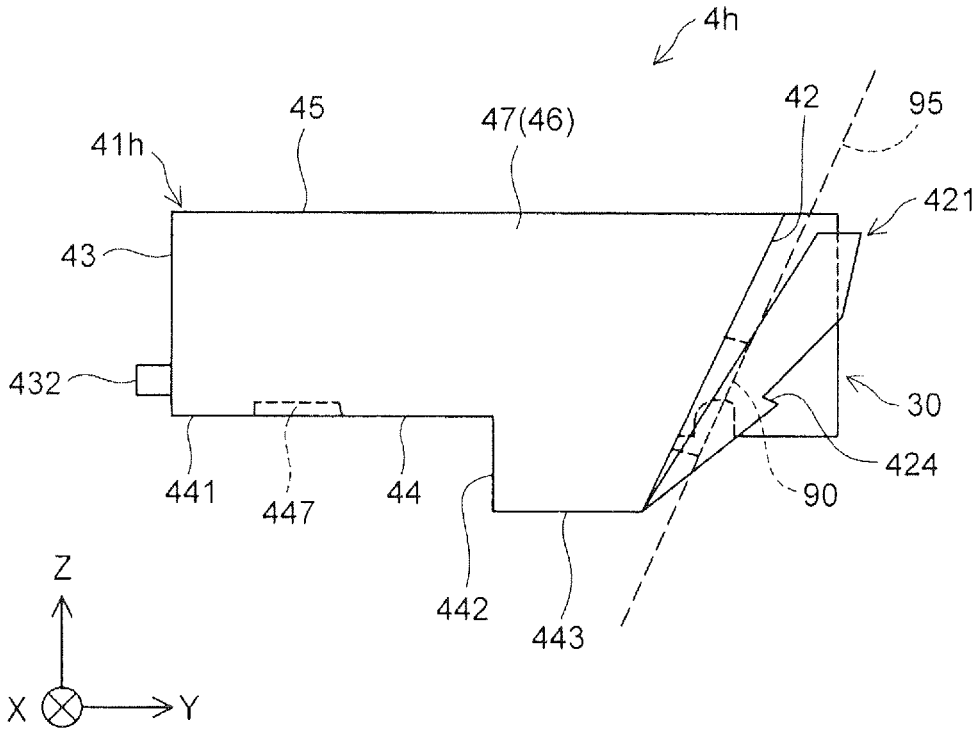
FIG. 47 is a conceptual diagram showing the shape of a cartridge according to a fourth modified example.

FIGS. 44 to 47 show modified examples regarding the outer shape of the cartridge. The following modified examples can be applied to the first cartridge 4 and the second cartridges 5, 5*a*, and 5*b* described in the above embodiments. The following description is given taking the example of the first cartridge 4. FIG. 44 is a conceptual diagram showing the shape of a cartridge according to a first modified example. FIG. 45 is a conceptual diagram showing the shape of a cartridge according to a second modified example. FIG. 46 is a conceptual diagram showing the shape of a cartridge according to a third modified example. FIG. 47 is a conceptual diagram showing the shape of a cartridge according to a fourth modified example.

An outer shell 41*e* of a cartridge 4*e* shown in FIG. 44 has curved side planes. Examples of the shape of the outer shell 41*e* include a shape that is a combination of curved planes and flat planes as shown in FIG. 44, and an elliptical shape. The cartridge 4*e* has the engaged portion 432 on the third plane 43 side. The cartridge 4*e* also has the liquid supply portion 447 on the first plane 44 side. The cartridge 4*e* also has the contact mechanism 30 and the lever 421 on the second plane 42 side. The cartridge 4*e* has a constant width. As described above, the cartridge 4*e* is provided with the engaged portion 432, the liquid supply portion 447, the contact mechanism 30, and the lever 421 in correspondence with the members of the printer 10. The cartridge 4*e* is interchangeable with the cartridge 4. In other words, the cartridge 4*e* can be removably mounted to the cartridge mounting portion 7 of the printer 10.

The side planes of an outer shell 41*f* of a cartridge 4*f* shown in FIG. 45 are formed by curved planes. The cartridge 4*f* shown in FIG. 45 is interchangeable with the cartridge 4, and therefore can be removably mounted to the cartridge mounting portion 7.

An outer shell 41*g* of a cartridge 4*g* shown in FIG. 46 is shaped as a parallelepiped. The height dimension of the cartridge 4*g* corresponds to the height dimension of the device compartment 71*a*, which is the shallowest in the cartridge mounting portion 7. In other words, a gap is partially formed between the first plane 44 of the cartridge 4*g* and the device-side bottom wall 74. The cartridge 4*g* shown in FIG. 46 is interchangeable with the cartridge 4, and therefore can be removably mounted to the cartridge mounting portion 7.

A cartridge 4*h* shown in FIG. 47 has an inclined second plane 42. The second plane 42 is inclined so as to be parallel to the plane 95 that includes the contact portions cp of the terminals 930. With the cartridge 4*h*, the second plane 42 itself has the function of the arrangement portion 39 (FIG. 10A). The cartridge 4*g* shown in FIG. 47 is interchangeable with the cartridge 4, and therefore can be removably mounted to the cartridge mounting portion 7.

As can be understood from the various examples shown in FIGS. 44 to 47, various modified examples are conceivable for the outer shape of the cartridge. Even when the outer shape of the cartridge is different from the shapes in the above embodiments, it can be said that the cartridges 4*e* to 4*h* virtually have six planes that correspond to the planes of the cartridge 4 of the embodiments, as shown by broken lines or straight lines in FIGS. 44 to 47, for example. Specifically, they can be virtually thought of as having the first plane 44 (bottom plane 44), the second plane 42 (front plane 42), the third plane 43 (rear plane 43), the fourth plane 45 (upper plane 45), the fifth plane 46 (right side plane 46), and the sixth plane 47 (left side plane 47) shown in FIGS. 10A and 16. In this specification, the term "plane" can be used with a meaning that encompasses both virtual planes (also called non-existent planes) and existent planes such as those shown in FIGS. 10A and 16. Also, the term "plane" is used with a meaning that encompasses both flat planes and curved planes.

Also, with the cartridge that introduces ink to the printer 10, from the viewpoint of raising the reliability of contact between the terminals 930 of the circuit substrate 90 and the contact members 800 of the printer 10, the cartridge 4 need only include at least the contact mechanism 30 and the contact portion 424. It is preferable that the contact portion 424 is located on the same side as the side on which the contact mechanism 30 is provided (the second plane 42 side). The engaged portion 432 can be omitted.

D-2: Modified Examples Regarding Layout Configuration of Circuit Substrate 90

Figure 48:
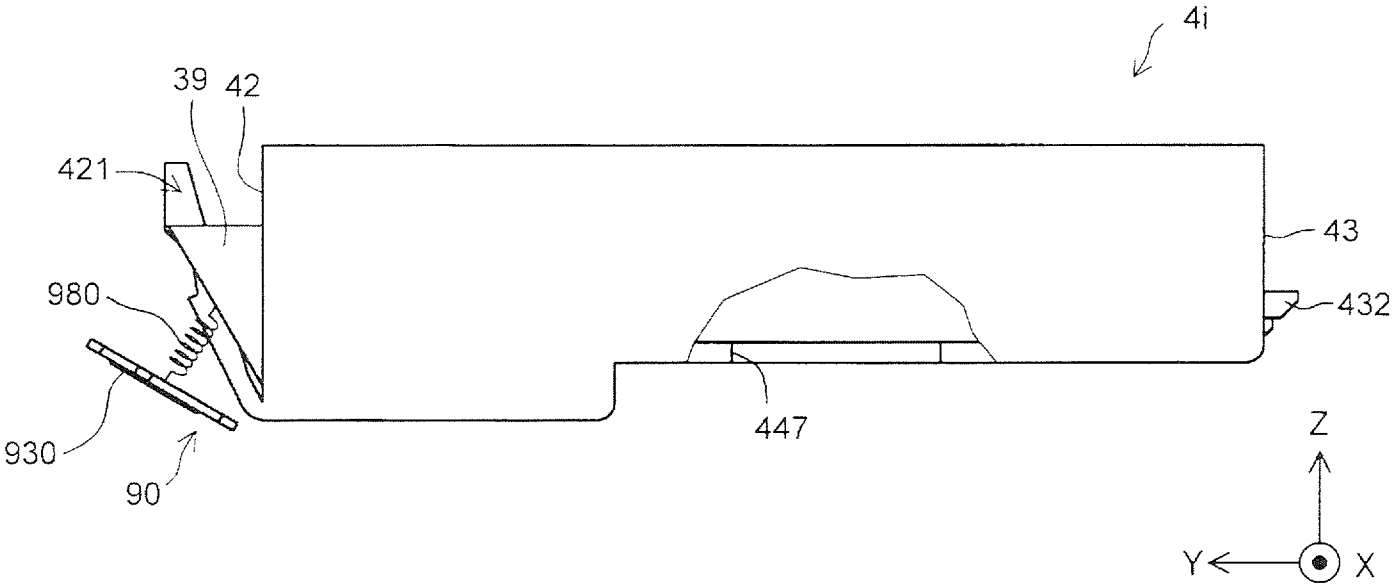
FIG. 48 is a conceptual diagram showing a layout configuration of a circuit substrate according to a first modified example.
Figure 49:
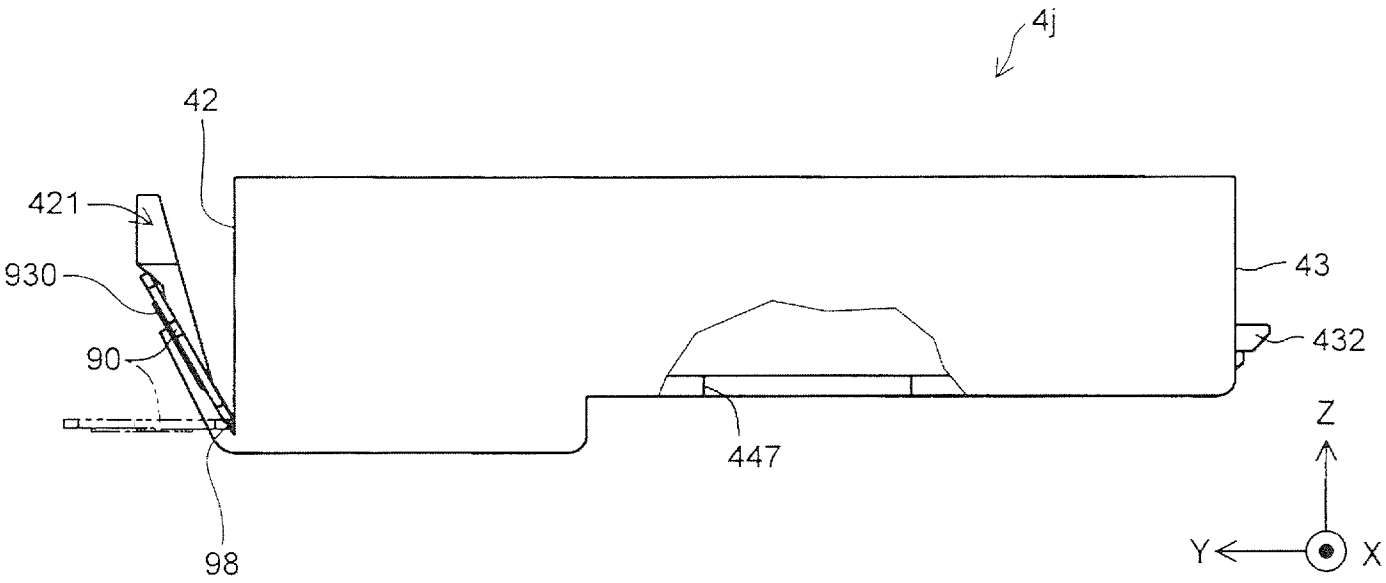
FIG. 49 is a conceptual diagram showing a layout configuration of a circuit substrate according to a second modified example.
Figure 50:
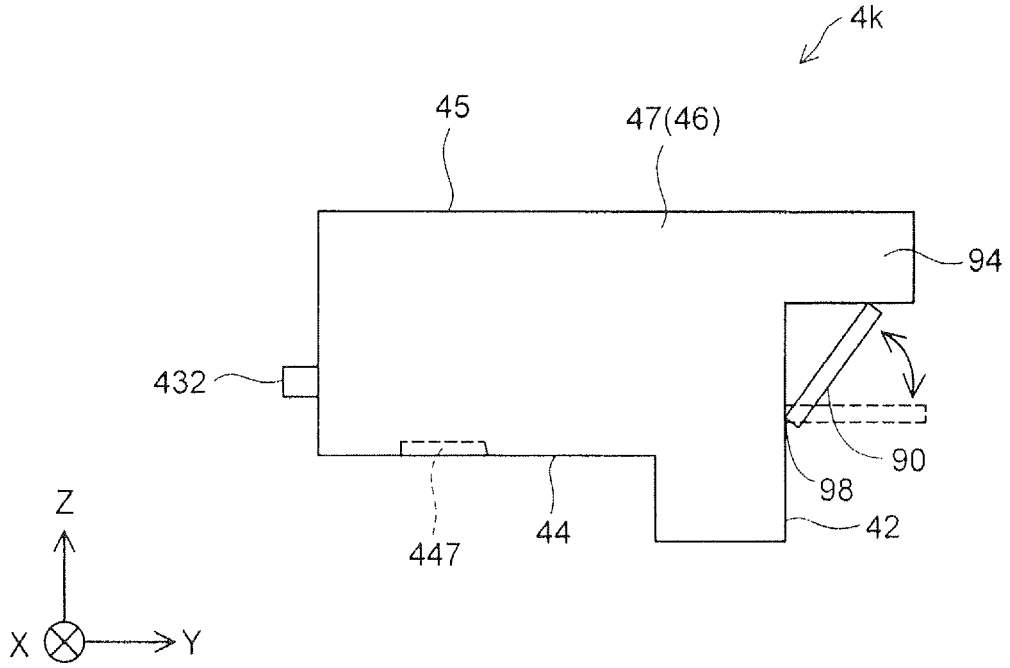
FIG. 50 is a conceptual diagram showing a layout configuration of a circuit substrate according to a third modified example.

FIGS. 48 to 50 show modified examples regarding the layout configuration of the circuit substrate 90. The following modified examples can be applied to the first cartridge 4 and the second cartridges 5, 5*a*, and 5*b* described in the above embodiments. The following description is given taking the example of the first cartridge 4. FIG. 48 is a conceptual diagram showing the layout configuration of the circuit substrate 90 according to a first modified example. FIG. 49 is a conceptual diagram showing the layout configuration of the circuit substrate 90 according to a second modified example.

FIG. 50 is a conceptual diagram showing the layout configuration of the circuit substrate 90 according to a third modified example.

The circuit substrate 90 of a cartridge 4*i* shown in FIG. 48 is attached to the arrangement portion 39 via a spring 980. In the mounted state, the circuit substrate 90 is located above the arrangement portion 39 due to the elastic force Ft of the contact members 800 (FIG. 7A). The other configurations of the cartridge 4*i* are similar to the configurations of the cartridge 4 of the first embodiment. For example, although not shown, the cartridge 4*i* includes the first engaged portion 36 and the second engaged portion 37 (FIG. 11).

The circuit substrate 90 of a cartridge 4*j* shown in FIG. 49 has a rotation support 98. Accordingly, the circuit substrate 90 is configured so as to be able to rotate using the rotation support 98 as the support. In the mounting process, the circuit substrate 90 is subjected to external force due to the contact members 800 (FIG. 7A) and the circuit substrate 90 coming into contact with each other. Accordingly, the circuit substrate 90 rotates from the position indicated by broken lines to the position indicated by solid lines. In the mounted state, the circuit substrate 90 is arranged at the position indicated by solid lines. In the mounted state, the terminals 930 of the circuit substrate 90 and the contact members 800 are in contact with each other. The other configurations of the cartridge 4*i* except for the arrangement portion 39 are similar to the configurations of the cartridge 4 of the first embodiment. For example, although not shown, the cartridge 4*j* includes the first engaged portion 36 and the second engaged portion 37 (FIG. 11). The cartridge 4*j* does not include the arrangement portion 39. Note that the cartridge 4*j* may include the arrangement portion 39.

Similarly to the cartridge 4*j*, the circuit substrate 90 of a cartridge 4*k* shown in FIG. 50 has the rotation support 98. A difference from the cartridge 4*j* is that the cartridge 4*k* includes a restriction portion 94 that restricts rotation of the circuit substrate 90. The restriction portion 94 protrudes from the second plane 42. In the mounted state, the circuit substrate 90 is arranged at the position indicated by solid lines. In other words, in the mounted state, the state (orientation) of the circuit substrate 90 is stabilized due to the upper end portion of the circuit substrate 90 coming into contact with the restriction portion 94.

The above-described cartridges 4*i* to 4*k* are interchangeable with the cartridge 4, and therefore can be removably mounted to the cartridge mounting portion 7.

Note that although the terminals 930 are provided on the surface of the circuit substrate 90 in the embodiments and modified examples of this specification, a configuration is possible in which the circuit substrate 90 is omitted, and the terminals 930 are provided directly on the surface of the container body 414 of the cartridge 4. For example, they may be provided directly on the outer plane 39*a* (FIG. 10A) of the arrangement portion 39.

D-3: Cartridge Employing an Adapter

Figure 51:
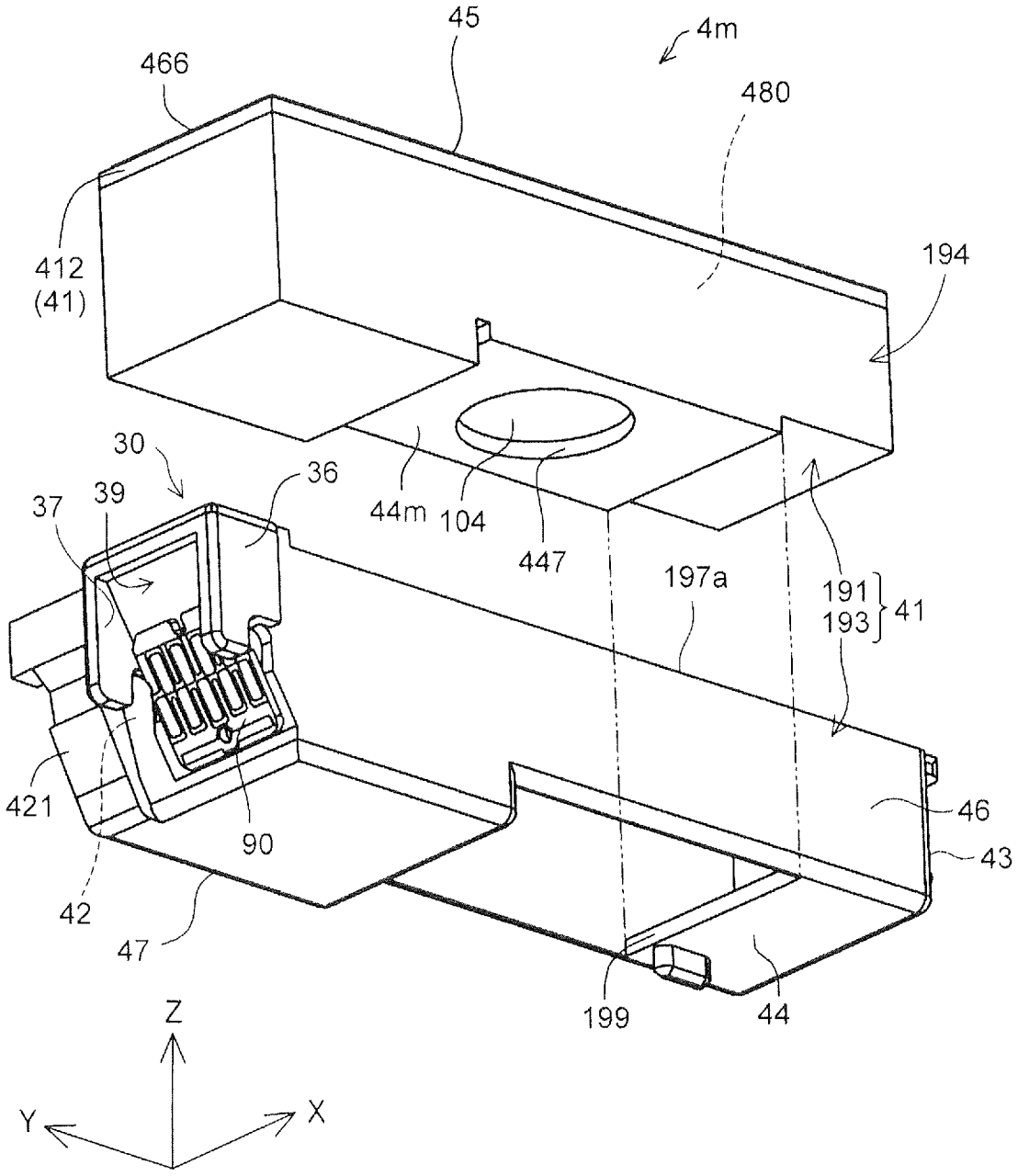
FIG. 51 is a perspective view showing a configuration of a cartridge that employs an adapter.
Figure 52:
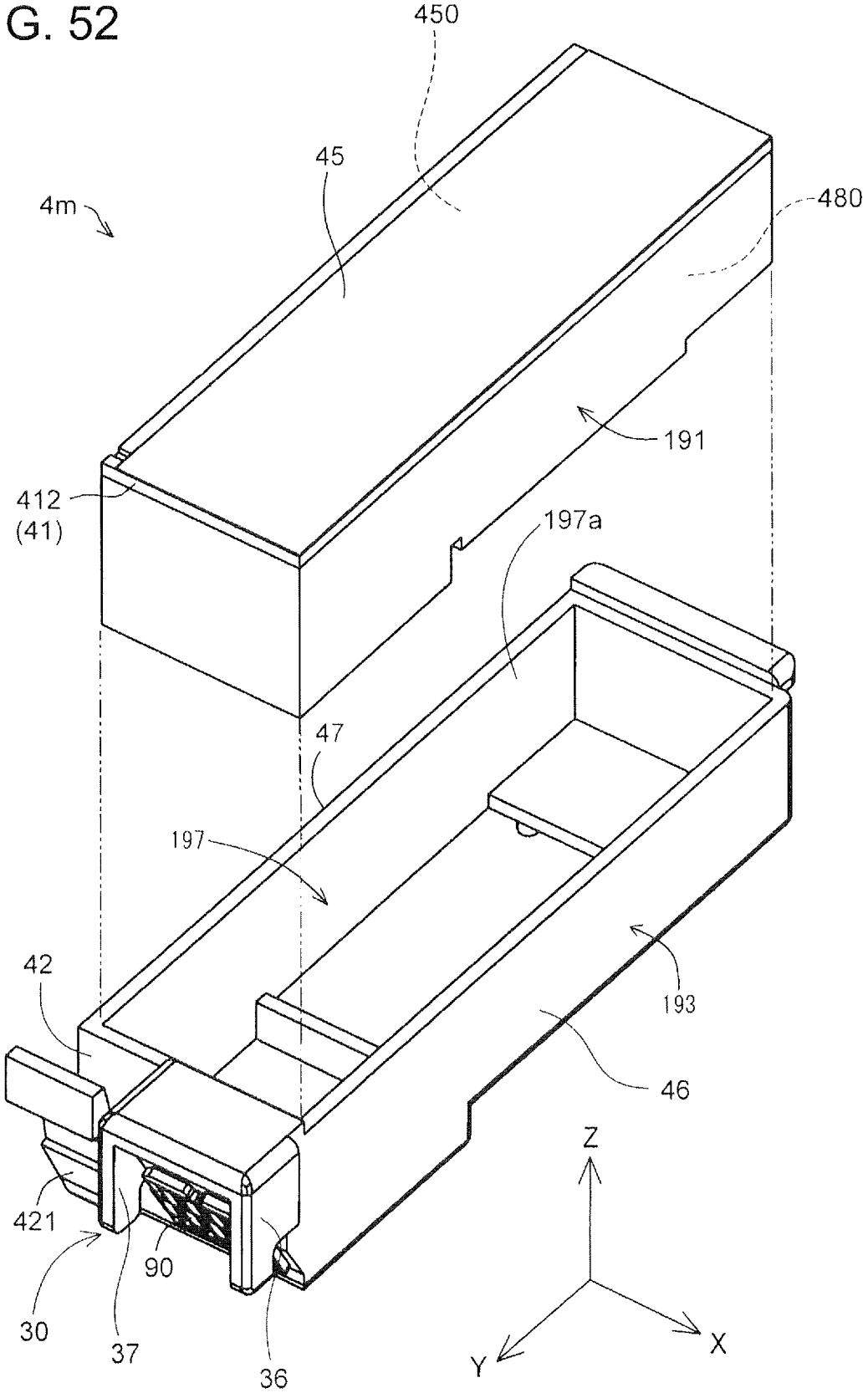
FIG. 52 is a perspective view showing the configuration of the cartridge that employs an adapter.

FIG. 51 is a perspective view showing the configuration of a cartridge 4*m* that employs an adapter. FIG. 52 is a perspective view showing the configuration of the cartridge 4*m* that employs an adapter. The cartridge 4*m* can be separated into an adapter 193 and a storage member 191 that has the liquid storage portion 480. When the ink in the storage member 191 has run out, the user replaces the storage member 191 with a new one, or fills the storage member 191 with ink. The adapter 193 is reusable. The cartridge 4*m* is interchangeable with the cartridge 4 (FIG. 9) of the first embodiment.

As shown in FIG. 51, the outer shell 41 of the cartridge 4*m* is configured by a combination of the outer shell of the storage member 191 and the outer shell of the adapter 193. The storage member 191 constitutes the fourth plane 45 of the outer shell 41 of the cartridge 4*m*. The storage member 191 has the liquid storage portion 480 that stores ink, and the liquid supply portion 447 for connection with the liquid introduction portion 703 of the printer 10. A holding member containing the first liquid holding member 104 is stored inside the storage member 191. As shown in FIG. 52, the storage member 191 has the cover member 412 in which the air release flow channel 450 is formed. The cover member 412 may be removably attached to the storage member body 194, or may be non-removably attached through adhesion or the like.

The adapter 193 constitutes the first plane 44, the second plane 42, the third plane 43, the fifth plane 46, and the sixth plane 47 of the outer shell 41 of the cartridge 4*m*. An opening 197*a* is formed in the plane of the adapter 193 that corresponds to the second plane. As shown in FIG. 52, a receiving portion 197, which is a space for receiving insertion of the storage member 191, is formed inside the adapter 193. Also, an opening 199 is formed in the first plane 44 at a position that corresponds to the liquid supply portion 447. When the storage member 191 is accommodated in the receiving portion 197 of the adapter 193, the liquid supply portion 447 can be connected to the liquid introduction portion 703 via the opening 199. The adapter 193 is provided with members corresponding to members of the cartridge mounting portion 7 such as the contact mechanism 30 and the lever 421. As described above, the cartridge 4*m* may be constituted by the storage member 191 and the adapter 193.

Figure 53:
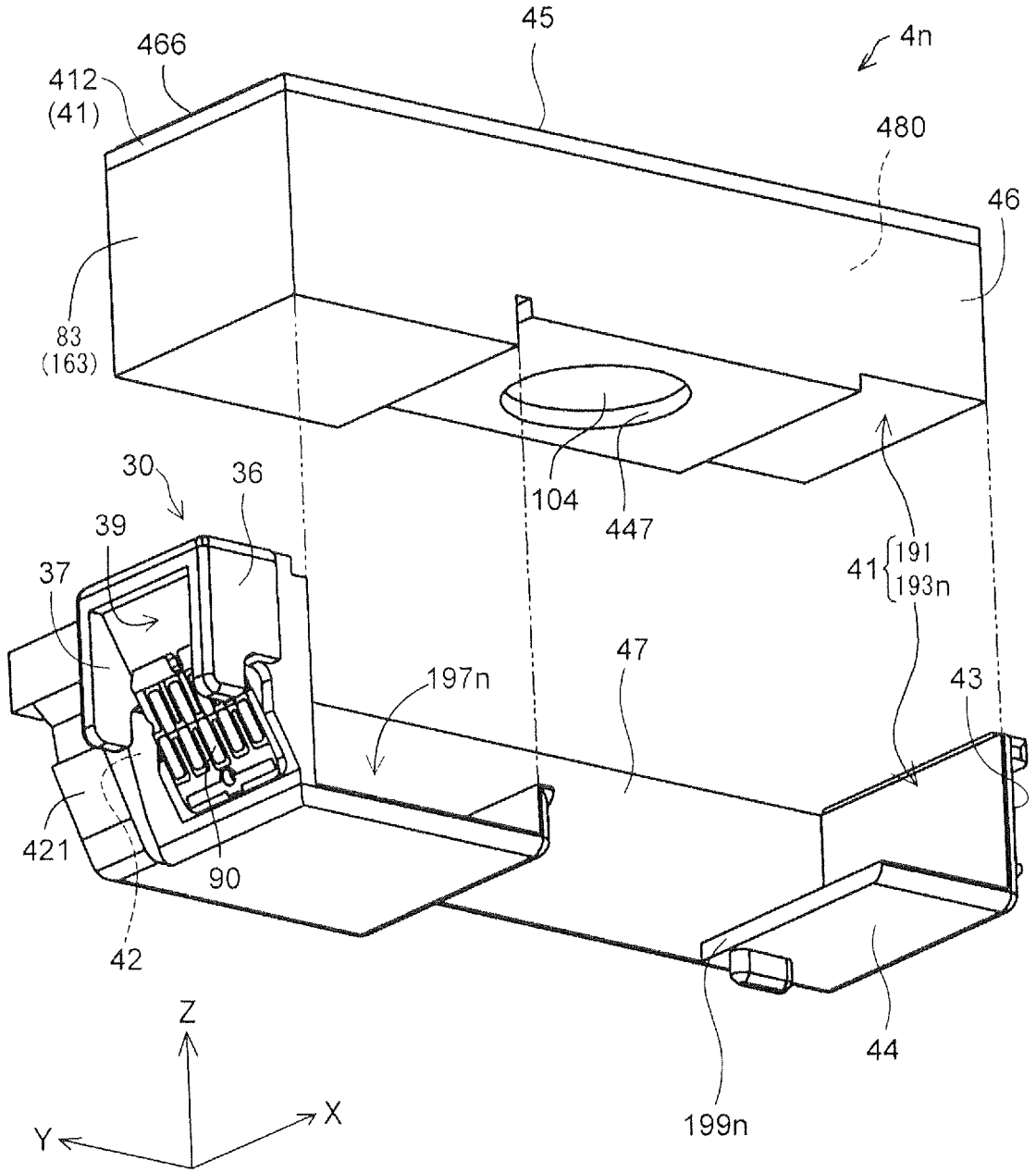
FIG. 53 is a perspective view showing a configuration of another cartridge that employs an adapter.

FIG. 53 is a perspective view showing the configuration of another cartridge 4*n* that employs an adapter. The cartridge 4*n* can be separated into an adapter 193*n* and the storage member 191 that has the liquid storage portion 480. When the ink in the liquid storage portion 480 has run out, the user replaces the storage member 191 with a new one, or fills the liquid storage portion 480 with ink. The adapter 193*n* is reusable. This cartridge 4*n* is interchangeable with the cartridge 4 (FIG. 9) of the first embodiment.

A difference between the cartridge 4*m* shown in FIGS. 51 and 52 and the cartridge 4*n* shown in FIG. 53 is the configuration of the adapter 193*n*. Other configurations such as the storage member 191 are similar to those of the cartridge 4*m*, and therefore the same reference signs will be used for the similar configurations, and descriptions will not be given for them.

The outer shell 41 of the cartridge 4*n* is constituted by a combination of the outer shell of the storage member 191 and the outer shell of the adapter 193*n*. The storage member 191 constitutes the fourth plane 45 and the fifth plane 46 of the outer shell 41 of the cartridge 4*n*.

The adapter 193*n* includes the first plane 44, the second plane 42, the third plane 43, and the sixth plane 47 of the outer shell 41 of the cartridge 4*n*. The planes of the adapter 193*n* that correspond to the fourth plane 45 and the fifth plane 46 of the outer shell 41 of the cartridge 4*n* form an opening.

The adapter 193*n* has a receiving portion 197*n*, which is a space for receiving insertion of the storage member 191. Also, an opening 199*n* for exposing the liquid supply portion 447 to the liquid introduction portion 703 is formed in the first plane 44 at a position that corresponds to the liquid supply portion 447. When the storage member 191 is stored in the receiving portion 197*n* of the adapter 193*n*, the liquid supply portion 447 can be connected to the liquid introduction portion 703 via the opening 199*n*. The adapter 193*n* is provided with members corresponding to members of the cartridge mounting portion 7 such as the contact mechanism 30 and the lever 421. As described above, the cartridge 4*n* may be constituted by the storage member 191 and the adapter 193*n*.

Figure 54:
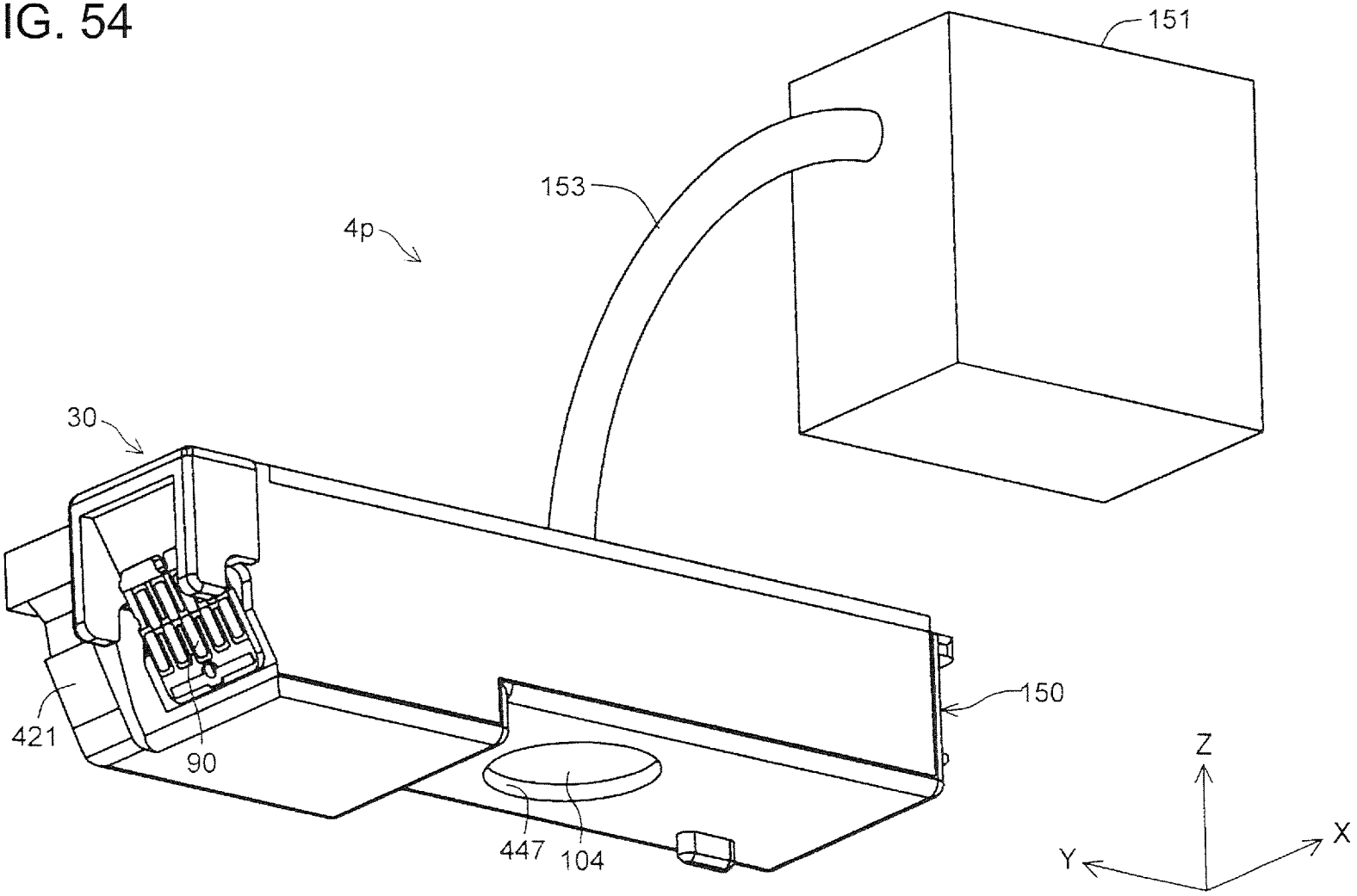
FIG. 54 is a perspective view showing the configuration of the other cartridge that employs an adapter.
Figure 55:
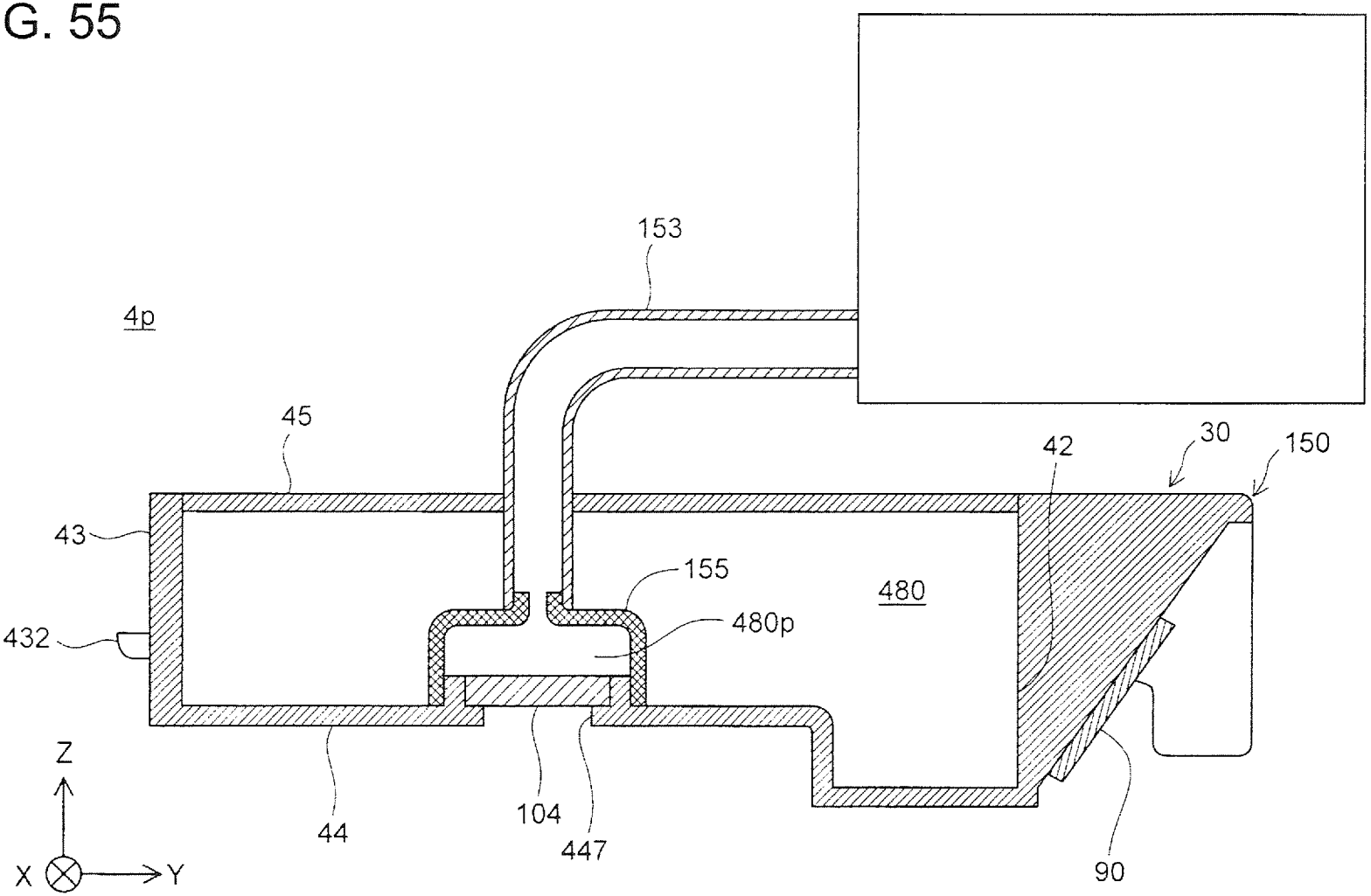
FIG. 55 is a schematic diagram for describing a cartridge.

FIG. 54 is a perspective view showing the configuration of another cartridge 4*p* that employs an adapter. FIG. 55 is a schematic diagram for describing the cartridge 4*p*. As shown in FIG. 54, the cartridge 4*p* includes an adapter 150, an external tank 151, a tube 153, and an auxiliary adapter 155 (FIG. 55). The configuration of the adapter 150 is similar to the configuration of the cartridge 4 of the first embodiment, with the exception of the configuration of the holding member 102 and the configuration of the fourth plane 45.

Ink is stored in the external tank 151. The external tank 151 is placed outside the printer 10 shown in FIG. 1. As shown in FIG. 55, the first liquid holding member 104 is arranged inside the liquid storage portion 480. The auxiliary adapter 155 is attached so as to cover the first liquid holding member 104 inside the liquid storage portion 480. Accordingly, an internal storage portion 480*p* defined by the auxiliary adapter 155 is formed inside the liquid storage portion 480. The first liquid holding member 104 is arranged inside the internal storage portion 480*p*. One portion of the tube 153 is inserted into the liquid storage portion 480 via an opening formed in the fourth plane 45. The tube 153 puts the external tank 151 and the internal storage portion 480*p* in communication with each other. When the ink in the external tank 151 has run out, the user replaces the external tank 151 with a new one, or fills the external tank 151 with ink. The adapter 150 is reusable. This cartridge 4*p* is interchangeable with the cartridge 4 (FIG. 9) of the first embodiment. In other words, the adapter 150 is configured so as to be able to be mounted to and removed from the cartridge mounting portion 7. Note that the adapter 150 may be configured so as to not include the fourth plane 45. Also, the first liquid holding member 104 does not need to be stored inside the internal storage portion 480*p*. For example, a member that can hold ink and is arranged in connection with the storage member 191 may be stored inside the internal storage portion 480*p*. Examples of a member that can hold ink include a porous member such as a sponge, and the non-woven material of this embodiment.

Figure 56:
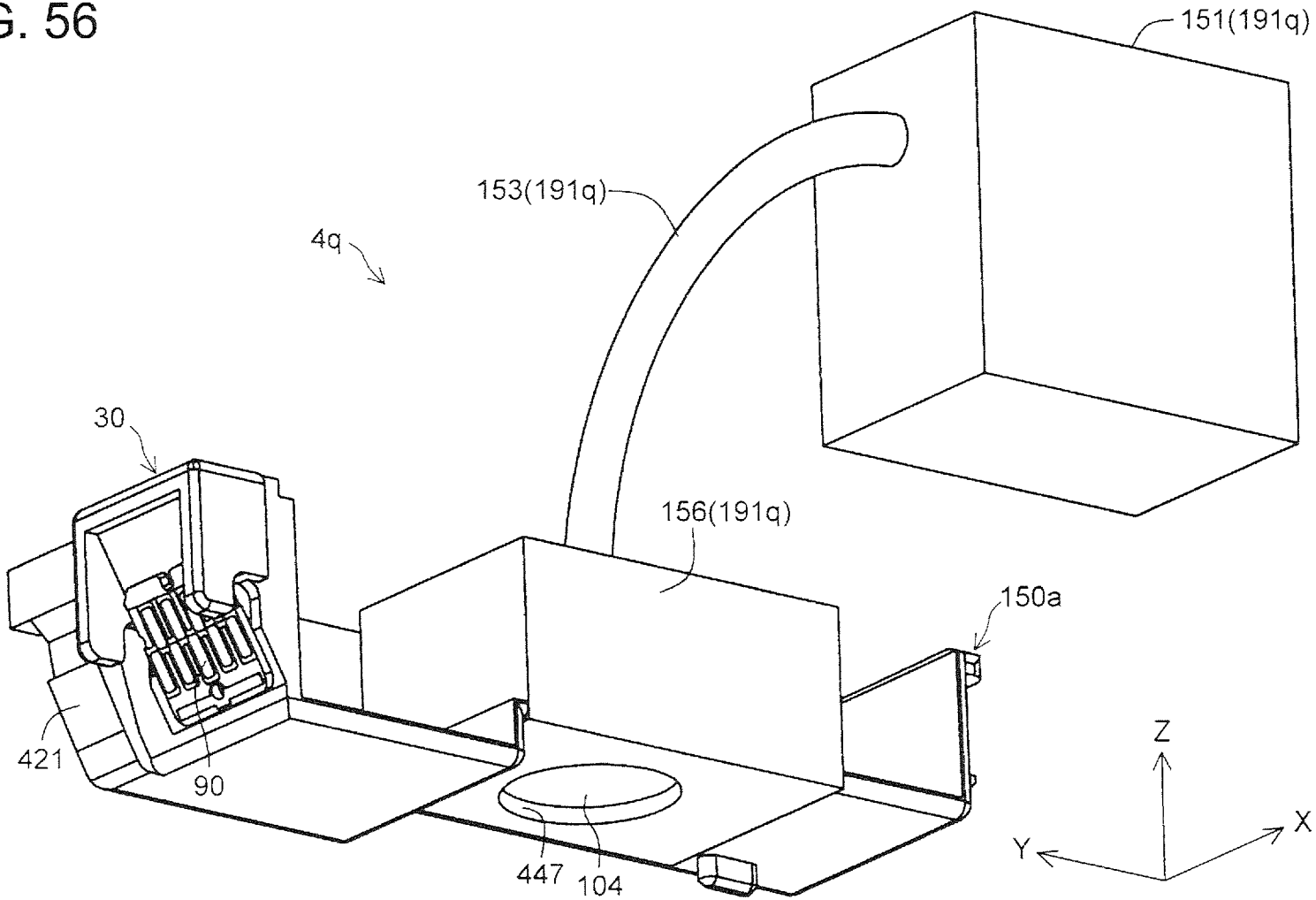
FIG. 56 is a perspective view showing a configuration of another cartridge that employs an adapter.

FIG. 56 is a perspective view showing the configuration of another cartridge 4*q* that employs an adapter. The cartridge 4*q* includes an adapter 150*a*, the external tank 151, the tube 153, and an auxiliary adapter 156. The configuration of the adapter 150*a* is similar to the configuration of the adapter 193*n* described with reference to FIG. 53. Ink is stored in the external tank 151. The external tank 151 is arranged outside the printer 10 shown in FIG. 1.

The auxiliary adapter 156 includes the liquid supply portion 447. Also, the auxiliary adapter is a casing. The first liquid holding member 104 is stored inside the auxiliary adapter 156. The first liquid holding member 104 is arranged so as to be in contact with the liquid supply portion 447. Note that the first liquid holding member 104 does not need to be stored inside the internal storage portion 480*p*. For example, a member that can hold ink and is arranged in connection with the storage member 191 may be stored inside the internal storage portion 480*p*. Examples of a member that can hold ink include a porous member such as a sponge, and the non-woven material of this embodiment.

The tube 153 puts the auxiliary adapter 156 and the external tank 151 in communication with each other. The tube 153 allows ink in the external tank 151 to flow to the auxiliary adapter 156. The external tank 151, the tube 153, and the auxiliary adapter 156 function as a storage member 191*q* for storing ink. The storage member 191*q* and the adapter 150*a* can be separated from each other. When the ink in the external tank 151 has run out, the user replaces the external tank 151 with a new one, or fills the external tank 151 with ink. The adapter 150*a* is reusable. This cartridge 4*q* is interchangeable with the cartridge 4 (FIG. 9) of the first embodiment.

Figure 57:
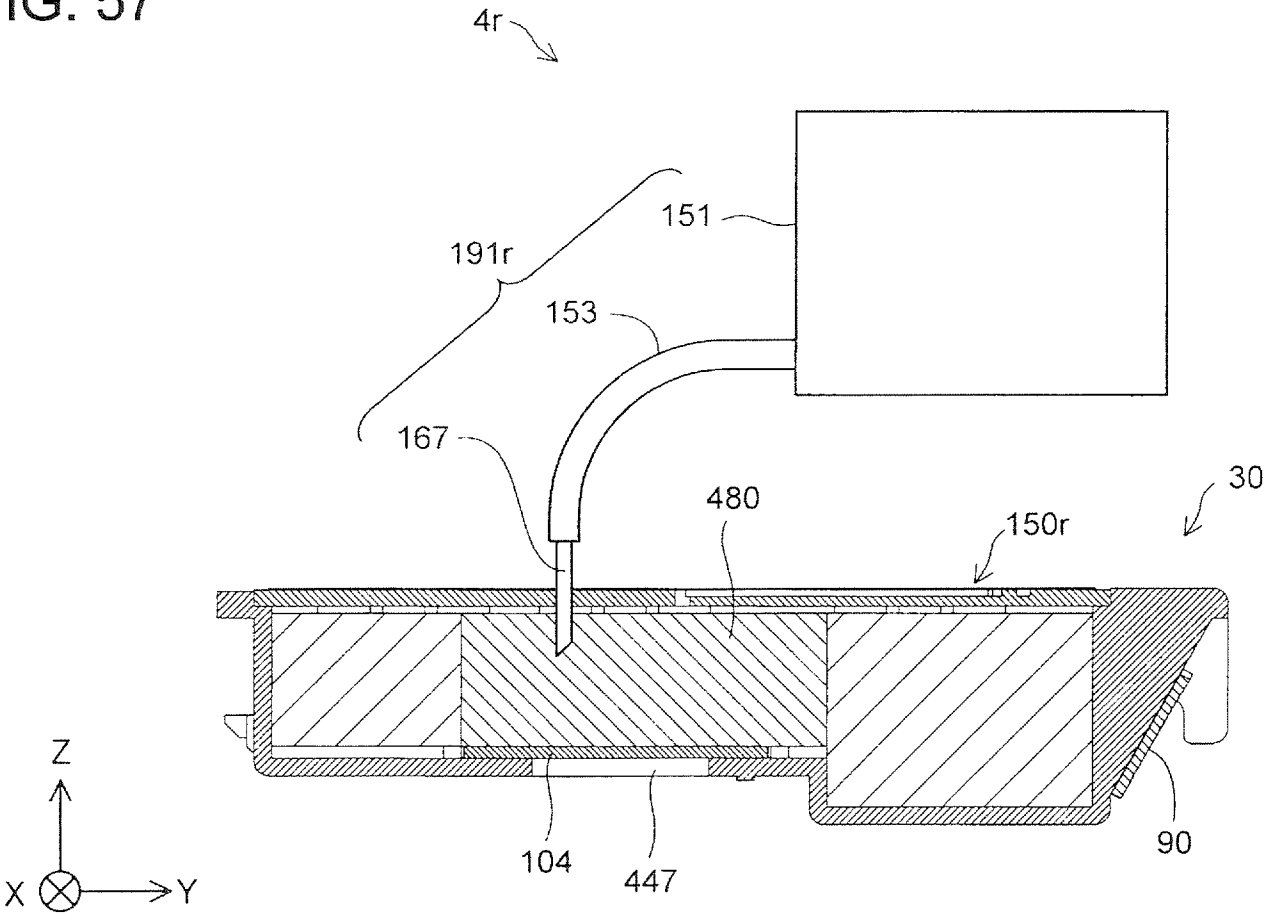
FIG. 57 is a perspective view showing the configuration of the other cartridge that employs an adapter.

FIG. 57 is a diagram for describing another cartridge 4*r* that employs an adapter. The cartridge 4*r* includes an adapter 150*r*, the external tank 151, the tube 153, and a flow needle 167. The configuration of the adapter 150*r* is similar to the configuration of the cartridge 4 of the first embodiment. Ink is stored in the external tank 151. The external tank 151 is arranged outside the printer 10 shown in FIG. 1.

The flow needle 167 is inserted into the liquid storage portion 480. The external tank 151 and the liquid storage portion 480 are put in communication with each other through the flow needle 167 and the tube 153. The external tank 151, the tube 153, and the flow needle 167 function as a storage member 191*r* for storing ink. The storage member 191*r* and the adapter 150*r* can be separated from each other. When the ink in the external tank 151 has run out, the user replaces the external tank 151 with a new one, or fills the external tank 151 with ink. The adapter 150*r* is reusable. This cartridge 4*r* is interchangeable with the cartridge 4 (FIG. 9) of the first embodiment.

The above-described cartridges 4*m* to 4*r* having an adapter can be applied to the other cartridges of this specification as well. For example, a similar configuration can be applied to the second cartridge 5 as well D-4: Modified Examples of Engaged Portions 36 and 37

The configurations of the engaged portions 36 and 37 are not limited to the configurations described in the above embodiments. The engaged portions 36 and 37 need only be configured so as to be able to engage with the engaging portions 84 and 85. Modified examples of the engaged portions 36 and 37 will be described below.

Figure 58:
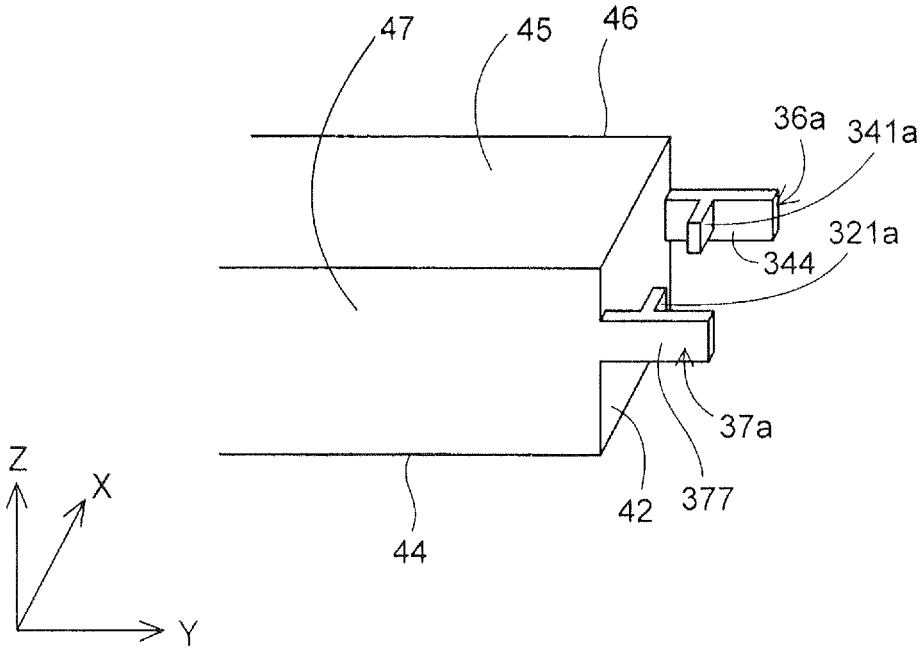
FIG. 58 is a diagram for describing a first modified example of an engaged portion.

FIG. 58 is a diagram for describing a first modified example of an engaged portion. A first engaged portion 36*a* is a member provided on the second plane 42. The first engaged portion 36*a* includes a body portion 344 that extends in the +Y axis direction and a first contact portion 341*a* that extends from the body portion 344 in the −X axis direction. A second engaged portion 37*a* is a member provided on the second plane 42. The second engaged portion 37*a* includes a body portion 377 that extends in the Y axis direction and a second contact portion 321*a* that extends from the body portion 377 in the +X axis direction.

In the mounted state, the portion of the first contact portion 341*a* that opposes the second plane 42 is engaged with the first engaging portion 84 (FIG. 7A). Accordingly, the cartridge can be restricted from moving away from the contact members 800 in resistance to elastic force Ft of the contact members 800. Also, in the mounted state, the portion of the second contact portion 321*a* that opposes the second plane 42 is engaged with the second engaging portion 85 (FIG. 7A). Accordingly, the cartridge can be restricted from moving away from the contact members 800 in resistance to elastic force Ft of the contact members 800.

Figure 59:
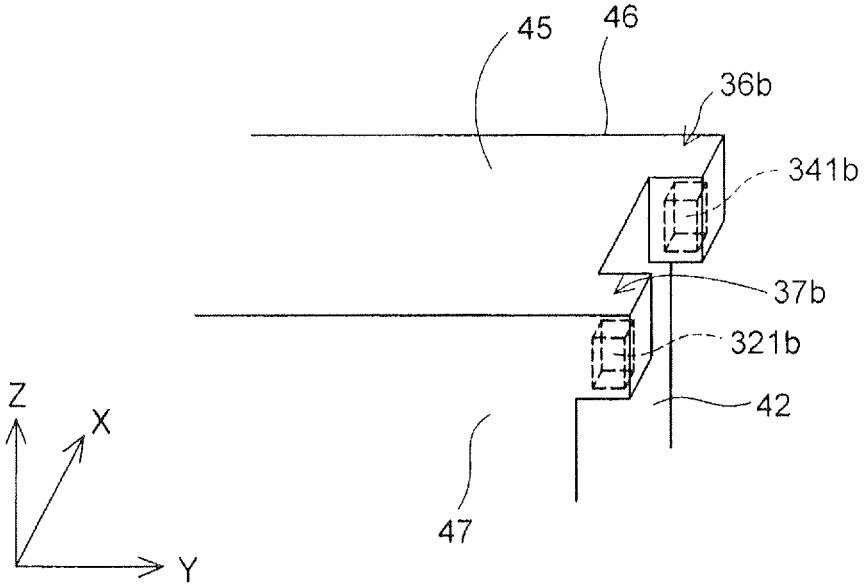
FIG. 59 is a diagram for describing the first modified example of an engaged portion.

FIG. 59 is a diagram for describing a first modified example of an engaged portion. A first engaged portion 36*b* is a member provided on the second plane 42. The first engaged portion 36*b* has a first contact portion 341*b* for receiving insertion of the first engaging portion 84 (FIG. 7A). The first contact portion 341*b* is a recessed portion that is open on the −Z axis direction (cartridge mounting direction) side. The second engaged portion 37*b* has a second contact portion 321*b* for receiving insertion of the second engaging portion 85 (FIG. 7A). The second contact portion 321*b* is a recessed portion that is open on the −Z axis direction side. In the mounted state, the inner planes of the first contact portion

341*b* and the first engaging portion 84 are engaged with each other due to the first engaging portion 84 being inserted into the first contact portion 341*b*. Accordingly, the cartridge can be restricted from moving away from the contact members 800 in resistance to elastic force Ft of the contact members 800. In the mounted state, the inner planes of the second contact portion 321*b* and the second engaging portion 85 are engaged with each other due to the second engaging portion 85 being inserted into the second contact portion 321*b*. Accordingly, the cartridge can be restricted from moving away from the contact members 800 in resistance to elastic force Ft of the contact members 800.

Note that the above-described modified examples of engaged portions are applicable to other cartridge of this specification as well. For example, a similar configuration can be applied to the second cartridge 5 as well.

D-5: Other Modified Examples

D-5-1: First Modified Example

Although the cartridge includes the lever 421 in the above embodiments and modified examples, the lever 421 can be omitted. The cartridge need only include a configuration able to restrict movement of the second plane 42 side in the vertically upward direction in the mounted state. For example, a member (contact member) realizing the functionality of the contact portion 424 may be included in place of the lever 421. The following describes a specific example of this.

Figure 60:
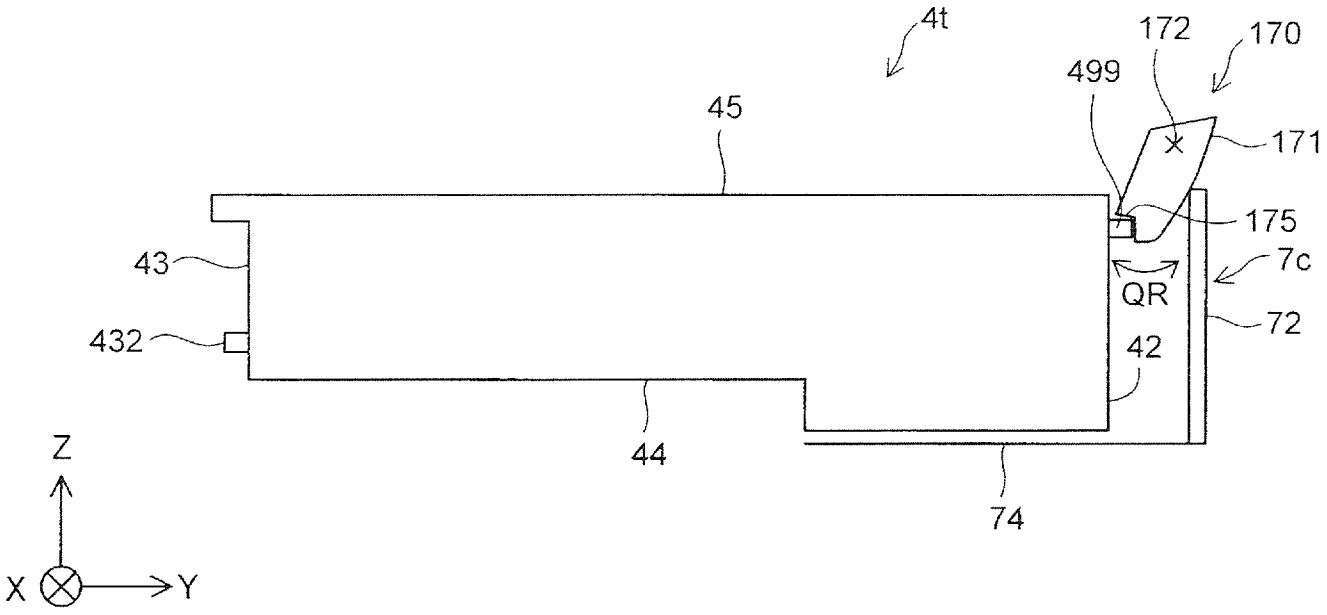
FIG. 60 is a diagram for describing a modified example of a contact member.

FIG. 60 is a diagram for describing a modified example of a contact member. A cartridge 4*t* shown in FIG. 60 includes a contact member 499 in place of the lever 421. Since the other configurations are similar to those of the cartridge 4 of the first embodiment, the same reference signs will be used for the similar configurations, and descriptions will not be given for them. A cartridge mounting portion 7*c* includes a lever 170 on the first device-side side wall 72. The lever 170 is used when mounting and removing the cartridge 4*t*. The contact member 499 is a projection provided on the second plane 42. As shown in FIG. 60, the lever 170 is engaged with the contact member 499 in the mounted state. Movement of the cartridge 4*t* on the second plane 42 side in the vertically upward direction is restricted due to the engagement of the lever 170 and the contact member 499. The lever 170 has a rotation shaft 172. An engaging portion 175 can move in an arrow QR direction about the rotation shaft 172. By applying external force in the −Y axis direction to an operation unit 171 of the lever 170, the user can move the lever 170 in a direction such that the engaging portion 175 disengages (+Y axis direction). Accordingly, the engagement of the contact member 499 and the lever 170 is canceled. The above-described modified example can be applied to the cartridges and cartridge mounting portions of the above-described embodiments and other modified Examples.

D-5-2: Second modified example

Although the cartridges 4 and 5 include the first and second engaged portions 36, 36A and 37, 37A in the above-described embodiments, they need only include at least either the first engaged portion 36, 36A or the second engaged portion 37, 37A. Even in this case, the reliability of contact between the contact members 800 and the terminals 930 can be raised by engaging the actually provided engaged portion(s) 36, 36A, 37, 37A with the engaging portion(s) 84, 85.

D-5-3: Third Modified Example

The invention is not limited to inkjet printers and ink cartridges for the same, and is also applicable to any liquid ejection device that ejects a liquid other than ink, and cartridges (liquid storage containers) for storing such liquid. For example, the invention is applicable to the following various types of liquid ejection devices and liquid storage containers for the same.

(1) Image recording device such as a facsimile device (2) Color material ejection device used in the manufacture of a color filter for use in an image display device such as a liquid crystal display (3) Electrode material ejection device used in electrode formation for an organic EL (Electro Luminescence) display, an FED (Field Emission Display), or the like (4) Liquid ejection device for ejecting a liquid that contains a bioorganic material used in biochip manufacture (5) Specimen ejection device for use as a precise pipette (6) Lubricating oil ejection device (7) Resin liquid ejection device (8) Liquid ejection device for the pinpoint ejection of lubricating oil in a precision machine such as a clock or camera (9) Liquid ejection device for ejecting a transparent resin liquid such as an ultraviolet curable resin liquid on a substrate in order to form, for example, microscopic semispherical lenses (optical lenses) for use in an optical communication element or the like

(10) Liquid ejection device for ejecting an acidic or alkaline etching liquid for etching a substrate or the like

(11) Liquid ejection device that includes a liquid ejection head for discharging any other microscopic droplets Note that "droplet" refers to the state of a liquid discharged from a liquid ejection device, and encompasses granular, tear-drop, and trailing string-shaped droplets. Also, the "liquid" referred to here need only be a material that can be ejected from the liquid ejection device. For example, the "liquid" need only be a material whose substance is in the liquid phase, and the "liquid" here encompasses high or low viscosity liquid materials, as wells a liquid materials such as sols, gel water, other inorganic solvents, organic solvents, solutions, liquid resins, and liquid metals (metal melts). Also, the liquid is not limited to being a one-state substance, and the "liquid" here encompasses a substance in which functional material particles made of a solid substance such as pigment or metal particles are dissolved, dispersed, or mixed in a solvent. Other representative examples of liquids include liquid crystal and ink such as that described in the above embodiments. Here, "ink" encompasses general water-based ink and oil-based ink, as well as various types of liquid compositions such as gel ink and hot-melt ink.

D-5-4: Fourth Modified Example

The invention can also be carried out in aspects such as the following. Portions in the following aspects that include configurations similar to those in the above embodiments or modified examples have similar effects.

Aspect 1

A cartridge that can be mounted to a liquid ejection device that includes a contact member, a first engaging portion, and a liquid introduction portion that can introduce a liquid, the cartridge including:

a liquid storage portion for storing the liquid;

a liquid supply portion for supplying the liquid from the liquid storage portion to the liquid introduction portion;

a first engaged portion for being engaged with the first engaging portion; and a terminal for coming into contact with the contact member, wherein the first engaged portion and the first engaging portion can become engaged when biasing force that includes a first direction component is applied to the terminal by the contact member.

Aspect 2

The cartridge according to the first aspect, further including:

a second engaged portion for being engaged with a second engaging portion that the liquid ejection device includes, wherein the second engaged portion and the second engaging portion can become engaged when the terminal is subjected to the biasing force.

Aspect 3

The cartridge according to the second aspect, wherein the terminal is arranged at a position sandwiched by the first engaged portion and the second engaged portion.

Aspect 4

The cartridge according to the second or third aspect, wherein a first portion of the first engaged portion that is engaged with the first engaging portion by coming into contact therewith, a second portion of the second engaged portion that is engaged with the second engaging portion by coming into contact therewith, and a third portion (contact portion cp) of the terminal that comes into contact with the contact member are arranged on the same straight line.

Aspect 5

The cartridge according to any one of the second to fourth aspects, further including:

a circuit substrate that includes the terminal; and an arrangement portion for arrangement of the circuit substrate, wherein the arrangement portion has an arrangement plane that is inclined relative to a vertical direction that is orthogonal to the first direction in a mounted state in which the cartridge has been mounted to the liquid ejection device, and the circuit substrate is arranged on the arrangement plane.

Aspect 6

The cartridge according to the fifth aspect, wherein the first engaged portion has a first opposing portion that, in a mounting process for mounting the cartridge to the liquid ejection device, opposes a first end portion of the first engaging portion located on a vertically upward direction side.

Aspect 7

The cartridge according to the sixth aspect, wherein the second engaged portion has a second opposing portion that, in the mounting process, opposes a second end portion of the second engaging portion located on a vertically upward direction side, and in the mounted state, the arrangement portion is arranged at a position sandwiched by the first engaging portion and the second engaging portion.

Aspect 8

The cartridge according to any one of the fifth to seventh aspects, wherein the arrangement portion is arranged at a position sandwiched by the first engaged portion and the second engaged portion.

Aspect 9

The cartridge according to any one of the second to eight aspects, wherein the terminal and the first engaged portion are arranged on the same side of the liquid storage portion.

Aspect 10

The cartridge according to the ninth aspect, wherein the terminal and the first engaged portion are arranged on a different side of the liquid storage portion than the side on which the liquid supply portion is located.

Aspect 11

The cartridge according to any one of the second to tenth aspects, wherein the terminal and the second engaged portion are arranged on the same side of the liquid storage portion.

Aspect 12

The cartridge according to the eleventh aspect, wherein the terminal and the second engaged portion are arranged on a different side of the liquid storage portion than the side on which the liquid supply portion is located.

Aspect 13

A cartridge that can be mounted to a cartridge mounting portion of a liquid ejection device that includes:

the cartridge mounting portion for mounting of the cartridge;

a liquid introduction portion that is arranged on a device-side bottom wall forming a bottom plane of the cartridge mounting portion, and is for introducing a liquid; and a connector that is arranged on a first device-side side wall that intersects with the device-side bottom wall, and includes:

a connector body;

a first engaging portion that is fixed to the connector body;

a second engaging portion that is fixed to the connector body; and a contact member that is fixed to the connector body at a position sandwiched by the first engaging portion and the second engaging portion, the cartridge comprising:

a liquid storage portion for storing the liquid;

a liquid supply portion for supplying the liquid from the liquid storage portion to the liquid introduction portion;

a first engaged portion for being engaged with the first engaging portion;

a second engaged portion for being engaged with the second engaging portion; and a terminal that is for coming into contact with the contact member, and is arranged at a position sandwiched by the first engaged portion and the second engaged portion, wherein when biasing force that includes a first direction component is applied to the terminal by the contact member, the first engaged portion can become engaged with the first engaging portion, and the second engaged portion can become engaged with the second engaging portion.

Aspect 14

The cartridge according to the thirteenth aspect, wherein in a mounted state in which the cartridge has been mounted to the liquid ejection device, the cartridge is transported in a transport direction by the liquid ejection device, and in the mounted state, the first engaged portion and the second engaged portion are arranged at positions that sandwich the connector body.

Aspect 15

The cartridge according to the thirteenth or fourteenth aspect, further including:

a circuit substrate that includes the terminal; and an arrangement portion for arrangement of the circuit substrate, wherein in a mounted state in which the cartridge has been mounted to the liquid ejection device, the cartridge is transported in a transport direction by the liquid ejection device, and in the mounted state, the first engaged portion and the second engaged portion are arranged at positions that sandwich the arrangement portion.

Aspect 16

The cartridge according to the fifteenth aspect, wherein the arrangement portion has an arrangement plane that is inclined relative to a vertical direction that is orthogonal to the first direction in the mounted state, and the circuit substrate is arranged on the arrangement plane.

Aspect 17

The cartridge according to the sixteenth aspect, wherein the first engaged portion has a first opposing portion that, in a mounting process for mounting the cartridge to the liquid ejection device, opposes a first end portion of the first engaging portion located on a vertically upward direction side, wherein the second engaged portion has a second opposing portion that, in the mounting process, opposes a second end portion of the second engaging portion located on a vertically upward direction side, and in the mounted state, the arrangement portion is arranged at a position sandwiched by the first engaging portion and the second engaging portion.

Aspect 18

The cartridge according to any one of the fifteenth to seventeenth aspects, wherein the arrangement portion is arranged at a position sandwiched by the first engaged portion and the second engaged portion.

Aspect 19

The cartridge according to any one of the thirteenth to eighteenth aspects, wherein a first portion of the first engaged portion that comes into contact with the first engaging portion, a second portion of the second engaged portion that comes into contact with the second engaging portion, and a third portion of the terminal that comes into contact with the contact member are arranged on the same straight line.

Aspect 20

The cartridge according to any one of the thirteenth to nineteenth aspects, wherein the terminal, the first engaged portion, and the second engaged portion are arranged on the same side of the liquid storage portion.

Aspect 21

The cartridge according to any one of the thirteenth to twentieth aspects, wherein the terminal, the first engaged portion, and the second engaged portion are arranged on a portion of an outer shell of the cartridge that opposes the first side plane in a mounted state in which the cartridge has been mounted to the liquid ejection device.

Aspect 22

The cartridge according to any one of the first to twenty-first aspects, wherein the biasing force includes the first direction component and a second direction component that is orthogonal to the first direction component, the second direction component being a vertically upward direction component in a mounted state in which the cartridge has been mounted to the liquid ejection device, and the cartridge further includes a restricted portion (contact portion 424) for being engaged with a restriction portion (mounting/removal portion 722) of the liquid ejection device, the restricted portion becoming engaged with the restriction portion when force of the second direction component is applied to the terminal by the contact member.

Aspect 23

The cartridge according to the twenty-second aspect, wherein the restricted portion is arranged so as to be adjacent to the first engaged portion.

Aspect 24

The cartridge according to the twenty-second or twenty-third aspect, wherein the restricted portion and the first engaged portion are arranged on the same side of the liquid storage portion.

Aspect 25

A cartridge that can be mounted to a liquid ejection device that includes a contact member, a first engaging portion, and a liquid introduction portion that can introduce a liquid, the cartridge including:

a liquid storage portion for storing the liquid;

a liquid supply portion for supplying the liquid from the liquid storage portion to the liquid introduction portion;

a first plane on which the liquid supply portion is formed;

a fourth plane that opposes the first plane;

a second plane and a third plane that each intersect with the first plane and the fourth plane, and that oppose each other;

a fifth plane that intersects with the first plane, the second plane, the third plane, and the fourth plane;

a sixth plane that opposes the fifth plane;

a first engaged portion for being engaged with the first engaging portion, and that is provided on the second plane side of the liquid storage portion; and a terminal for coming into contact with the contact member, and that is provided on the third plane side of the liquid storage portion, wherein the first engaged portion and the first engaging portion can become engaged with each other when a biasing force that includes a first direction component is applied to the terminal by the contact member, the first direction component being the direction in which the second plane and the third plane oppose each other, and furthermore the direction from the second plane to third plane.

Aspect 26

The cartridge according to the twenty-fifth aspect, further including:

a second engaged portion for being engaged with a second engaging portion that the liquid ejection device includes, and that is provided on the second plane side of the liquid supply portion, wherein the second engaged portion and the second engaging portion can become engaged when the biasing force is applied to the terminal.

Aspect 27

The cartridge according to the twenty-sixth aspect, wherein the first engaged portion and the second engaged portion are arranged with a gap therebetween in a direction in which the fifth plane and the sixth plane oppose each other, and the terminal is arranged at a position sandwiched by the first engaged portion and the second engaged portion.

Aspect 28

The cartridge according to the twenty-sixth or twenty-seventh aspect, wherein a first portion of the first engaged portion that comes into contact with the first engaging portion, a second portion of the second engaged portion that comes into contact with the second engaging portion, and a third portion of the terminal that comes into contact with the contact member are arranged on the same straight line.

Aspect 29

The cartridge according to any one of the twenty-sixth to twenty-eighth aspects, further including:

a circuit substrate that includes the terminal; and an arrangement portion that is provided on the second plane and has an arrangement plane on which the circuit substrate is arranged, wherein the arrangement plane is inclined relative to the first plane so as to extend in a direction from the third plane side toward the second plane side as it extends from the first plane side toward the fourth plane side.

Aspect 30

The cartridge according to the twenty-ninth aspect, wherein the first engaged portion has a first opposing portion that, in a mounting process for mounting the cartridge to the liquid ejection device, opposes a first end portion that is a portion of the first engaging portion and is located at an end portion on the side in a direction that is orthogonal to the first direction and is from the first plane toward the fourth plane.

Aspect 31

The cartridge according to the twenty-ninth or thirtieth aspect, wherein the second engaged portion has a second opposing portion that, in a mounting process for mounting the cartridge to the liquid ejection device, opposes a second end portion that is a portion of the second engaging portion and is located at an end portion on the side in a direction that is orthogonal to the first direction and is from the first plane toward the fourth plane, and in the mounted state, the arrangement portion is arranged at a position sandwiched by the first engaging portion and the second engaging portion.

Aspect 32

The cartridge according to any one of the twenty-ninth to thirty-first aspects, wherein the arrangement portion is arranged at a position sandwiched by the first engaged portion and the second engaged portion.

Aspect 33

The cartridge according to any one of the twenty-fifth to thirty-second aspects, wherein the biasing force includes the first direction component and a second direction component that is orthogonal to the first direction component, the second direction component being a direction in which the first plane and the fourth plane oppose each other, and furthermore a direction from the first plane toward the fourth plane, the cartridge further includes a restricted portion (contact portion 424) for being engaged with a restriction portion (mounting/removal portion 722) of the liquid ejection device, the restricted portion becoming engaged with the restriction portion when force of the second direction component is applied to the terminal by the contact member, and the restricted portion is provided on the second plane side of the liquid storage portion.

Aspect 34

The cartridge according to the thirty-third aspect, wherein the restricted portion is arranged so as to be adjacent to the first engaged portion.

Aspect 35

A liquid ejection device including:

a cartridge mounting portion to which a cartridge can be mounted, the cartridge mounting portion having a device-side bottom wall and a first device-side side wall that define the cartridge mounting portion, the first device-side side wall intersecting with the device-side bottom wall;

a liquid introduction portion that is arranged on the device-side bottom wall and is able to introduce liquid stored in the cartridge; and a connector that is arranged on the first device-side side wall and is able to be electrically connected to a terminal of the cartridge, wherein the connector has:

a connector body;

a first engaging portion that is fixed to the connector body and is for being engaged with the cartridge; and a contact member that is fixed to the connector body and is for being connected to the terminal, and in a mounted state in which the cartridge has been mounted to the cartridge mounting portion, the first engaging portion becomes engaged with the first engaged portion of the cartridge due to the contact member coming into contact with the terminal and a biasing force in a direction that includes a first direction component being applied to the terminal.

Aspect 36

The liquid ejection device according to the thirty-fifth aspect, wherein the connector further has a second engaging portion that is fixed to the connector body and is for being engaged with the cartridge, the contact member is arranged at a position sandwiched by the first engaging portion and the second engaging portion, and in the mounted state, the second engaging portion becomes engaged with the second engaged portion of the cartridge due to the contact member coming into contact with the terminal and the biasing force being applied to the terminal.

Aspect 37

A liquid ejection system including:

the cartridge according to any one of the first to thirty-fourth aspects; and a liquid ejection device that discharges liquid to the outside when liquid is supplied from the cartridge, the liquid ejection device including:

a cartridge mounting portion to which the cartridge can be mounted, the cartridge mounting portion having a bottom plane and a side plane that define the cartridge mounting portion, the side plane intersecting with the bottom plane;

a liquid introduction portion that is arranged on the bottom plane and is able to introduce liquid stored in the cartridge; and a connector that is arranged on the side plane and can be electrically connected to a terminal of the cartridge.

The invention is not limited to the above-described embodiments, working examples, or modified examples, and the invention can be implemented with various configurations without departing from the spirit of the invention. For example, technical features in the embodiments, working examples, and modified examples that correspond to technical features in the modes described in the Summary section can be replaced and combined as necessary in order to solve some or all of the above-described issues or achieve some or all of the above-described effects. Also, technical features not described as being essential in the specification can be omitted as necessary.

What is claimed is:

1. A cartridge configured to be removably mounted to a liquid ejection device, the liquid ejection device comprising a first row and second row of conductive contact members arranged along a first direction, and a liquid introduction portion, the cartridge being configured to be received by a first force in a second direction that is perpendicular to the first direction from the first row and second row of conductive contact members and from the liquid introduction portion and by a second force in a third direction perpendicular to the first direction and second direction from the first and second rows of conductive contact members in a state that the cartridge is mounted on the liquid ejection device, the cartridge comprising:

a liquid supply portion configured to be connected to the liquid introduction portion;

a first row of contact portions arranged along the first direction and configured to come into contact with the first row of conductive contact members;

a second row of contact portions arranged along the first direction and configured to come into contact with the second row of conductive contact members;

a first engaged portion configured to be engaged with the liquid ejection device; and a second engaged portion configured to be engaged with the liquid ejection device, wherein:

the first engaged portion has a first opposing portion that, in a mounting process for mounting the cartridge to the liquid ejection device, opposes a first end portion of the liquid ejection device located on a side facing the second direction, the second engaged portion has a second opposing portion that, in a mounting process for mounting the cartridge to the liquid ejection device, opposes a second end portion of the liquid ejection device located on the side facing the second direction, the first and second engaged portions are configured so as to, when in a state of being engaged with the liquid ejection device, restrict the first and second rows of contact portions from moving away from the first and second rows of conductive contact members, and a central contact portion is located at a center among the first row of the contact portions and is passed by a plane that passes through a central point between the first and second engaged portions and that is perpendicular to the first direction.

2. The cartridge according to claim 1, wherein:

the first engaged portion is a first hook including the first opposing portion and a first contact portion configured to contact the liquid ejection device, the first opposing portion and the first contact portion defining a first recessed portion, and the second engaged portion is a second hook including the second opposing portion and a second contact portion configured to contact the liquid ejection device, the second opposing portion and the second contact portion define a second recessed portion.

3. The cartridge according to claim 1, wherein the central contact portion is located at a center position among the first and second rows of contact portions in the first direction.

4. The cartridge according to claim 1, wherein a first distance between a center of the liquid supply portion and a portion where the liquid ejection device and the first engaged portion come into contact is greater than a second distance between the center of the liquid supply portion and a portion where one of the first row of conductive contact members and corresponding one of the first row of contact portions come into contact, wherein the first and second distances are measured in the third direction.

5. The cartridge according to claim 4, wherein the first distance is greater than a third distance between the center of the liquid supply portion and a portion where one of the second row of conductive contact members and corresponding one of the second row of contact portions come into contact, the third distance being measured in the third direction.

6. The cartridge according to claim 4, wherein the second distance is shorter than a third distance between the center of the liquid supply portion and a portion where one of the second row of conductive contact members and corresponding one of the second row of contact portions come into contact, the third distance being measured in the third direction.

7. The cartridge according to claim 6 further comprising:

a third engaged portion configured to be engaged with the liquid ejection device, wherein the third engaged portion is configured to be used as a rotation support when the cartridge is mounted to the liquid ejection device before the first row of contact portions come into contact with the first row of conductive contact members.

8. The cartridge according to claim 1, wherein contact portions in the second row of contact portions are located between the first engaged portion and the second engaged portion in the first direction.

9. The cartridge according to claim 1, wherein contact portions in the first row of contact portions are arranged at different positions from contact portions in the second row of contact portions in the first direction.

10. The cartridge according to claim 1, wherein the first engaged portion has a first abutting portion that, in a mounting process for mounting the cartridge to the liquid ejection device, abuts the liquid ejection device in the third direction, and the second engaged portion has a second abutting portion that, in a mounting process for mounting the cartridge to the liquid ejection device, abuts the liquid ejection device in the third direction.

* * * * *